US010718155B2

(12) United States Patent
Wen et al.

(10) Patent No.: US 10,718,155 B2
(45) Date of Patent: Jul. 21, 2020

(54) LIGHT BLOCKING SYSTEM FOR VERTICAL BLIND

(71) Applicant: Nien Made Enterprise Co., Ltd., Taichung (TW)

(72) Inventors: Yu-Che Wen, Taoyuan (TW); Chih-Yao Chang, Taichung (TW); Lin Chen, Taichung (TW); Keng-Hao Nien, Taichung (TW); Chin-Tai Lu, Taichung (TW); Chao-Hung Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 254 days.

(21) Appl. No.: 15/812,390

(22) Filed: Nov. 14, 2017

(65) Prior Publication Data

US 2018/0135353 A1 May 17, 2018

Related U.S. Application Data

(60) Provisional application No. 62/421,792, filed on Nov. 14, 2016.

(51) Int. Cl.
*E06B 9/36* (2006.01)

(52) U.S. Cl.
CPC ..... *E06B 9/361* (2013.01); *E06B 9/36* (2013.01); *E06B 9/364* (2013.01); *E06B 9/367* (2013.01)

(58) Field of Classification Search
CPC . E06B 9/361; E06B 9/36; E06B 9/367; E06B 9/364; E06B 9/362; E06B 9/26
USPC ..... 160/38, 176.1 V
See application file for complete search history.

(56) References Cited

U.S. PATENT DOCUMENTS

| | | | | | |
|---|---|---|---|---|---|
| 2,577,884 | A | * | 12/1951 | Garubo | E06B 3/928 160/172 R |
| 2,653,656 | A | * | 9/1953 | Kuebler | A47H 1/04 160/19 |
| 2,854,071 | A | * | 9/1958 | Toti | E06B 9/367 160/176.1 R |
| 2,876,834 | A | * | 3/1959 | Walker | E06B 9/306 160/168.1 R |
| 4,222,427 | A | * | 9/1980 | Buchner | A47H 2/00 16/94 R |

(Continued)

FOREIGN PATENT DOCUMENTS

| | | |
|---|---|---|
| CN | 205206704 U | 5/2016 |
| JP | 48-59335 | 7/1973 |

(Continued)

*Primary Examiner* — Katherine W Mitchell
*Assistant Examiner* — Jeremy C Ramsey
(74) *Attorney, Agent, or Firm* — Winston Hsu

(57) ABSTRACT

A light blocking system is disclosed, which is adapted to be used in a vertical blind which includes a headrail, a control mechanism provided in the headrail, and a covering assembly including a plurality of slats. Each of the slats is connected to the control mechanism with an end thereof, and therefore is hung below the headrail. A gap is left between the covering assembly and the headrail. The control mechanism is adapted to turn the slats in situ relative to the headrail, or to move the slats back and forth in a longitudinal direction of the headrail. The light blocking system includes a cover plate provided corresponding to the gap, wherein the cover plate covers the gap when the covering assembly is in a closed state.

11 Claims, 43 Drawing Sheets

(56) References Cited

U.S. PATENT DOCUMENTS

| | | | | |
|---|---|---|---|---|
| 5,179,990 | A * | 1/1993 | Marocco | E06B 9/322 160/176.1 V |
| 5,301,733 | A | 4/1994 | Toti | |
| 5,515,901 | A * | 5/1996 | Hall | E05D 15/264 160/206 |
| 7,686,059 | B2 * | 3/2010 | Jarosinski | E06B 9/322 160/167 R |
| 10,316,582 | B2 * | 6/2019 | Wen | E06B 9/323 |
| 2016/0326799 | A1 | 11/2016 | Marocco | |

FOREIGN PATENT DOCUMENTS

| | | |
|---|---|---|
| JP | 48-101740 | 12/1973 |
| JP | 2004-19183 | 1/2004 |

* cited by examiner (Prior Art)

LIGHT BLOCKING SYSTEM FOR VERTICAL BLIND

CROSS-REFERENCE TO RELATED APPLICATIONS

This application claims all benefits accruing under 35 U.S.C. § 119 from U.S. provisional application No. 62/421,792 filed on Nov. 14, 2016, the entirety of which is incorporated by reference herein.

BACKGROUND OF THE INVENTION

1. Technical Field

The present invention relates generally to a light blocking system, and more particularly to a light blocking system for a vertical blind, wherein the light blocking system is adapted to cover the gap between a headrail and a covering assembly which is assembled below, whereby to prevent light from passing through the gap when the covering assembly is in a closed state.

2. Description of Related Art

A conventional vertical blind is shown in FIG. 1 and FIG. 2, which includes a headrail 1 and a plurality of slats 2 hung below the headrail 1, wherein the headrail 1 is substantially long and column-shaped, and is transversely installed above a window hole in a longitudinal direction thereof, whereby the hung slats 2 could cover the window hole. By changing the positions and the angles of the slats 2, the amount of light which is allowed to pass therethrough can be adjusted.

In a circumstance which requires a large amount of light getting in, a control member 3 can be manipulated to turn the slats 2 to an angle approximately vertical to the longitudinal direction of the headrail 1, as shown in FIG. 1. At this time, the distance between every two adjacent slats 2 is the greatest, allowing the most light to pass through. On the contrary, when it needs to block out all light or to maintain privacy, the slats 2 should be turned to an angle approximately parallel to the longitudinal direction of the headrail 1, wherein a long edge of each of the slats 2 would approach or overlap the adjacent slat 2, becoming a screen to block light out, as shown in FIG. 2.

However, for the convenience of installment, the conventional vertical blind has a gap 4 left between a top edge of the slats 2 and a bottom of the headrail 1, and the gap 4 is not covered by the slats 2. In other words, even when the slats 2 are turned to the angle parallel to the longitudinal direction of the headrail 1, there would be still light passing through the gap, and the privacy in the room may not be fully protected. In addition, a section of each of slats 2 near the headrail 1 is usually bored a hole to be hung from a clip of a turning mechanism, and these holes would also cause the problem of light leakage. Therefore, though vertical blinds are already a commonly used type of window coverings, the design still has room for improvement to provide a better light blocking and privacy protection effect, which would benefit the majority of users.

BRIEF SUMMARY OF THE INVENTION

In view of the above, the objective of the present invention is to provide a light blocking system for a vertical blind, which could provide an excellent light blocking effect when the covering assembly of the vertical blind is closed.

The present invention provides a light blocking system, which is adapted to be used in a vertical blind. The vertical blind includes a headrail, a control mechanism, and a covering assembly, wherein a gap is formed between the headrail and the covering assembly. The control mechanism includes an operable portion, a motion portion, and a plurality of clips, wherein the motion portion is provided in the headrail. The covering assembly includes a plurality of slats, wherein each of the slats is suspended from one of the clips with an end thereof, and therefore is hung below the headrail. Each of the clips is rotatably connected to the motion portion. The operable portion is exposed out of the headrail to be operated, and drives the motion portion when operated, whereby to turn the slats in situ relative to the headrail, so that the covering assembly is adapted to be sequentially changed between a closed state, a fully open state, and another closed state. When the covering assembly is in the closed state and the another closed state, the slats overlaps each other to block out light, wherein a surface of each of the slats faces opposite directions when the covering assembly is in the closed state and in the another closed state; when the covering assembly is in the fully open state, each of the slats is substantially perpendicular to a longitudinal direction of the headrail, which allows a most amount of light to pass through. The slats are operable to move back and forth in the longitudinal direction of the headrail. The light blocking system includes a cover plate, which is disposed corresponding to the gap, and covers the gap when the covering assembly is in the closed state.

In an embodiment, the cover plate also covers the gap when the covering assembly is in the another closed state.

In an embodiment, the cover plate is movable along with operation of the control mechanism. When the slats are driven to turn by the control mechanism, the cover plate is also driven by the control mechanism to cover or expose the gap.

In an embodiment, the light blocking system further includes a driving module connected to the control mechanism, wherein, when the control mechanism drives the slats to turn, the driving module is also driven by the control mechanism to move the cover plate.

In an embodiment, the motion portion includes a led gear, a link gear, and a link shaft, wherein each of the clips is rotatably connected to the link shaft. The operable portion is adapted to be operated to drive the led gear to rotate, and the led gear drives the link gear to rotate while being driven by the operable portion, so as to drive the link shaft to rotate as well, whereby to turn the slats in situ relative to the headrail. The driving module includes a mounting portion and a pushing portion, wherein the mounting portion is provided corresponding to the link shaft, and is synchronously movable with the link shaft. The pushing portion extends outward from the mounting portion, and a free end of the pushing portion optionally abuts against the cover plate. A maximum distance between the mounting portion and the free end of the pushing portion is greater than a distance between the mounting portion and the cover plate when the cover plate completely covers the gap. When the mounting portion rotates, the mounting portion drives the pushing portion to optionally push against the cover plate, so that the cover plate is pivotable relative to the headrail to cover or expose the gap.

In an embodiment, the mounting portion is connected to one of the clips or the led gear, so that the mounting portion is synchronously movable with the link shaft.

In an embodiment, the mounting portion is connected to one of the clips or the led wheel, so that the mounting portion is synchronously movable with the link shaft.

In an embodiment, the pushing portion is fixedly connected to a side of the mounting portion, so that the pushing portion is rotatable along with rotation of the mounting portion.

In an embodiment, the driving module further includes a driving portion which has external teeth provided therearound, wherein the driving portion fits around the link shaft to be synchronously moved along with the link shaft. The mounting portion is disposed between the driving portion and the pushing portion, wherein a segment of the mounting portion corresponding to the driving portion is provided with teeth to mesh with the external teeth of the driving portion, so that the mounting portion is drivable by the driving portion. A side of the pushing portion facing the mounting portion is provided with a toothed rack, and a segment of the mounting portion corresponding to the pushing portion is provided with teeth to mesh with the toothed rack. When the driving portion is rotated by the link shaft, the mounting portion drives the pushing portion to move back and forth in a direction parallel to a transverse direction of the headrail, whereby to optionally push against the cover plate.

In an embodiment, the motion portion includes a led gear, a link gear, and a link shaft, wherein each of the clips is rotatably connected to the link shaft. The operable portion is adapted to be operated to drive the led gear to rotate, and the led gear drives the link gear to rotate while being driven by the operable portion, so as to drive the link shaft to rotate as well, whereby to turn the slats in situ relative to the headrail. The driving module includes a driving portion, a mounting portion, and a pushing portion, wherein the driving portion fits around the link shaft to be synchronously moved along with the link shaft. The driving portion has external teeth provided therearound. The mounting portion is disposed on a side of the driving portion, and is pivotally connected to the headrail; the mounting portion has external teeth provided therearound to mesh with the external teeth of the driving portion, so that the mounting portion is drivable by the driving portion to pivot relative to the headrail. The pushing portion extends outward from the mounting portion, and is connected to the cover plate. When the driving portion is rotated by the link shaft, the mounting portion drives the pushing portion to pivot, whereby to pivot the cover plate relative to the headrail.

In an embodiment, the motion portion includes a led gear, a link gear, and a link shaft, wherein each of the clips is rotatably connected to the link shaft. The operable portion is adapted to be operated to drive the led gear to rotate, and the led gear drives the link gear to rotate while being driven by the operable portion, so as to drive the link shaft to rotate as well, whereby to turn the slats in situ relative to the headrail. The driving module includes a driving portion and a moving portion, wherein the driving portion fits around the link shaft to be synchronously moved along with the link shaft, and the driving portion has external teeth provided therearound. The cover plate is provided on a side of the headrail, and the moving portion is provided on a surface of the cover plate facing the driving portion; the moving portion has a toothed rack meshing with the external teeth of the driving portion. When the driving portion rotates, the moving portion is driven by the driving portion to move up and down relative to the headrail.

In an embodiment, the motion portion includes a led gear, a link gear, and a link shaft, wherein each of the clips is rotatably connected to the link shaft. The operable portion is adapted to be operated to drive the led gear to rotate, and the led gear drives the link gear to rotate while being driven by the operable portion, so as to drive the link shaft to rotate as well, whereby to turn the slats in situ relative to the headrail. The driving module includes a driving portion, a transmission member, and a motion portion, wherein the driving portion fits around the link shaft to be synchronously moved along with the link shaft. The motion portion is provided to drive the cover plate, and the transmission member connects the driving portion and the motion portion in a way that the driving portion and the motion portion move synchronously. When the link shaft drives the driving portion to rotate, the driving portion drives the motion portion to rotate, and drives the cover plate to pivot about the motion portion.

In an embodiment, the motion portion includes a led gear, a link gear, and a link shaft, wherein each of the clips is rotatably connected to the link shaft. The operable portion is adapted to be operated to drive the led gear to rotate, and the led gear drives the link gear to rotate while being driven by the operable portion, so as to drive the link shaft to rotate as well, whereby to turn the slats in situ relative to the headrail. The driving module includes a driving portion, a motion portion, and a transmission member, wherein the driving portion fits around the link shaft to be synchronously moved along with the link shaft. The motion portion is a long rod, and an end of the cover plate is connected to the motion portion. The transmission member connects the driving portion and the motion portion in a way that the driving portion and the motion portion move synchronously. When the link shaft drives the driving portion to rotate, the driving portion drives the motion portion to rotate, and drives the cover plate to roll around the motion portion or to be released from the motion portion.

In an embodiment, the cover plate includes a first plate and a second plate, wherein the first plate has a first connecting portion, and the second plate has a second connecting portion. The headrail has a first guide slot and a second guide slot provided on a front side thereof. The first connecting portion is inserted into the first guide slot, while the second connecting portion is inserted into the second guide slot. The first plate has a first stop portion, while the second plate has a second stop portion, wherein the first stop portion and the second stop portion are adapted to stop each other. The first guide slot is arranged in front of the second guide slot in a transverse direction of the headrail, so that the first plate is adapted to overlap the second plate as in front of the second plate. The control mechanism includes an operable portion connected to the first plate and one of the slats. When the operable portion is controlled to move the slats in the longitudinal direction of the headrail, the first plate is also moved in the longitudinal direction of the headrail, and, after the first stop portion contacts and pushes the second stop portion, the second plate is driven to move as well.

In an embodiment, the cover plate includes a plurality of shielding members, and each of the shielding members is respectively provided on an end edge of one of the slats corresponding to the headrail.

In an embodiment, the cover plate is substantially long, and is connected to the headrail with a long edge thereof.

With the above design, the cover plate could cover the gap between the covering assembly and the headrail of the vertical blind when the covering assembly is closed, whereby to provide a better light blocking effect.

BRIEF DESCRIPTION OF THE SEVERAL VIEWS OF THE DRAWINGS

The present invention will be best understood by referring to the following detailed description of some illustrative embodiments in conjunction with the accompanying drawings, in which

FIG. 11 shows the relationship between the front cover plate, the rear cover plate, and the headrail when the covering assembly is in the closed state;

FIG. 14 shows the relationship between the front cover plate, the rear cover plate, and the headrail when the covering assembly is in the closed state;

DETAILED DESCRIPTION OF THE INVENTION

Figure 1:
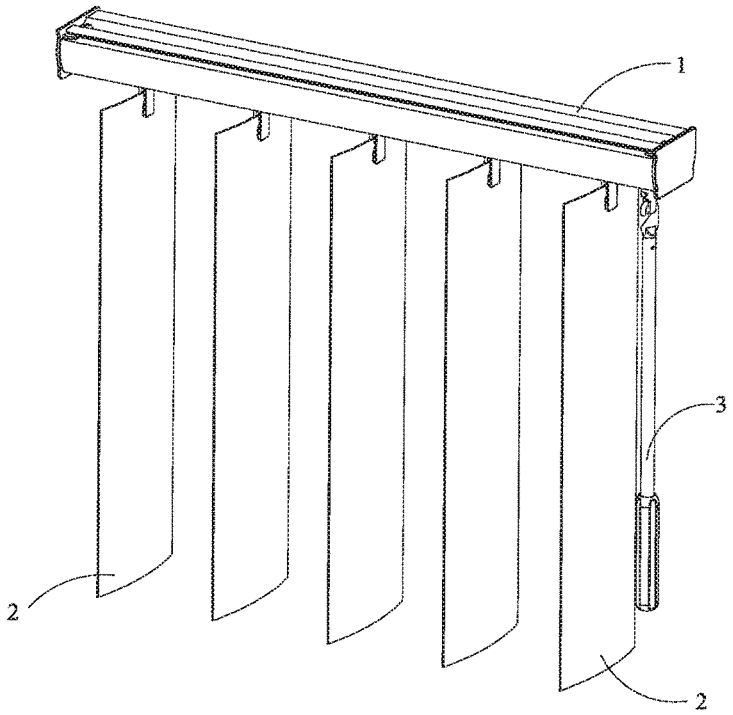
FIG. 1 is a perspective view of a conventional vertical blind, showing the slats are in a state that allows the most light to pass therebetween.
Figure 2:
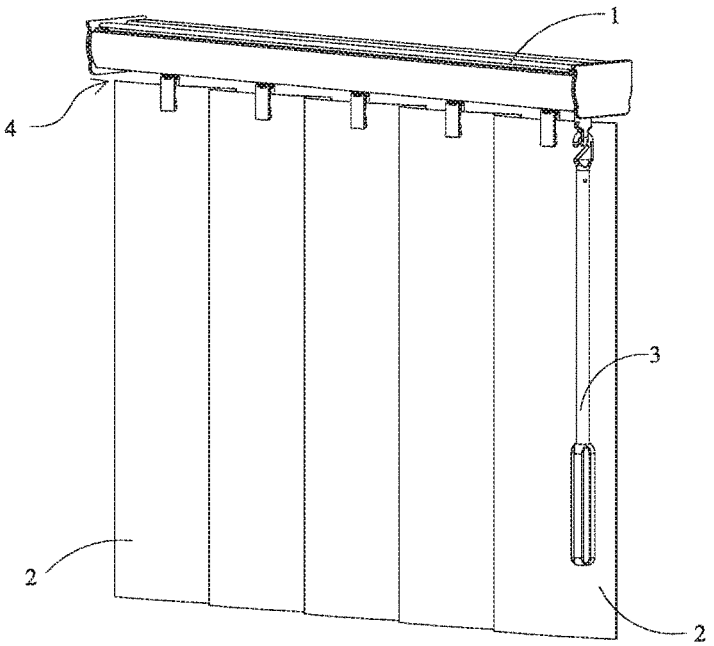
FIG. 2 is a perspective view of the conventional vertical blind shown in FIG. 1, showing the slats are in a state that blocks light out.

A vertical blind 100 which uses a light blocking system of the first embodiment of the present invention is shown in FIG. 3 to FIG. 6, wherein the vertical blind 100 includes a headrail 110, a covering assembly hung below the headrail 110, a control mechanism 130, and a light blocking system 180. The light blocking system 180 includes a front cover plate 182 and a rear cover plate 184, which are respectively provided on opposite sides below the headrail 110 in a longitudinal direction of the headrail 110. Two ends of the headrail 110 in the longitudinal direction thereof are respectively covered by end caps 1102, whereby to prevent the components accommodated therein from being seen from outside. The covering assembly includes a plurality of slats 120, and a gap 140 is left between a bottom of the headrail 110 and a top edge of the slats 120. The front cover plate 182 and the rear cover plate 184 respectively cover a front side and a rear side of the gap 140. The control mechanism 130 is provided in the headrail 110, and each of the slats 120 is connected to the control mechanism 130 with an end thereof. The control mechanism 130 is controllable to drive the slats 120 to turn.

Figure 3:
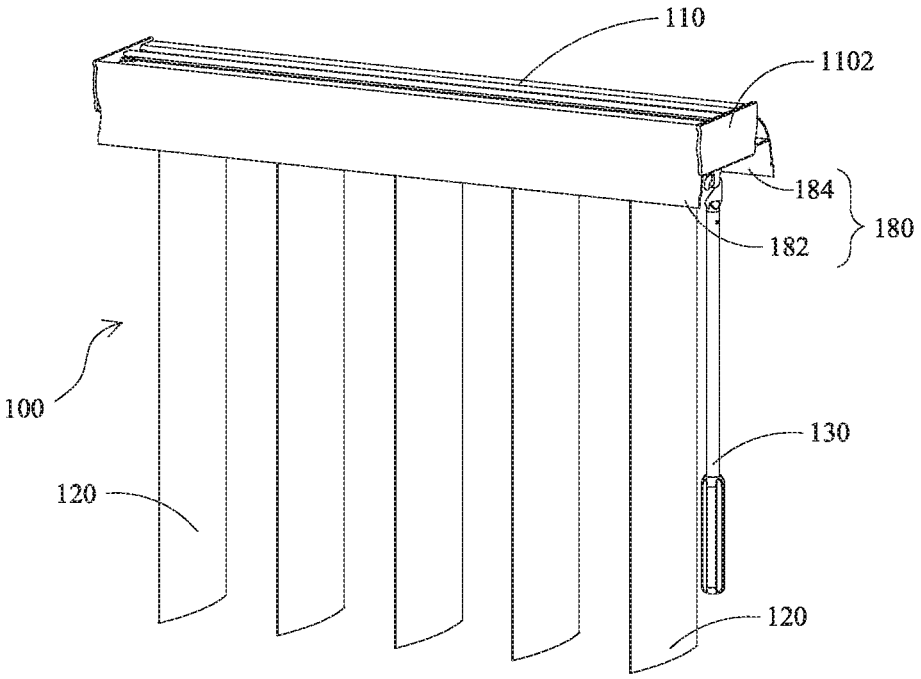
FIG. 3 is a perspective view of a vertical blind applied with the light blocking system of a first embodiment of the present invention, showing the covering assembly is in the fully open state.
Figure 4:
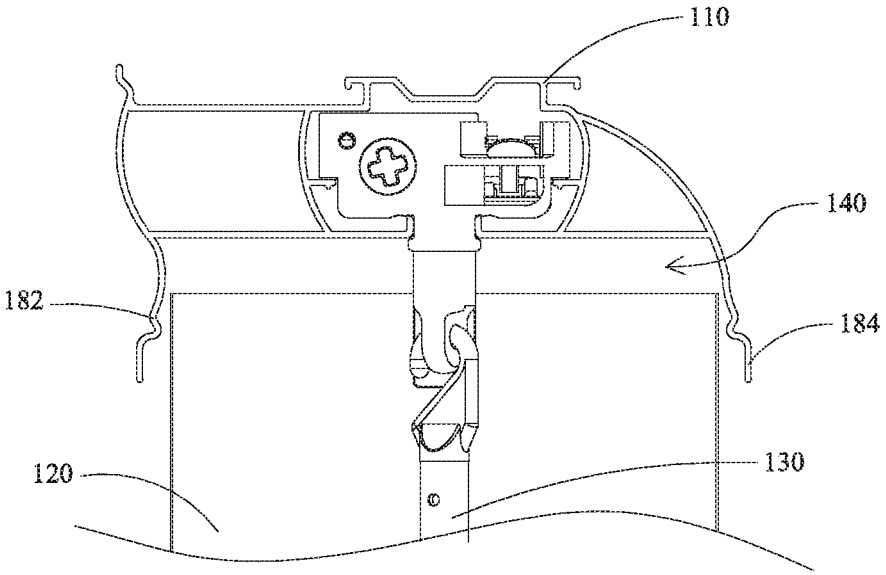
FIG. 4 is a partial side view of the vertical blind shown in FIG. 3, showing the relationship between the front cover plate, the rear cover plate, and the headrail when the covering assembly is in the fully open state.
Figure 5:
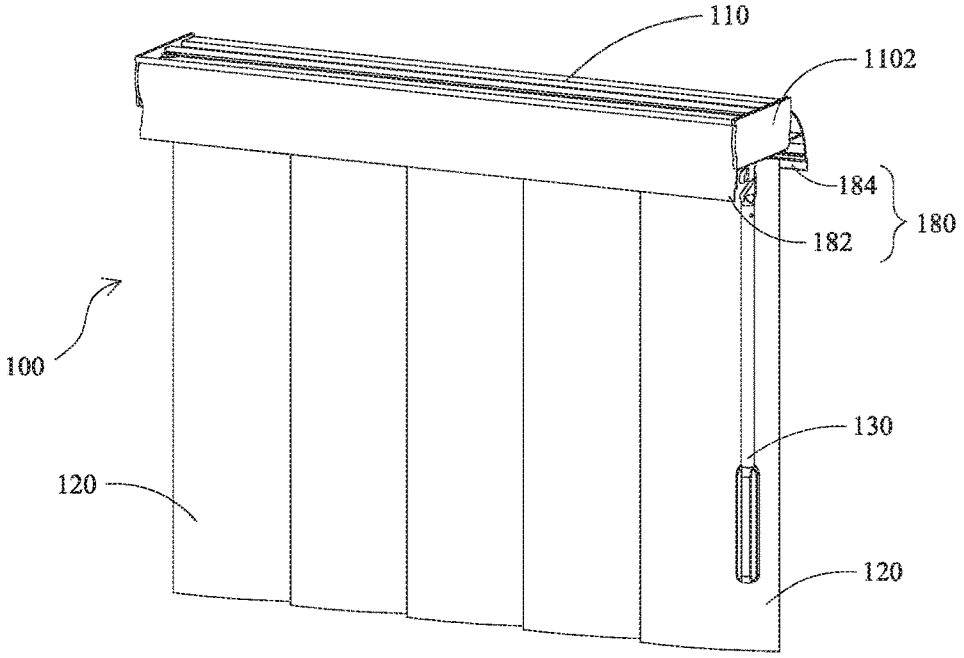
FIG. 5 is similar to FIG. 3, which is also a perspective view of the vertical blind applied with the light blocking system of the first embodiment of the present invention, but the covering assembly is in the closed state.
Figure 6:
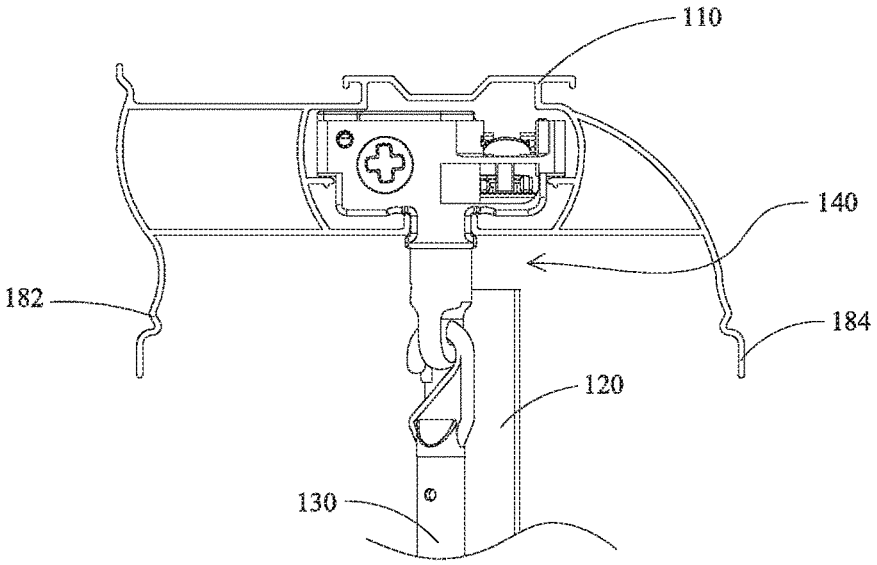
FIG. 6 is similar to FIG. 4, which is a partial side view of the vertical blind, showing the relationship between the front cover plate, the rear cover plate, and the headrail when the covering assembly is in the closed state.
Figure 7:
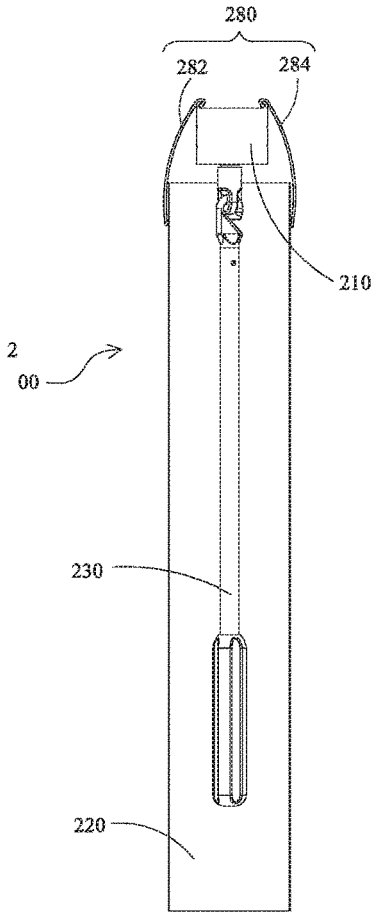
FIG. 7 is a side view of a vertical blind applied with the light blocking system of a second embodiment of the present invention, showing the covering assembly is in the fully open state.
Figure 8:
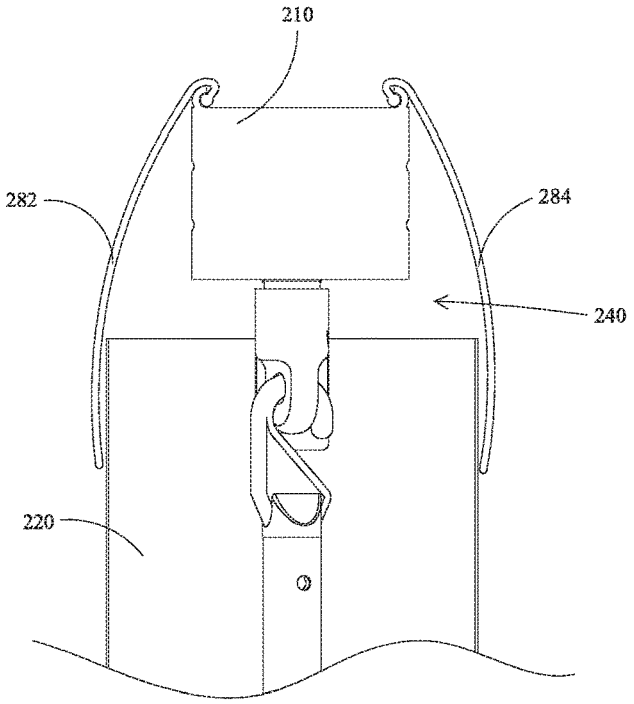
FIG. 8 is a partial side view of the vertical blind shown in FIG. 7, showing the relationship between the front cover plate, the rear cover plate, and the headrail when the covering assembly is in the fully open state.
Figure 9:
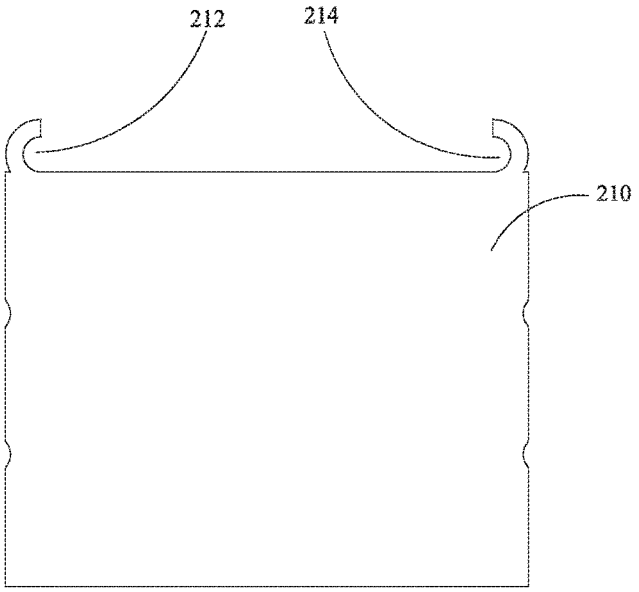
FIG. 9 is a side view of the headrail which matches the light blocking system of the second embodiment of the present invention.
Figure 10:
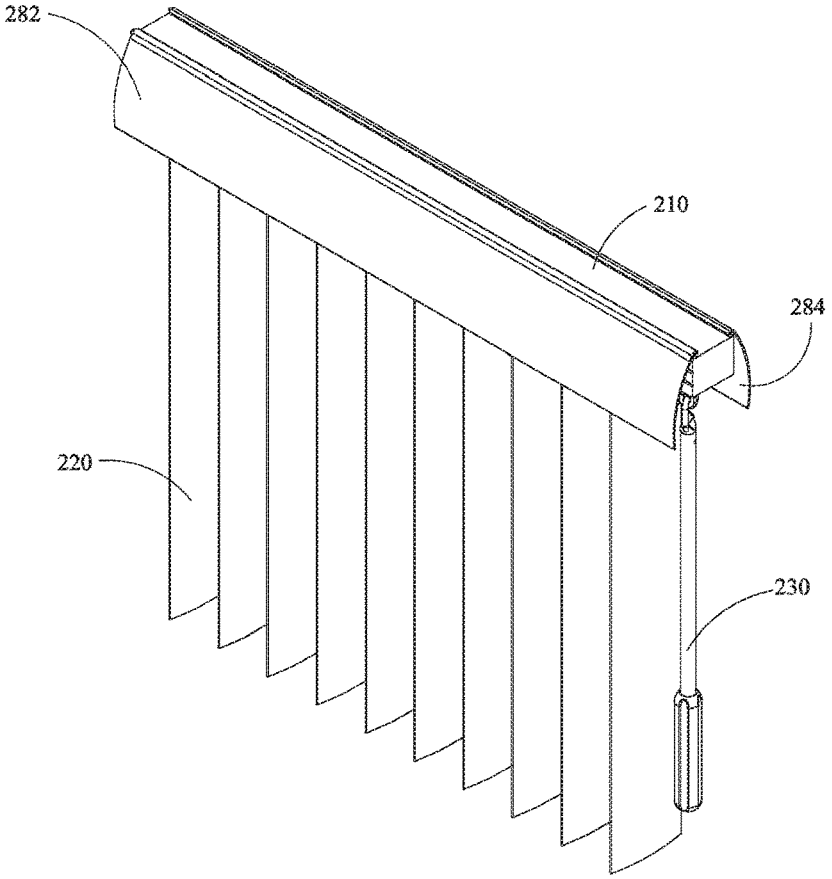
FIG. 10 is a partial perspective view of the vertical blind shown in FIG. 7.

FIG. 3 to FIG. 4 are views showing the condition when the slats 120 of the vertical blind 100 are turned to an angle which is approximately perpendicular to the longitudinal direction of the headrail 110. In this condition, a maximum amount of light is allowed to pass through the space between the slats 120, and herein we define the covering assembly is in a fully open state (this definition also stands in each of the subsequent embodiments). On the other hand, FIG. 5 to FIG. 6 are views showing the condition when the slats 120 are turned to an angle substantially parallel to the longitudinal direction of the headrail 110. In this condition, a long edge of each of the slats 120 approaches, or even overlaps, the adjacent one of the slats 120, so that the slats 120 become a screen, and therefore light would not be able to pass the region covered by the slats 120. Herein we define the covering assembly is in a closed state at this time (this definition stands in each of the subsequent embodiments as well). In addition, the slats 120 could be also turned over 180 degrees to another angle which is also substantially parallel to the longitudinal direction of the headrail 110 (not shown), and herein we define the covering assembly is in another closed state at this time (this definition, again, stands in the subsequent embodiments). More specifically, a surface of each of the slats 120 faces completely opposite directions when the covering assembly is in the closed state and in the another closed state. Furthermore, light would be not allowed to pass the region covered by the slats 120 as well when the covering assembly is in the another closed state. The control mechanism 130 is controllable to turn the slats 120. Since the techniques regarding the control mechanism 130 are well-known, and are not claimed features of the present invention, we are not going to describe them in details. However, for the ease of understanding the disclosures of the present invention, we still provide a rough description in the following paragraph.

In general, the control mechanism 130 includes an operable portion, a motion portion, and a plurality of clips. The operable portion is exposed out of the headrail 110 to be operated, and is the only component of the control mechanism 130 visible in the drawings corresponding to the current embodiment. Other components of the control mechanism 130 are not explicitly illustrated in the drawings. In each of the drawings of the subsequent embodiments, these components will not be particularly shown either, unless the control mechanism has specific interactions or worth-mentioning structural relationship with the light blocking system. Take the vertical blind 100 which uses the light blocking system of the first embodiment of the present invention as an example. The clips are used to suspend the slats 120 of the covering assembly. In more details, each of the slats 120 is suspended from one of clips with an end thereof, and therefore the slats 120 are hung below the headrail 110. Furthermore, the clips are connected to a link shaft of the motion portion in a rotatable manner. In this way, the link shaft can be used to control the clips, whereby to synchronously turn the slats 120 by the same angle. The motion portion further includes a led gear and a link gear. The operable portion can be operated to rotate a led gear, which is engaged with a link gear, and the link gear is engaged with the link shaft. With such design, when the led gear is driven to rotate, the link gear is also driven to rotate, and therefore the link shaft is driven to rotate as well. As a result, the slats 120 can be turned in situ relative to the headrail 110.

In the current embodiment, the gap 140 between the bottom of the headrail 110 and the top edge of the slats 120 is always covered by the front cover plate 182 and the rear cover plate 184. Therefore, when the covering assembly is in the closed state, the light would be able to pass neither the region covered by the slats 120 nor the gap 140, which could effectively prevent light leakage. Furthermore, in the current embodiment, the front cover plate 182 and the rear cover plate 184 both slightly incline toward a rear side (i.e., in a direction toward the window), whereby the light coming from the rear side of the vertical blind 100 can be blocked out more thoroughly.

A vertical blind 200 using the light blocking system of the second embodiment of the present invention is shown in FIG. 7 to FIG. 11, wherein the vertical blind 200 includes a headrail 210, a covering assembly hung below the headrail 210, a control mechanism 230, and a light blocking system 280. The covering assembly includes a plurality of slats 220. In the current embodiment, the light blocking system 280 includes a front cover plate 282 and a rear cover plate 284, and the headrail 210 is provided with a front groove 212 and a rear groove 214. The front cover plate 282 and the rear cover plate 284 are long plates, wherein a lateral edge of the front cover plate 282 in a longitudinal direction thereof is pivotally provided in the front groove 212, while a lateral edge of the rear cover plate 284 is pivotally provided in the rear groove 214; another lateral edge of each of the front and the rear cover plates is a free end, which can be lifted relative to the headrail 210. A gap 240 is left between a bottom of the headrail 210 and a top edge of the slats 220, and the front cover plate 282 and the rear cover plate 284 respectively cover a front side and a rear side of the gap 240. In the current embodiment, the front groove 212 and the rear groove 214 are provided on a top of the headrail 210, but this is not a limitation of the present invention. The front cover plate 282 and the rear cover plate 284 could be also provided on the front and rear sides or on the bottom of the headrail 210 to meet different requirements, as long as the front cover plate 282 and the rear cover plate 284 could cover the front and the rear sides of the gap 240.

Figure 11:
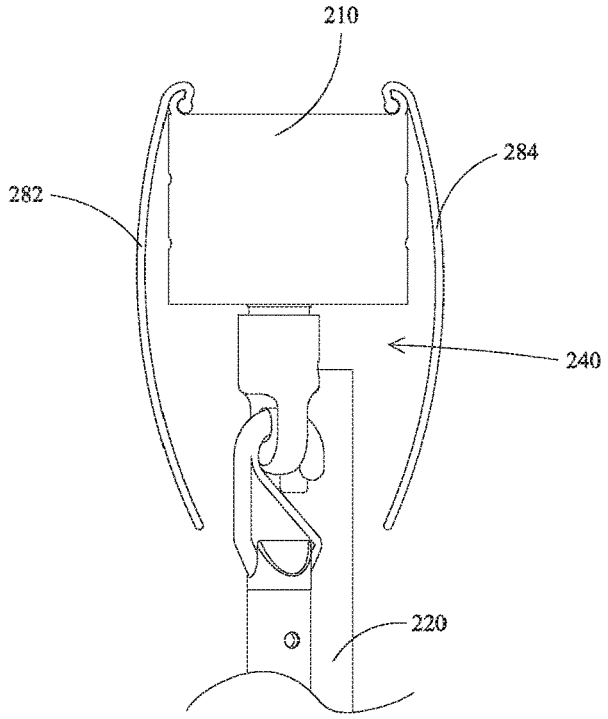
FIG. 11 is a partial side view of the vertical blind shown in FIG. 7, wherein the covering assembly is in the closed state.

FIG. 7 to FIG. 10 are different views showing the condition when the covering assembly of the vertical blind 200 is in the fully open state, wherein an angle of the slats 220 is substantially perpendicular to the longitudinal direction of the headrail 210, and two end corners of the top edge of each of the slats 220 respectively pushes the front cover plate 282 and the rear cover plate 284, so that the front cover plate 282 and the rear cover plate 284 are lifted upward and outward. When the control mechanism 230 is operated to change the covering assembly into the closed state, as shown in FIG. 11, the angle of the slats 220 is substantially parallel to the longitudinal direction of the headrail 210, and the front cover plate 282 and the rear cover plate 284 droop naturally for not being pushed by the end corners of the top edges of the slats 220. As a result, not only the slats 220 completely block out the light, the front cover plate 282 and the rear cover plate 284 would also cover the gap 240 between the slats 220 and the headrail 210 to prevent the light from passing therethrough. Therefore, the vertical blind 200 could have an excellent light blocking performance when its covering assembly is in the closed state.

As mentioned above, the slats 220 could be turned by 180 degrees. After the slats 220 are turned from an angle parallel to the longitudinal direction of the headrail 210 (i.e., the covering assembly is in the closed state) to another angle perpendicular to the longitudinal direction of the headrail 210 (i.e., the covering assembly is the fully open state), the slats 220 could continue to be rotated, and finally reach an angle parallel to the longitudinal direction of headrail 210. At this time, the covering assembly is moved into the another closed state. A surface of each of the slats 200 faces complete opposite directions when the covering assembly is in the another closed state and in the original closed state. Furthermore, during the process that the covering assembly has gone beyond the fully open state and continues to be changed toward the another closed state, the front cover plate 282 and the rear cover plate 284 would change from the lifted condition to the naturally drooping condition along with the rotation of the slats 220. Whereby, when the covering assembly is in the another closed state, the front cover plate 282 and the rear cover plate 284 would also cover the gap 240 between the slats 220 and the headrail 210.

Figure 12:
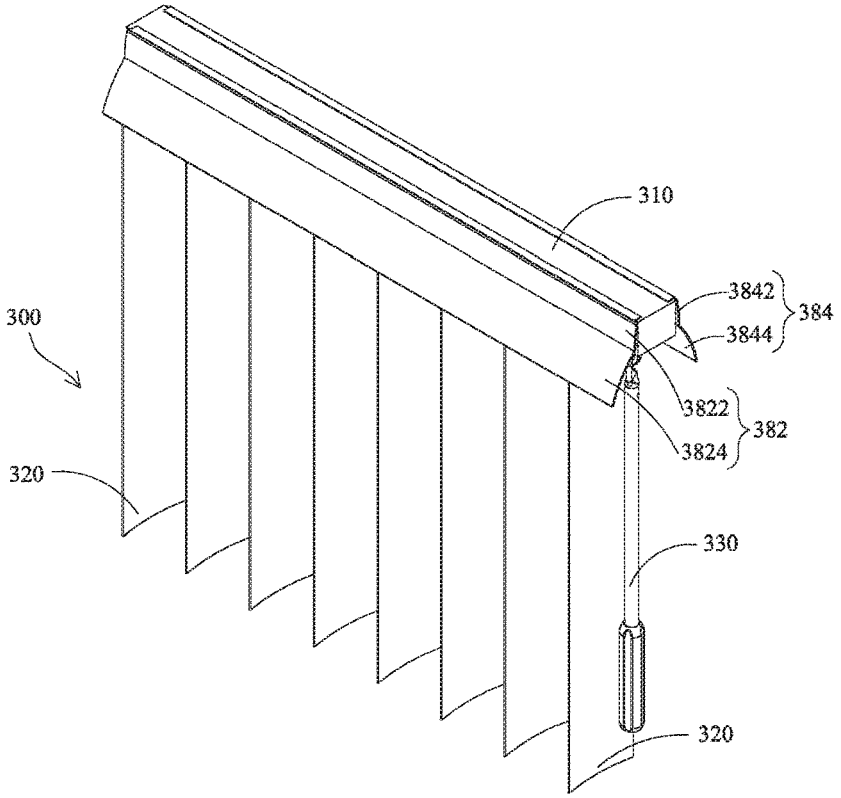
FIG. 12 is a perspective view of a vertical blind applied with a third embodiment of the present invention, wherein the covering assembly is in the fully open state.
Figure 13:
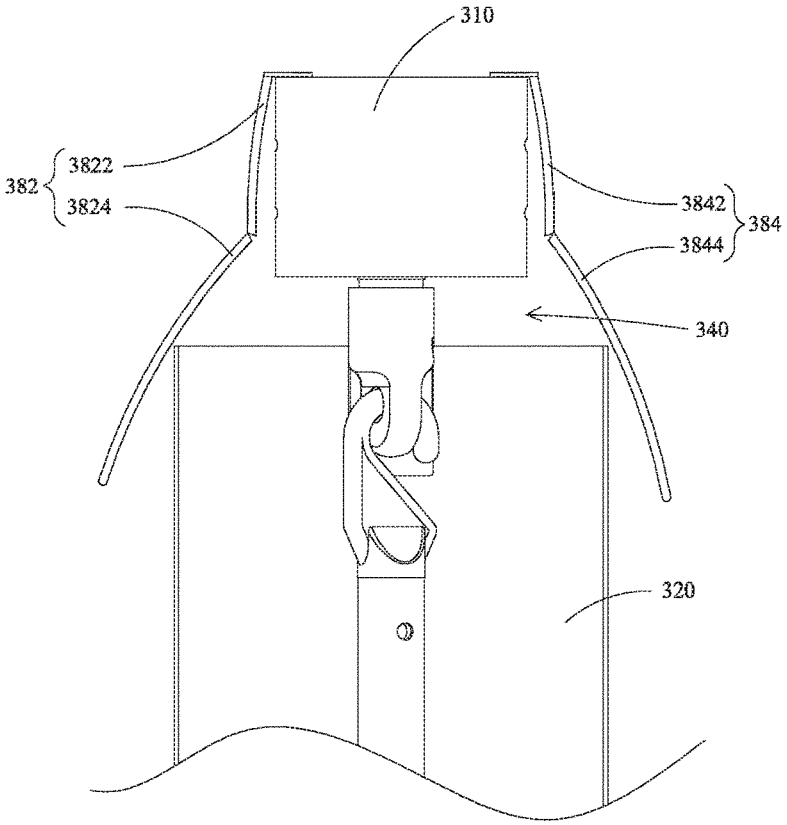
FIG. 13 is a partial side view of the vertical blind shown in FIG. 12, showing the relationship between the front cover plate, the rear cover plate, and the headrail when the covering assembly is in the fully open state.
Figure 14:
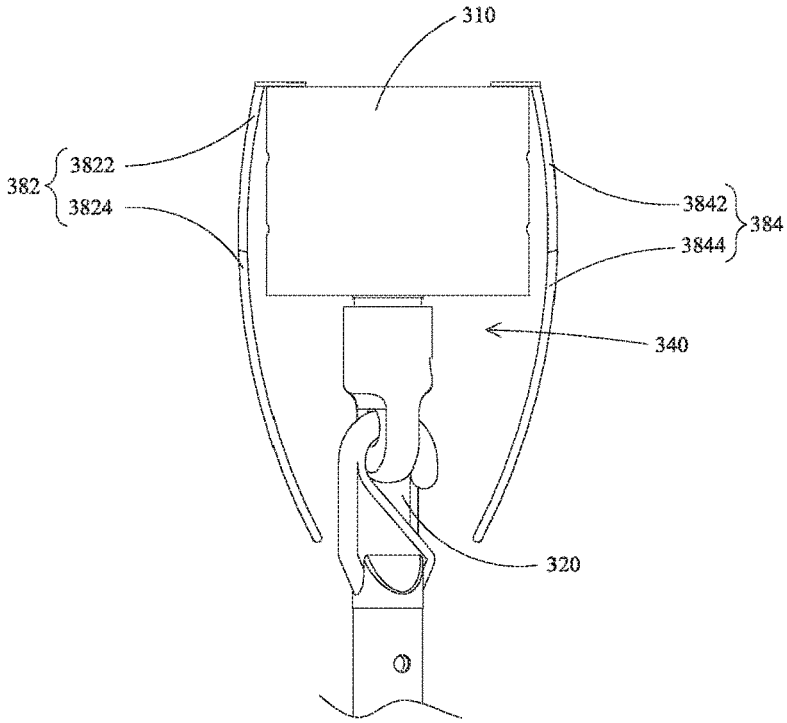
FIG. 14 is a partial side view of the vertical blind shown in FIG. 12, wherein the covering assembly is in the closed state.
Figure 15:
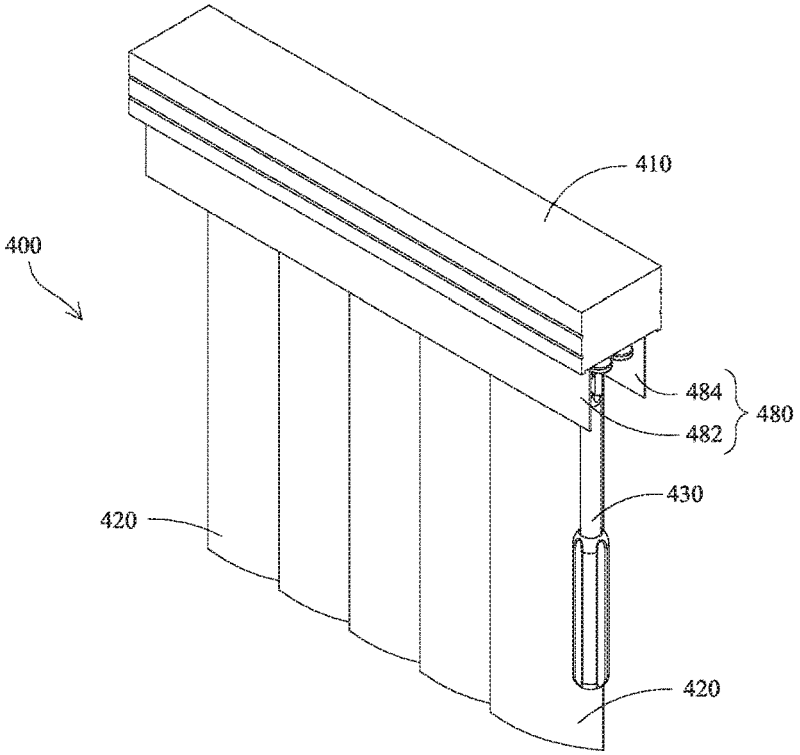
FIG. 15 is a perspective view of a vertical blind applied with the light blocking system of a fourth embodiment of the present invention, wherein the covering assembly is in the closed state.

A vertical blind 300 using a light blocking system of the third embodiment of the present invention is shown in FIG. 12 to FIG. 14, wherein the vertical blind 300 includes a headrail 310, a covering assembly hung below the headrail 310, a control mechanism 330, and a light blocking system 380. The covering assembly includes a plurality of slats 320, and the light blocking system 380 in the current embodiment includes a front cover plate 382 and a rear cover plate 384, which are both long plates. Each of the front cover plate 382 and the rear cover plate 384 is fixedly connected to the headrail 310 with a lateral edge in a longitudinal direction thereof, and another lateral edge is a free end, which could be lifted relative to the headrail 310. The ways to connect the front and the rear cover plates 382, 384 and the headrail 310 are not limitations of the present invention. In the current embodiment, these components are fixed with glues, but nails, magnets, hook-and-loop fasteners, and other removable or irremovable means would be also acceptable. The positions to fix the front and the rear cover plates 382, 384 are not limitations of the present invention, either. In the current embodiment, the front cover plate 382 and the rear cover plate 384 are connected to a top of the headrail 310, but could be also connected to a front and rear sides or inner sides of the headrail 310.

A gap 340 is left between a bottom of the headrail 310 and a top edge of the slats 320, and the front cover plate 382 and the rear cover plate 384 respectively cover the front and rear sides of the gap 340. Similar to the previous embodiment, the front cover plate 382 and the rear cover plate 384 would cover the gap 340 when the covering assembly of the vertical blind 300 is in the closed state, which could prevent the problem of light leakage. On the other hand, when the covering assembly of the vertical blind 300 is changed into the fully open state by driving the control mechanism 330, the front cover plate 382 and the rear cover plate 384 would be pushed by the end corners of the top of each of the slats 320, and therefore respectively get lifted forward and rearward.

It is worth mentioning that, in the current embodiment, each of the front cover plate 382 and the rear cover plate 384 respectively includes a drooping portion 3822, 3842 and a covering portion 3824, 3844, wherein a segment thereof corresponding to the headrail 310 is the drooping portion 3822, 3842, and another segment thereof corresponding to the gap 340 is the covering portion 3824, 3844. Herein we take the front cover plate 382 for example. In order to make an upper half of the front cover plate 382 close to the headrail 310, the drooping portion 3822 could be made of soft fabrics or plastics, but hard cardboards, metals, or plastics would be also applicable. As for the covering portion 3824, it should be suitable to be pushed by the corresponding end corner of the top of each of the slats 320, and therefore would be made of hard and opaque materials such as hard cardboards, hard plastics, or metals. With such design, the materials and the patterns of the drooping portion 3822 and the covering portion 3824 could match each other. When in the condition of allowing light to pass through, the angel of the drooping portion 3822 would barely change while the covering portion 3824 is pushed by the slats 320 to move upward and outward, which could keep an appearance of the headrail 310 unchanged.

Similar to the light blocking system 200 mentioned in the second embodiment, in the current embodiment, while the covering assembly is changing toward the another closed state after going through the fully open state, the front cover plate 382 and the rear cover plate 384 (or more specifically, the covering portions 3824, 3844) of the light blocking system 380 would also gradually return to the naturally drooping condition from the lifted condition. In this way, the light blocking system 380 could also cover the gap 340 when the covering assembly is in the another closed state.

In addition, the connection between the drooping portions 3822, 3842 and the covering portions 3824, 3844 could be done at least in the following methods: (1) a length of each of the drooping portions 3822, 3842 equals a total length of the front cover plate 382 or the rear cover plate 384, and the segments corresponding to the gap 340 are covered by a hard material to form the covering portions 3824, 3844; (2) the drooping portions 3822, 3842 and the covering portions

3824, 3844 are independent components, and are connected by gluing, stitching, hinging, or in other ways to achieve a pivotable connection therebetween; (3) the drooping portions 3822, 3842 and the covering portions 3824, 3844 are directly made through extrusion molding with a soft material and a hard material.

It needs to be clarified that, the front cover plate s182, 282, 382 and the rear cover plates 184, 284, 384 mentioned in the aforementioned three embodiments are not necessary to be presented both; one of the front and the rear cover plates could be also omitted, and the length of each of the cover plates are not a limitation of the present invention, as long as the light coming from the rear side of the vertical blind 100, 200, 300 could be blocked out.

A vertical blind 400 using a light blocking system of the fourth embodiment of the present invention is shown in FIG. 15 to FIG. 21, wherein the vertical blind 400 includes a headrail 410, a covering assembly hung below the headrail 410, a control mechanism 430, and a light blocking system 480. The covering assembly includes a plurality of slats 420, and a gap 450 is left between a bottom of the headrail 410 and a top edge of the slats 420. The light blocking system 480 includes a driving module, a front cover plate 482, and a rear cover plate 484, wherein the driving module in the current embodiment is a pushing member 486. The pushing member 486 has a mounting portion provided at a center thereof, and the mounting portion in the current embodiment is an engaging portion 4862 which has a through hole, whereby the pushing member 486 could fit around the control mechanism 430 at a location near the headrail 410. As a result, the mounting portion (i.e., the engaging portion 4862) would move synchronously with a link shaft 438 of the control mechanism 430. The link shaft 438 mentioned herein is a component of the control mechanism 430 used to synchronously turn the slats 420. The front cover plate 482 and the rear cover plate 484 are provided below the headrail 410 in a longitudinal direction of the headrail 410 in a pivotable manner, and cover the pushing member 486.

Figure 16:
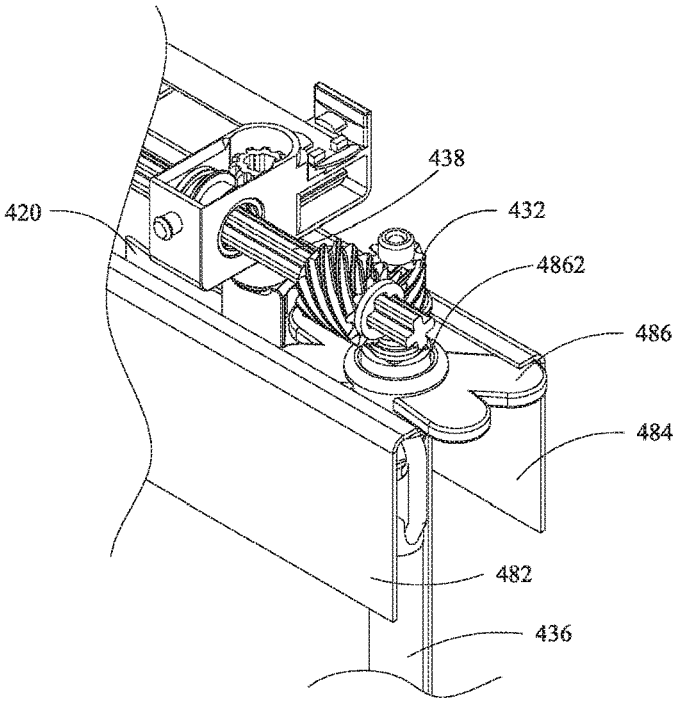
FIG. 16 is a schematic view showing the arrangement of the light blocking system of the fourth embodiment in the headrail.
Figure 17:
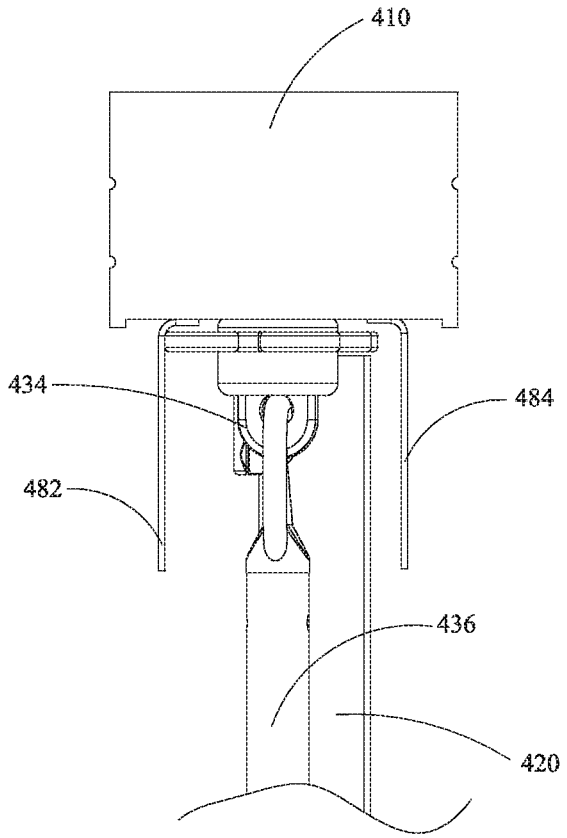
FIG. 17 is a partial side view of the vertical blind shown in FIG. 15.
Figure 18:
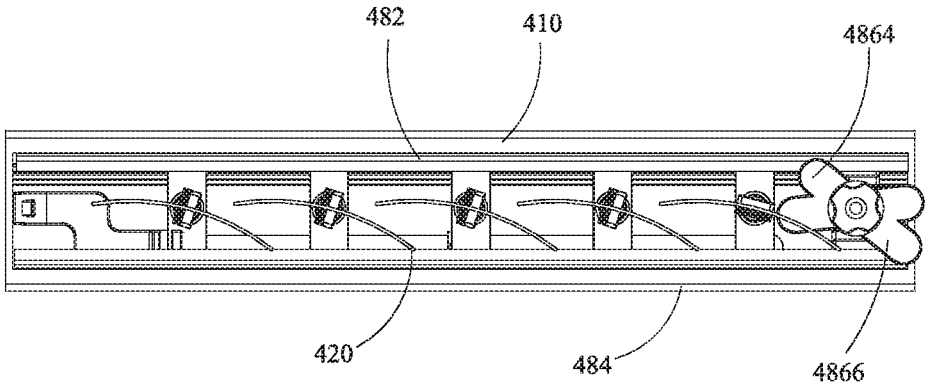
FIG. 18 is a bottom view of the vertical blind shown in FIG. 15.
Figure 19:
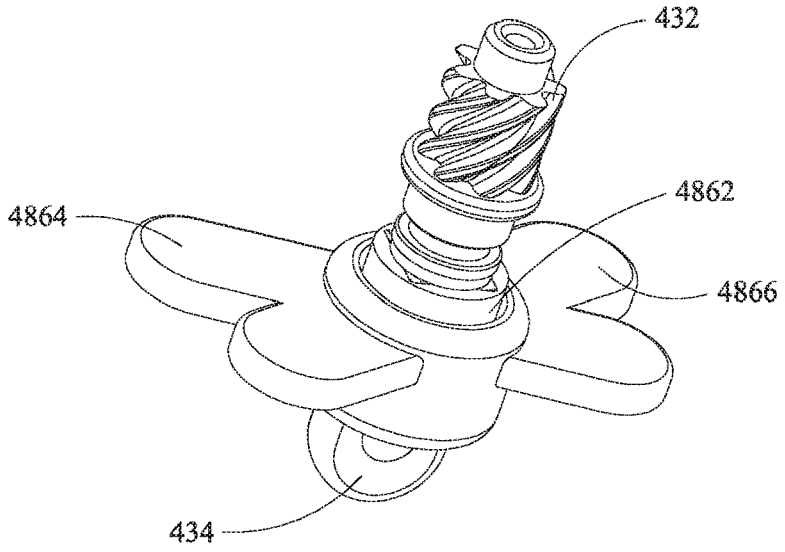
FIG. 19 is a perspective view of the pushing member of the light blocking system of the fourth embodiment of the present invention.

FIG. 15 to FIG. 19 are different views showing the condition when the covering assembly of the vertical blind 400 is in the closed state, wherein the front cover plate 482 and the rear cover plate 484 naturally droop to cover the gap 450 at the same time, preventing light from passing therethrough. The arrangements of the pushing member 486 and the control mechanism 430 are shown in FIG. 16 and FIG. 19, and FIG. 16 omits the headrail 410 to clearly show the components inside, wherein the control mechanism 430 has a led gear 432 provided at a top end thereof, and has a hook portion 434 provided at a bottom end thereof to suspend an operation rod 436. However, the structural arrangements of the control mechanism 430 and the techniques relevant to the operation of turning the slats 420 are well-known and are not claimed features of the present invention, so we are not going to describe them in details herein. The pushing member 486 has two pushing portions 4864, 4866 extending from the engaging portion 4862 located at the center thereof, each of which respectively corresponds to the front cover plate 482 and the rear cover plate 484. The led gear 432 of the control mechanism 430 goes into the headrail 410 to cooperate with a turning mechanism of the slats 420. In more details, the pushing member 486 fits around an outside of an end of the hook portion 434 corresponding to the led gear 432 to be synchronously rotated along with the led gear 432. An extending length between each of the pushing portions 4864, 4866 and the engaging portion 4862 in a radial direction of the engaging portion 4862 is greater than a distance between the engaging portion 4862 and each of the front cover plate 482 and the rear cover plate 484.

Figure 20:
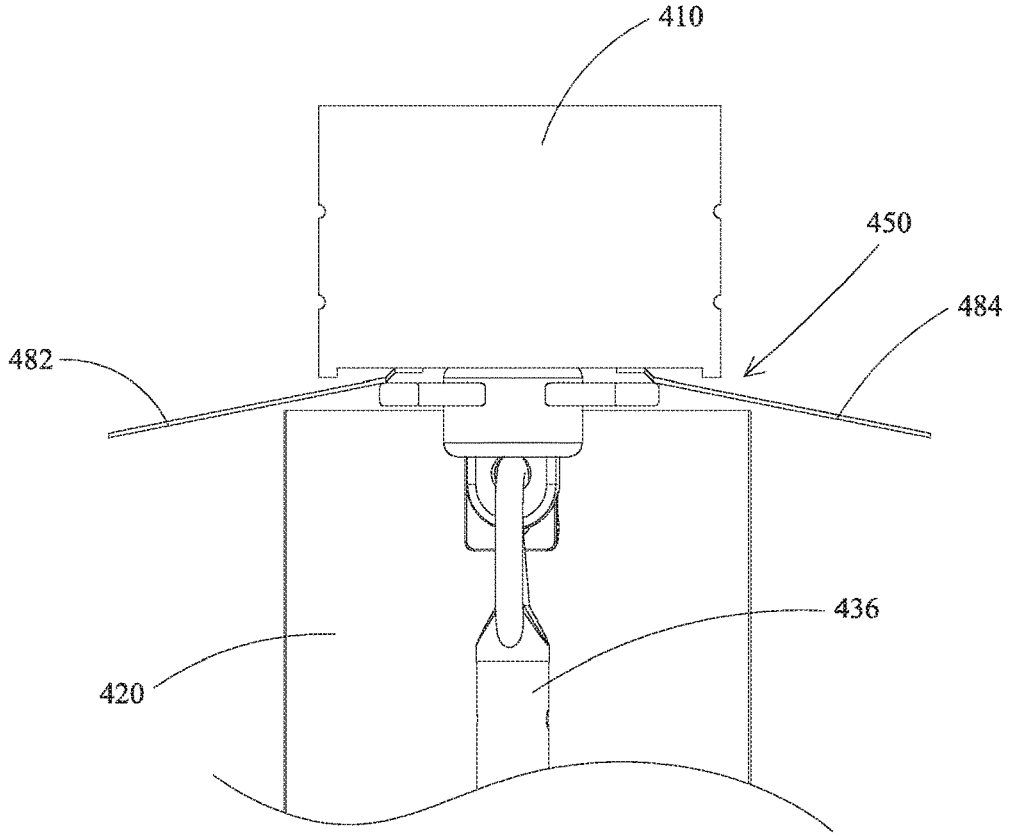
FIG. 20 is a partial side view of the vertical blind shown in FIG. 15, wherein the covering assembly is in the fully open state.
Figure 21:
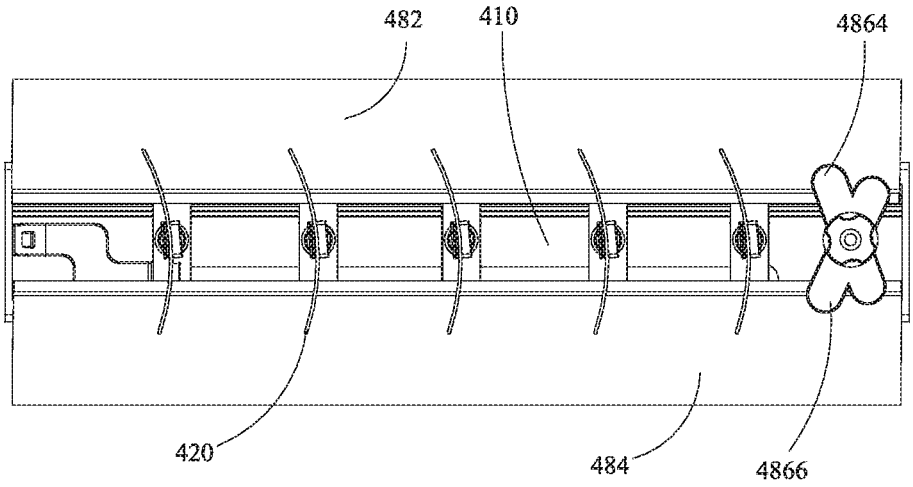
FIG. 21 is a bottom view of the vertical blind shown in FIG. 20.

FIG. 20 and FIG. 21 are different views showing the condition when the covering assembly of the vertical blind 400 is in the fully open state. By rotating the operation rod 436 of the control mechanism 430 to drive the led gear 432, the slats 420 would be driven to rotate. At the same time, the pushing member 486 would also rotate synchronously along with the led gear 432 in the same direction. When an angle of the slats 420 is substantially perpendicular to the longitudinal direction of the headrail 410 (i.e., when the covering assembly is in the fully open state), the pushing portions 4864, 4866 of the pushing member 486 would respectively push and lift the front cover plate 482 and the rear cover plate 484 upward and outward.

It is worth mentioning that, while the covering assembly is changing toward the another closed state after going through the fully open state, the pushing portions 4864, 4866 of the pushing member 486 would gradually leave the front cover plate 482 and the rear cover plate 484, so that the front cover plate 482 and the rear cover plate 484 would naturally droop as not being pushed anymore. In this way, the gap 450 could be also covered when the covering assembly is in the another closed state.

In the current embodiment, the pushing member 486 fits around the control mechanism 430 to be synchronously rotated along with the operation of the control mechanism 430. However, this is not a limitation of the present invention. The pushing member 486 could also fit around the turning mechanism of the slats 420, which could also provide the same function which synchronously operates the control mechanism 430 and the slats 420, so that the front cover plate 482 and the rear cover plate 484 could be still pushed and lifted upward and outward when the covering assembly is in the fully open state.

Furthermore, the pushing member 486 could be used with a restriction mechanism. For example, the headrail 410 could have a bump provided on a bottom thereof, wherein the bump is located at a position corresponding to the covering assembly which is in the fully open state, so that the pushing member 486 would abut against the restriction mechanism and stop rotating when the slats 420 are rotated to be substantially perpendicular to the longitudinal direction of the headrail 410. At the same time, the led gear 432 and the pushing member 486 would have sliding movements therebetween, so that the led gear 432 could rotate relative to the pushing member 486, and therefore the control mechanism 430 could be still used to adjust the angle of the slats 420. At this time, the front cover plate 482 and the rear cover plate 484 would remain in the condition as being pushed upward by the pushing member 486.

A vertical blind 500 using a light blocking system of the fifth embodiment of the present invention is shown in FIG. 22 to FIG. 29, wherein the vertical blind 500 includes a headrail 510, a covering assembly hung below the headrail 510, a control mechanism 530, and a light blocking system 580. The covering assembly includes a plurality of slats 520, and a gap 550 is left between a bottom of the headrail 510 and a top edge of the slats 520. The light blocking system 580 includes a front cover plate 582 and a rear cover plate 584, which are pivotably provided below the headrail 510 in a longitudinal direction of the headrail 510. The light blocking system 580 further includes a driving module, which is a pushing mechanism 586 in the current embodiment. The pushing mechanism 586 includes a mounting portion and a pushing portion 5864, wherein the mounting portion is a rotary portion 5862 in the current embodiment.

The mounting portion (i.e., the rotary portion 5862) is provided in the headrail 510, and is adapted to be controlled by the control mechanism 530 to synchronously rotate along with the turning of the slats 520. More specifically, a rotation angle of the rotary portion 5862 equals a rotation angle of the slats 520. The pushing portion 5864 is a long rod, which is connected to an end of the rotary portion 5862 closer to the slats 520 with a center thereof. The pushing portion 5864 is located higher than a bottom edge of the front cover plate 582 and a bottom edge of the rear cover plate 584, and a length in a longitudinal direction thereof is greater than a distance between the front cover plate 582 and the rear cover plate 584.

Figure 22:
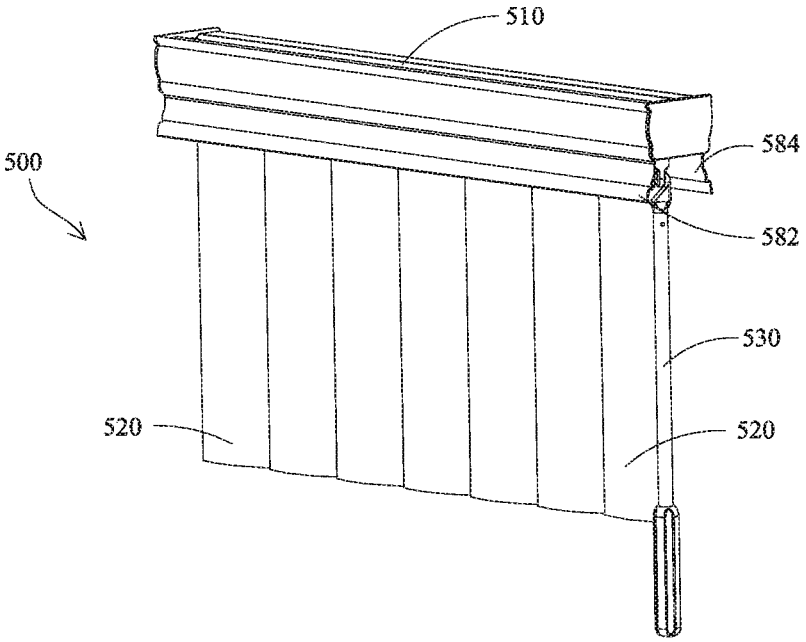
FIG. 22 is a perspective view of a vertical blind applied with the light blocking system of a fifth embodiment of the present invention, wherein the covering assembly is in the closed state.
Figure 23:
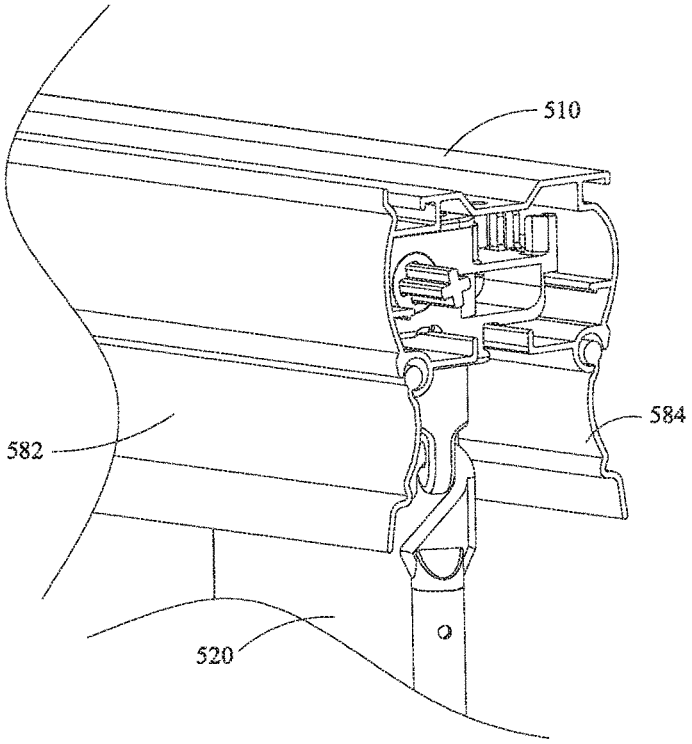
FIG. 23 is a partial schematic view of the vertical blind shown in FIG. 22, showing the structures of the components in the headrail.
Figure 24:
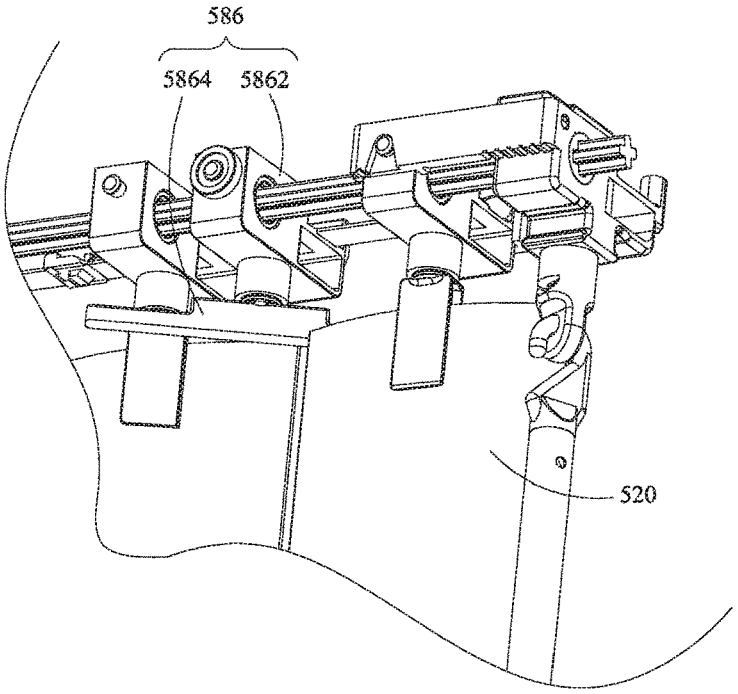
FIG. 24 is a partial schematic view of the vertical blind shown in FIG. 22, showing the structural relationship between the pushing member, the headrail, and the slats.
Figure 25:
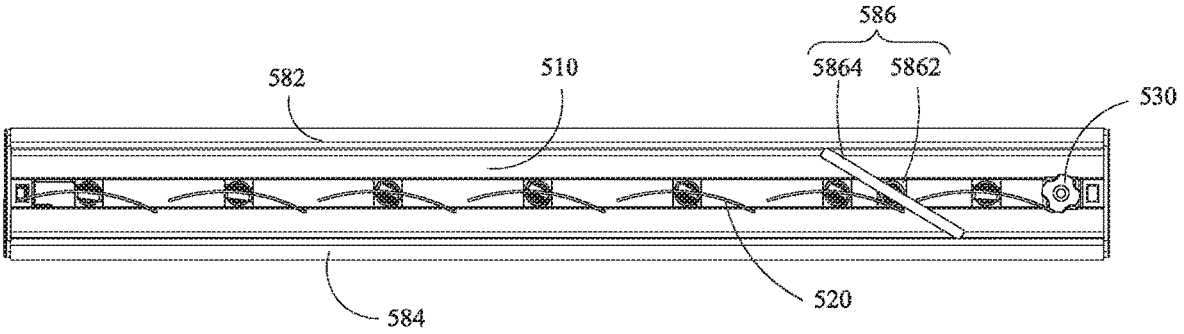
FIG. 25 is a bottom view of the vertical blind shown in FIG. 22.
Figure 26:
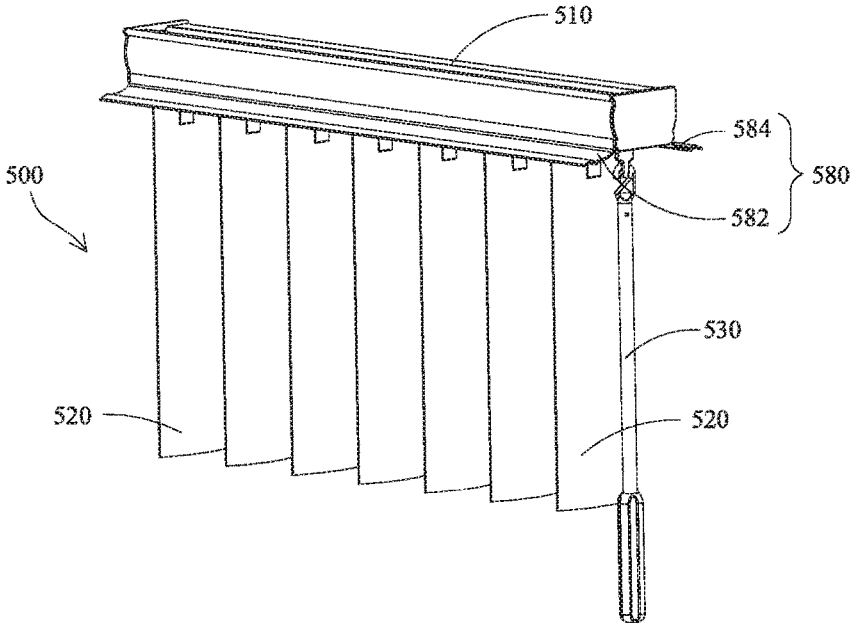
FIG. 26 is a perspective view of the vertical blind shown in FIG. 22, wherein the covering assembly is in the fully open state.
Figure 27:
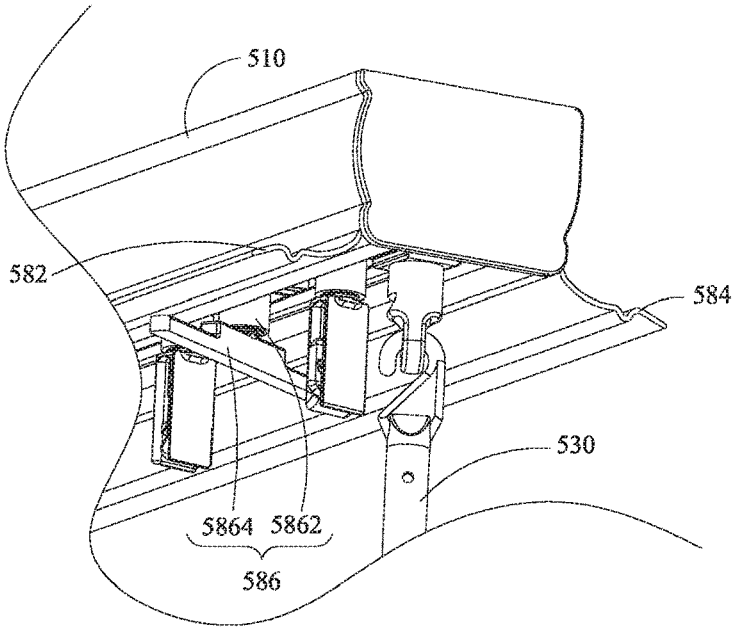
FIG. 27 is a partial schematic view of the vertical blind shown in FIG. 26, showing the condition of the pushing member when the covering assembly is in the fully open state.
Figure 28:
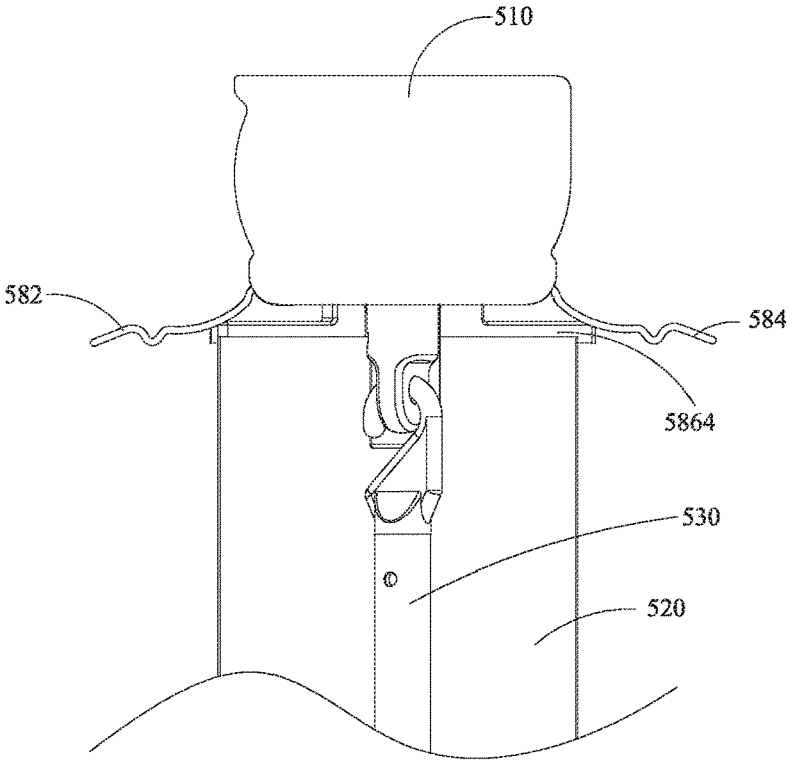
FIG. 28 is a partial side view of the vertical blind shown in FIG. 26.
Figure 29:
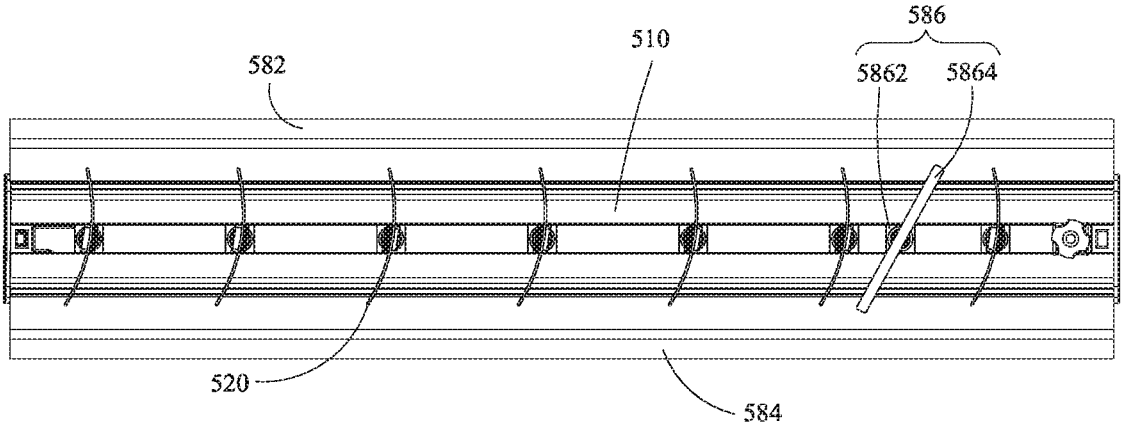
FIG. 29 is a bottom view of the vertical blind shown in FIG. 26.
Figure 30:
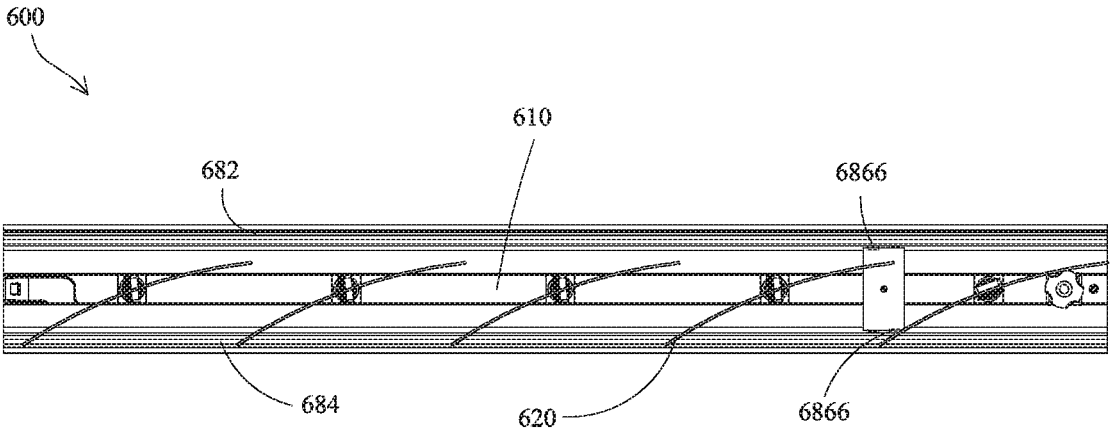
FIG. 30 is a bottom view of a vertical blind applied with the light blocking system of a sixth embodiment of the present invention, wherein the covering assembly is in the closed state.
Figure 31:
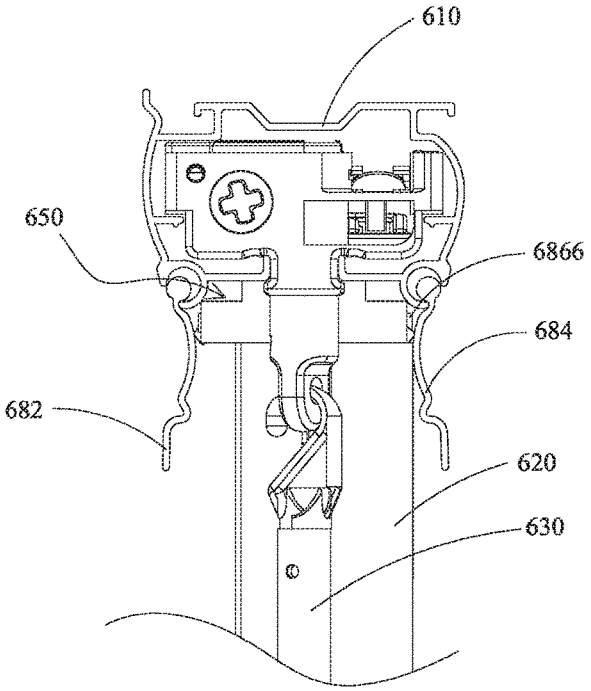
FIG. 31 is a partial side view of the vertical blind shown in FIG. 30.
Figure 32:
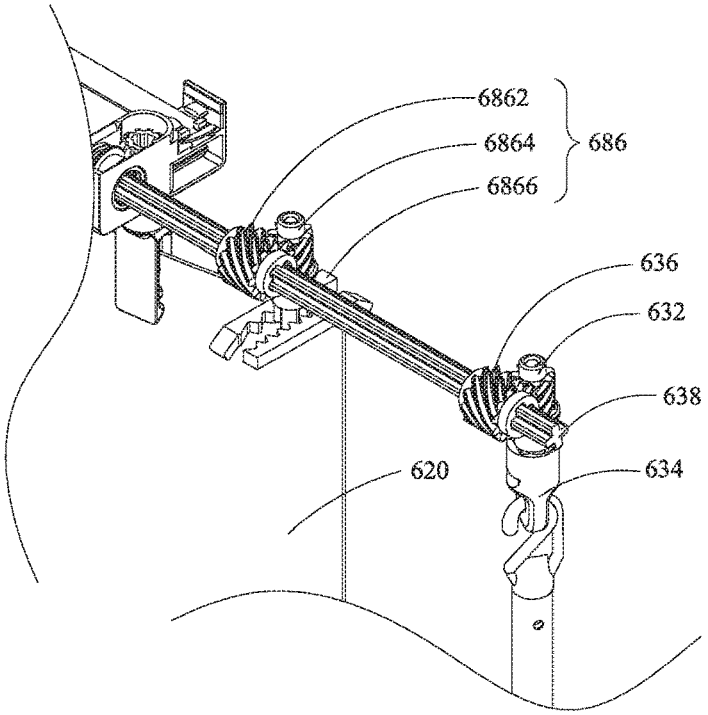
FIG. 32 is a partial perspective view of the vertical blind shown in FIG. 30, showing the structural relationship between the control mechanism and the pushing mechanism.
Figure 33:
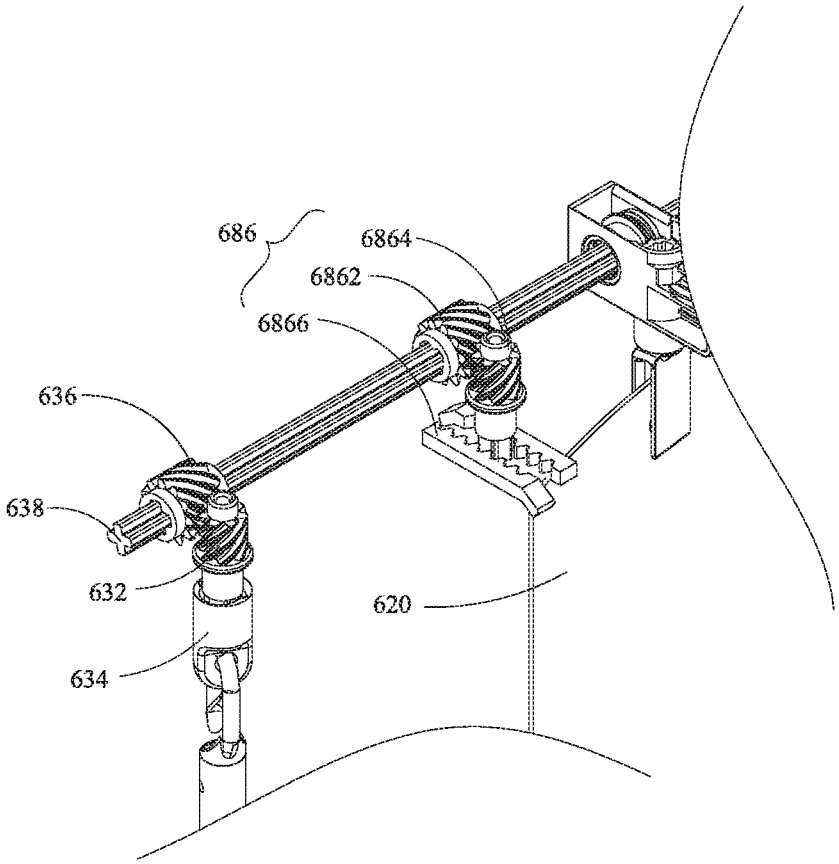
FIG. 33 is a partial perspective view of the vertical blind shown in FIG. 30 viewed from another angle, showing the condition of the pushing mechanism when the covering assembly is in the closed state.

FIG. 22 to FIG. 25 are different views showing the condition when the covering assembly of the vertical blind 500 is in the closed state. In FIG. 22 and FIG. 23, the front cover plate 582 and the rear cover plate 584 naturally droop to cover the gap 550 at the same time, whereby light would not be able to pass therethrough. In FIG. 24, the vertical blind 500 is in the closed state, wherein the headrail 510, the front cover plate 582, and the rear cover plate 584 are omitted. FIG. 25 is a bottom view showing the condition when the covering assembly is in the closed state, and it can be clearly seen that the rotary portion 5862 is disposed in the headrail 510, and the pushing portion 5864 below is approximately located at a same height with the gap 550. When an angle of the slats 520 is substantially parallel to a longitudinal direction of the headrail 510 (i.e., when the covering assembly is in the closed state), the angle of the pushing portion 5864 is consistent with the angle of the slats 520. As a result, the front cover plate 582 and the rear cover plate 584 could naturally droop, and would have no interference from the pushing portion 5864.

FIG. 26 to FIG. 29 are different views showing the condition when the covering assembly of the vertical blind 500 is in the fully open state. During the process of turning the slats 520 toward an angle substantially perpendicular to the longitudinal direction of the headrail 510, the pushing portion 5864 would be rotated by the same angle with the slats 520, and two ends of the pushing portion 5864 in the longitudinal direction thereof would push the front cover plate 582 and the rear cover plate 584 before end corners of the slats 520. When the covering assembling is changed into the fully open state, the pushing portion 5864 would push and lift the front cover plate 582 and the rear cover plate 584 upward and outward to allow light to pass therethrough.

Similar to the aforementioned embodiments, while the covering assembly is changing toward the another closed state after going through the fully open state, the pushing portion 5864 of the pushing mechanism 586 would gradually leave the front cover plate 582 and the rear cover plate 584, so that the front cover plate 582 and the rear cover plate 584 would naturally droop for not being pushed anymore. Whereby, the gap 450 would be still covered when the covering assembly is in the another closed state.

A vertical blind 600 using a light blocking system of the sixth embodiment of the present invention is shown in FIG. 30 to FIG. 36. Similar to the aforementioned vertical blind 500, the vertical blind 600 using the current embodiment includes a headrail 610, a covering assembly hung below the headrail 610, a control mechanism 630, and a light blocking system, wherein the light blocking system includes a front cover plate 682, a rear cover plate 684, and a driving module. The covering assembly includes a plurality of slats 620, and a gap 650 is left between a bottom of the headrail 610 and a top edge of the slats 620. The front cover plate 682 and the rear cover plate 684 are respectively pivotably provided under the headrail 610 in a longitudinal direction of the headrail 610. The control mechanism 630 includes a led gear 632, a hook portion 634, a link gear 636, and a link shaft 638, wherein the led gear 632 is provided in the headrail 610, and is connected to an upper end of the hook portion 634. The hook portion 634 has an operation rod suspended below to be operated. The link gear 636 fits around the link shaft 638 to be synchronously moved along with the link shaft 638, and the link shaft 638 is provided in a way that the link shaft 638 is synchronously movable with a turning mechanism of the slats 620. Furthermore, the led gear 632 meshes with the link gear 636. When the link gear 632 is controlled to rotate, the link gear 636 and the link shaft 638 would be driven to rotate together, whereby to change an angle of the slats 620. The driving module is a pushing mechanism 686 in the current embodiment, including a driving portion 6862, a mounting portion, and pushing portions 6866. The driving portion 6862 fits around the link shaft 638 to be synchronously movable with the link shaft 638, and has external teeth provided therearound. The mounting portion is a rotary portion 6864 in the current embodiment, and has teeth provided on an end thereof to mesh with the driving portion 6862, whereby to be driven by the driving portion 6862. Each of the pushing portions 6866 is a toothed rack in the current embodiment, and meshes with another end of the rotary portion 6864. When the rotary portion 6864 is controlled to rotate, the pushing portions 6866 would be moved back and forth in a direction parallel to a transverse direction of the headrail 610.

FIG. 30 to FIG. 33 are different views showing the condition when the covering assembly of the vertical blind 600 is in the closed state. At this time, the pushing portions 6866 would be driven by the rotary portion 6864 to move toward the rotary portion 6864, and would locate below the headrail 610. As a result, the front cover plate 682 and the rear cover plate 684 would naturally droop and cover the gap 650, whereby to prevent light from passing through.

Figure 34:
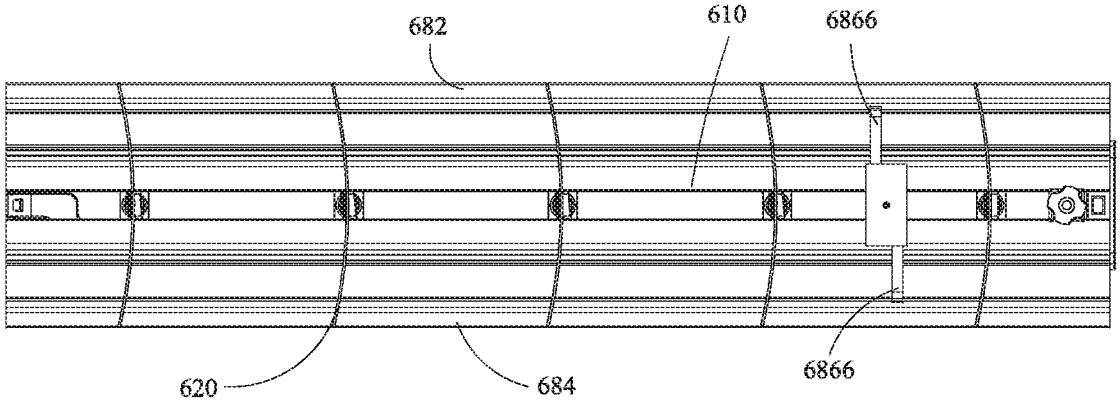
FIG. 34 is similar to FIG. 30, which is also a bottom view of the vertical blind, but the covering assembly is in the fully open state.
Figure 35:
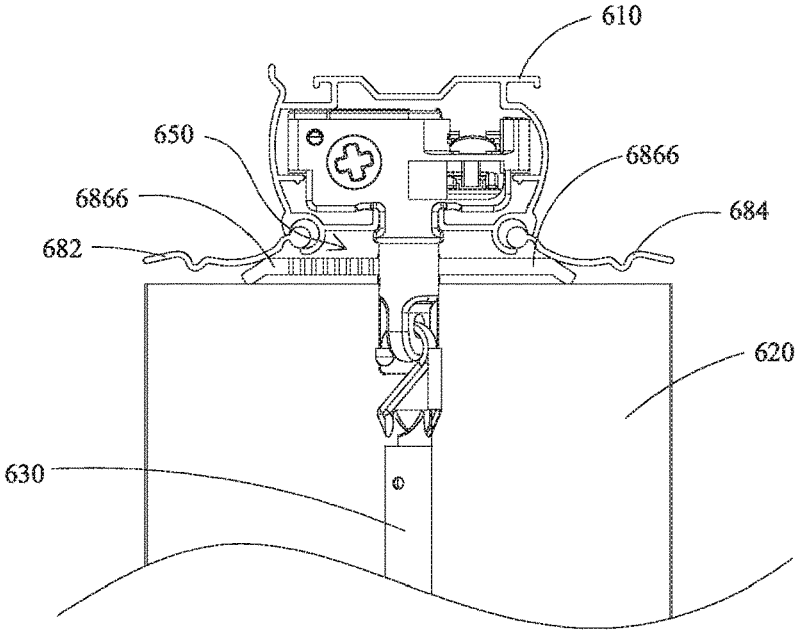
FIG. 35 is a partial side view of the vertical blind shown in FIG. 34.
Figure 36:
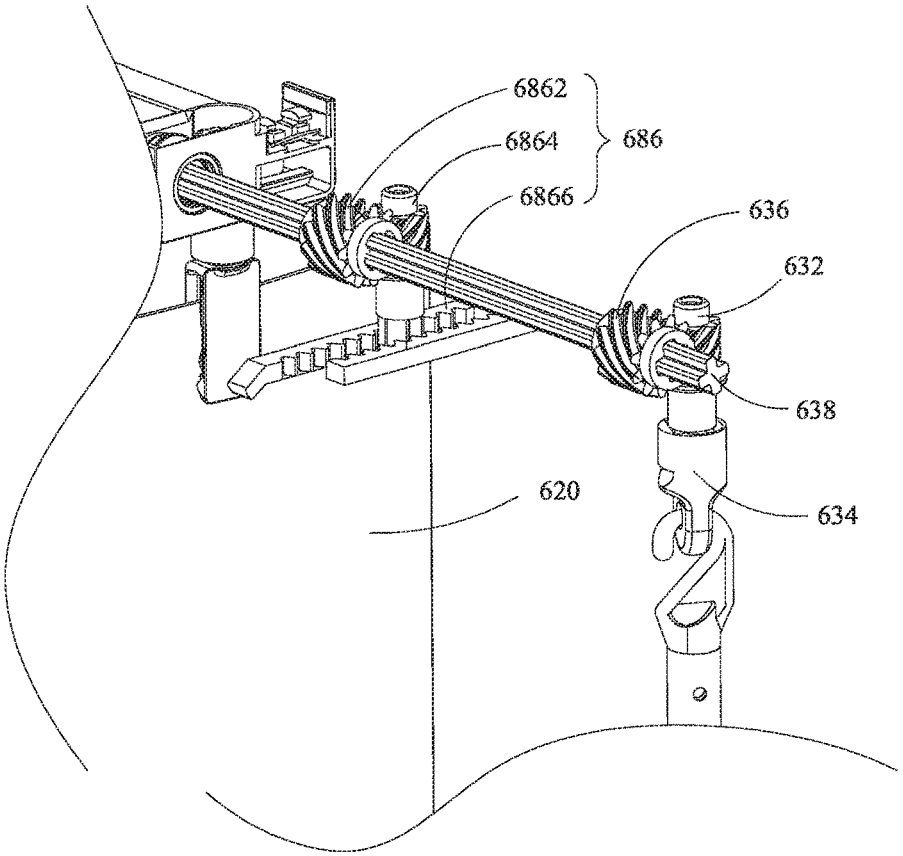
FIG. 36 is a partial perspective view of the vertical blind shown in FIG. 34, showing the condition of the pushing mechanism when the covering assembly is in the fully open state.

FIG. 34 to FIG. 36 are different views showing the condition when the covering assembly of the vertical blind 600 is in the fully open state. At this time, the pushing portions 6866 would be driven by the rotary portion 6864 to move outward in the transverse direction of the headrail 610. Whereby, an end of each of the pushing portions 6866 corresponding to the front cover plate 682 and rear cover plate 684 would respectively push the front cover plate 682 and the rear cover plate 684, so that the front cover plate 682 and the rear cover plate 684 would be pushed outward and lifted upward.

In the current embodiment, the number of the pushing portion 6866 is two to correspond to the front cover plate 682 and the rear cover plate 684. However, this is not a limitation of the present invention. If there is only one cover plate included in the vertical blind, there should be only one pushing portion as well.

A vertical blind 700 using a light blocking system of the seventh embodiment of the present invention is shown in FIG. 37 to FIG. 42, which is an embodiment that the cover plate thereof is pivotable. The vertical blind 700 includes a headrail 710, a covering assembly hung below the headrail 710, a control mechanism 730, and a light blocking system. The covering assembly includes a plurality of slats 720, and a gap 750 is left between a bottom of the headrail 710 and a top edge of the slats 720. The light blocking system includes a cover plate 782 and a driving module, wherein the driving module in the current embodiment is a pushing mechanism 786, of which an end is connected to the cover plate 782, and another end thereof is provided in a way that the pushing mechanism 786 is synchronously movable with the control mechanism 730, whereby the pushing mechanism 786 could be driven by the control mechanism 730. The cover plate 782 is a long plate, and is provided outside of the headrail 710 in a longitudinal direction of the headrail 710.

Figure 38:
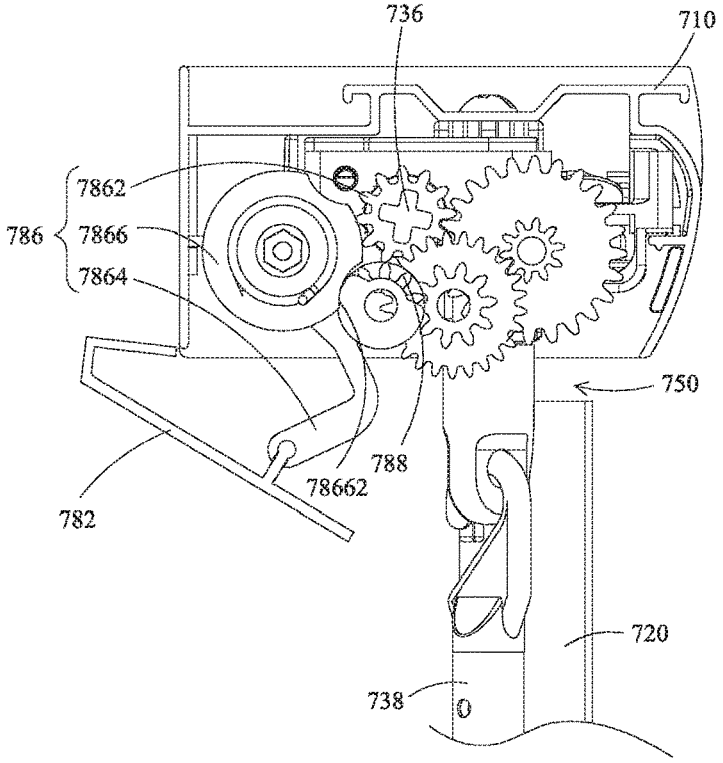
FIG. 38 is a partial side view of the vertical blind shown in FIG. 37, which omits the end cap of the headrail, and shows the conditions of the control mechanism and the pushing mechanism when the covering assembly is in the closed state.
Figure 41:
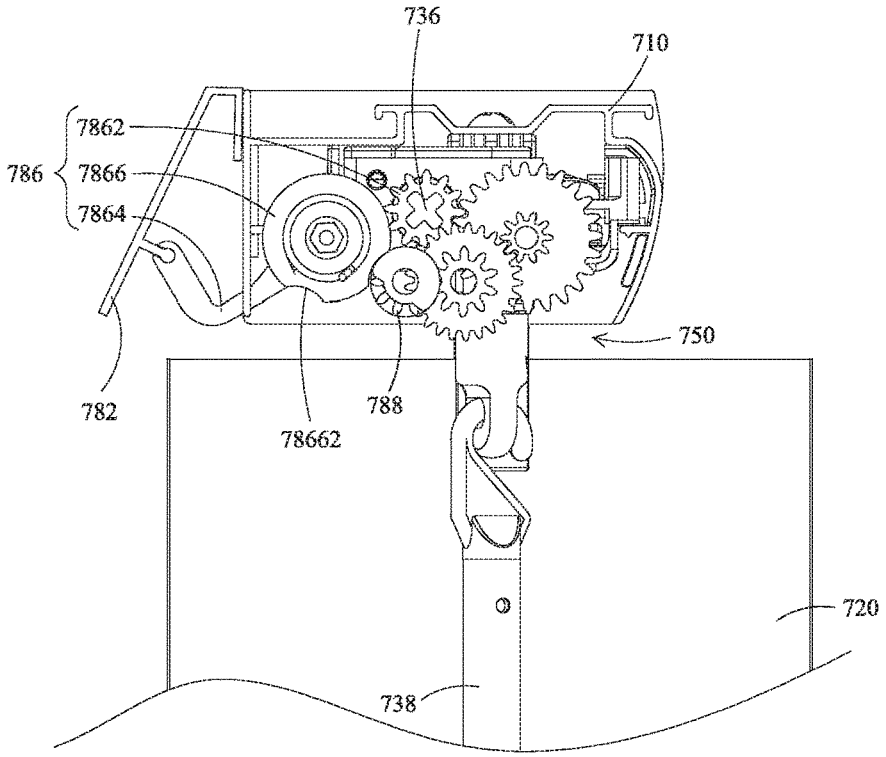
FIG. 41 is another partial side view of the vertical blind shown in FIG. 40 viewed from another angle, which omits the end cap of the headrail, and shows the conditions of the control mechanism and the pushing mechanism when the covering assembly is in the fully open state.

The control mechanism 730 is provided in the headrail 710, and includes a link shaft 736 sequentially connecting the turning mechanism (i.e., the clip) of each of the slats 720, and an operation rod 738 to be operated. When the operation rod 738 is rotated, the link shaft 736 would be correspondingly rotated to change an angle of the slats 720. However, such mechanism for adjusting the angle of the slats 720 are conventional, and therefore we are not going to describe in details herein. The pushing mechanism 786 includes a driving portion 7862, a pushing portion 7864, and a mounting portion 7866, wherein the driving portion 7862 in the current embodiment is a gear with external teeth, and the driving portion 7862 fits around the link shaft 736 to be synchronously moved along with the link shaft 736. The pushing portion 7864 is L-shaped, wherein an end thereof is connected to the driving portion 7862 through the mounting portion 7866, and could be driven by the driving portion 7862 to move between a lowered position and a lifted position. Another end of the pushing portion 7864 is fixedly connected to the cover plate 782, so that the cover plate 782 could be lowered or lifted along with a movement of the pushing portion 7864. In more details, the mounting portion 7866 has external teeth provided on at least a part of a periphery thereof. In the current embodiment, the external teeth of the mounting portion 7866 meshes with the external teeth of the driving portion 7862 through a plurality of intermediate gears to create an appropriate gear ratio. It is worth mentioning that, the mounting portion 7866 has two recesses 78662 provided on the periphery thereof, wherein the recesses 78662 have no teeth, and one of them could properly accommodate one of the intermediate gears (which is given a reference number 788) when the covering assembly is in the fully open state or the closed state. As a result, said intermediate gear 788 which falls into one of the recesses 78662 could rotate freely in there, as illustrated in FIG. 38 and FIG. 41. Whereby, the cover plate 782 could be prevented from over-flipping and hitting the headrail 710 or the slats 720.

Figure 37:
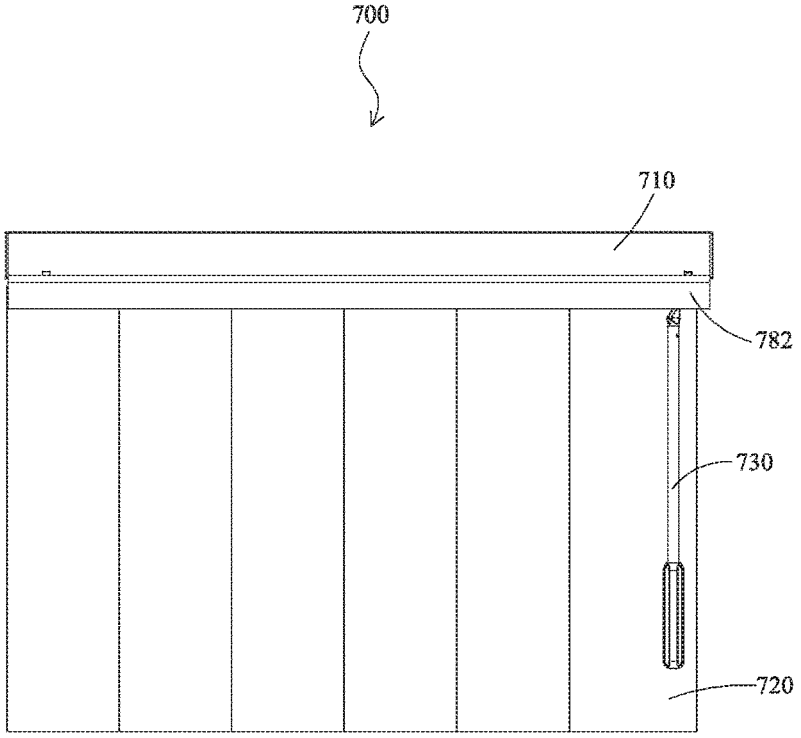
FIG. 37 is a front view of a vertical blind of the light blocking system of a seventh embodiment of the present invention, wherein the covering assembly is in the closed state.
Figure 39:
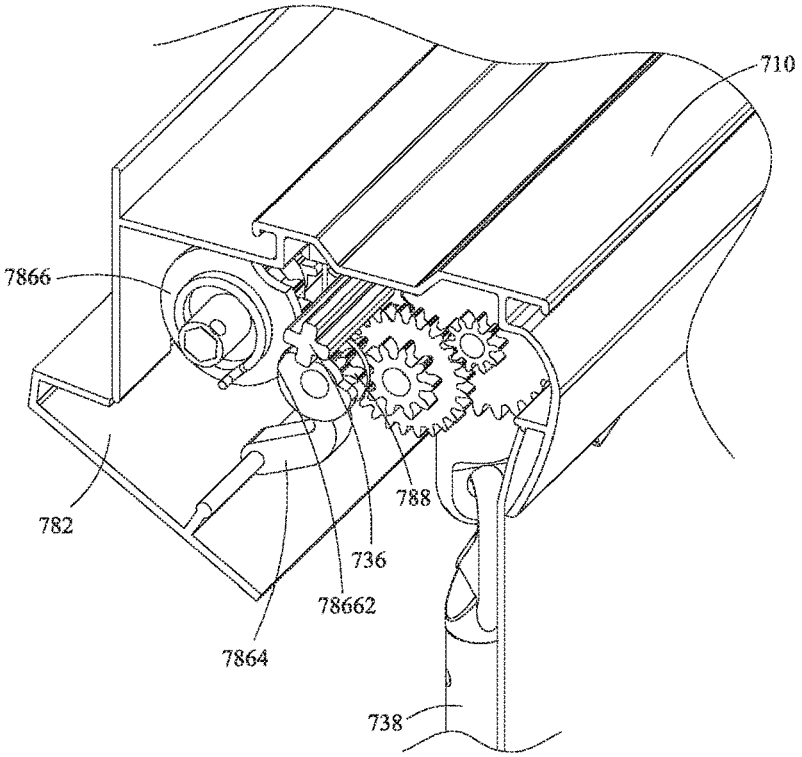
FIG. 39 is a partial perspective view of the vertical blind shown in FIG. 37.

FIG. 37 to FIG. 39 are different views showing the condition when the covering assembly of the vertical blind 700 is in the closed state. At this time, the pushing portion 7864 is at the lowered position, so that the cover plate 782 which is connected to the another end of the pushing portion 7864 corresponding to the driving portion 7862 would be lowered to cover the gap 750, which could prevent light from passing therethrough.

Figure 40:
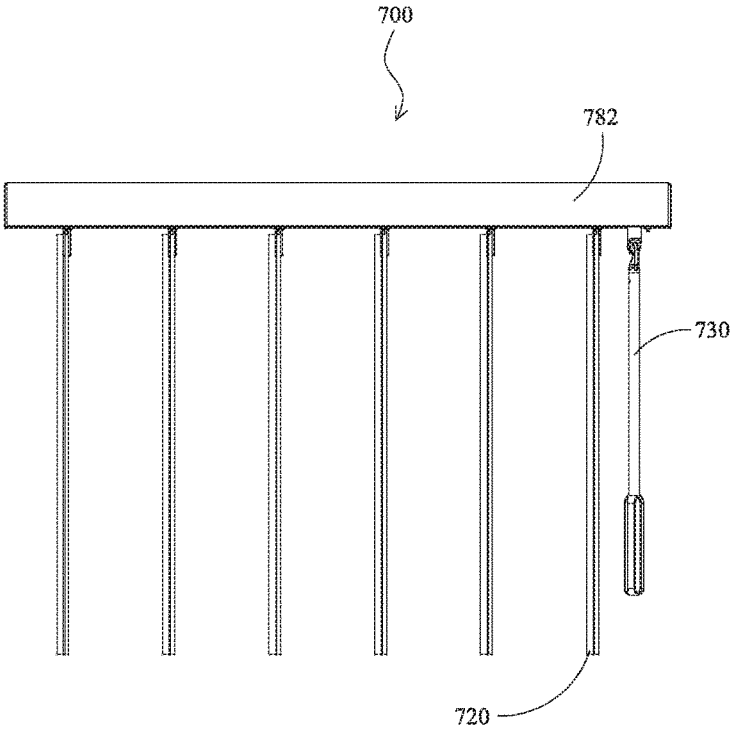
FIG. 40 is similar to FIG. 37, which is a front view of the vertical blind applied with the light blocking system of the seventh embodiment of the present invention, but the covering assembly is in the fully open state.
Figure 42:
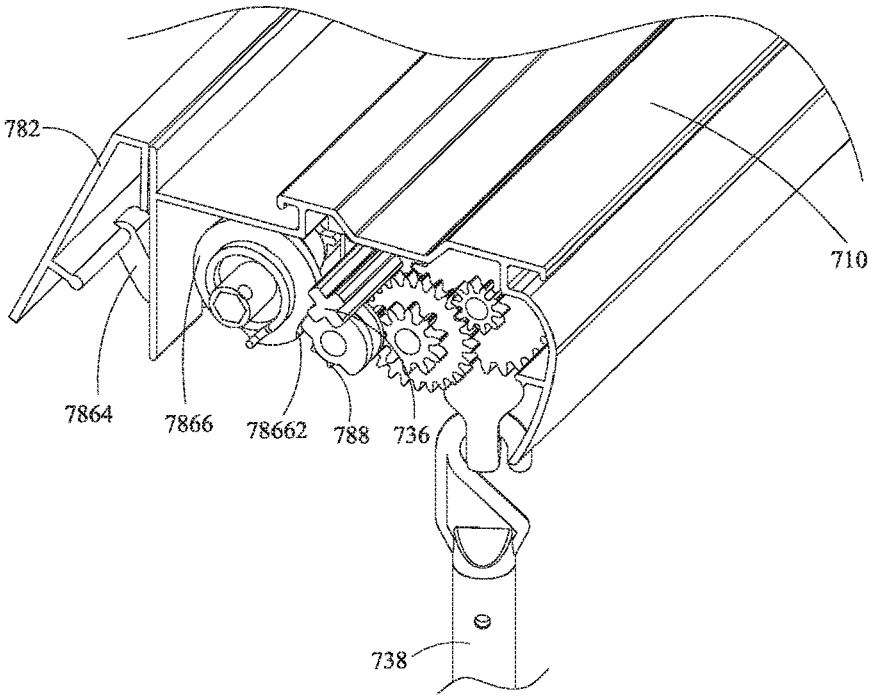
FIG. 42 is a partial perspective view of the vertical blind shown in FIG. 40.

FIG. 40 to FIG. 42 are different views showing the condition when the covering assembly of the vertical blind 700 is in the fully open state. When the turning mechanisms of the slats 720 of the vertical blind 700 are driven by the control mechanism 730 to rotate and change the covering assembly toward the fully open state, the pushing portion 7864 would be also driven to rotate by the driving portion 7862 through the mounting portion 7866, so that the pushing portion 7864 would be pivoted clockwise about the mounting portion 7866 from the lowered position to the lifted position. In other words, the end of the pushing portion 7864 connected to the cover plate 782 would be moved outward and upward relative to the headrail 710, whereby to lift the cover plate 782 outward and upward, allowing light to pass through the gap 750. It is worth mentioning that, if viewed from a front view angle illustrated in FIG. 40, the lifted cover plate 782 would cover the headrail 710, whereby to provide a different visual effect.

A vertical blind 800 using a light blocking system of the eighth embodiment of the present invention is shown in FIG. 43 to FIG. 48, which is another embodiment having a pivotable cover plate. The vertical blind 800 includes a headrail 810, a covering assembly hung below the headrail 810, a control mechanism 830, and a light blocking system. The covering assembly includes a plurality of slats 820, and a gap 850 is left between a bottom of the headrail 810 and a top edge of the slats 820. The light blocking system includes a cover plate 882 and a driving module, wherein the driving module in the current embodiment is a pushing mechanism 886, of which an end is connected to the cover plate 882, and another end is provided in a way that the pushing mechanism 886 could be synchronously moved along with the control mechanism 830, so that the pushing mechanism 886 could be driven by the control mechanism 830 to rotate. The cover plate 882 is a long plate, which is provided on an outside of the headrail 810 along a longitudinal direction of the headrail 810.

The control mechanism 830 is similar to the control mechanism 730 cooperating with the aforementioned seventh embodiment, and also has a link shaft 836 provided in the headrail 810 to sequentially connect the turning mechanism (i.e., the clip) of each of the slats 820, and an operation rod 838 to be operated. When the operation rod 838 is rotated, the link shaft 836 would be synchronously driven to change an angle of the slats 820. The pushing mechanism 886 includes a driving portion 8862, a pushing portion 8864, and a mounting portion 8866, wherein the driving portion 8862 in the current embodiment is a gear with external teeth, and the driving portion 8862 fits around the link shaft 836 to be synchronously rotated along with the link shaft 836. The mounting portion 8866 also has external teeth meshing with the external teeth of the driving portion 8862. In more details, the mounting portion 8866 includes a gear 88662 and a cam 88664, and said external teeth are teeth of the gear 88662. Whereby, the gear 88662 could be driven by the driving portion 8862 to further rotate the cam 88664 correspondingly. The pushing portion 8864 is substantially L-shaped, of which an end has a shape matching the cam 88664, and another end is close to the cover plate 882 to optionally abut against the cover plate 882. More specifically, with the connection relationship between the pushing portion 8864, the mounting portion 8866, and the driving portion 8862, the pushing portion 8864 could be driven by the driving portion 8862, and could raise or lower the end close to the cover plate 882 along with the rotation of the cam 88664.

Figure 43:
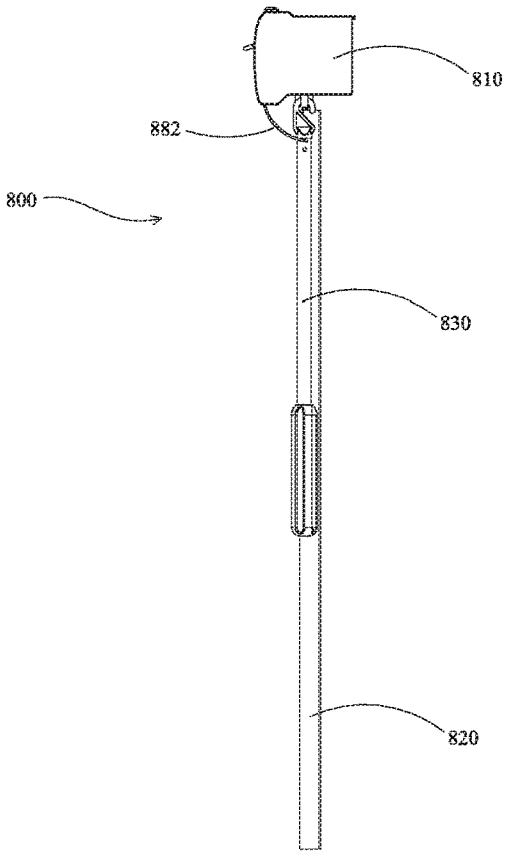
FIG. 43 is a side view of a vertical blind applied with the light blocking system of an eighth embodiment of the present invention, wherein the covering assembly is in the closed state.
Figure 44:
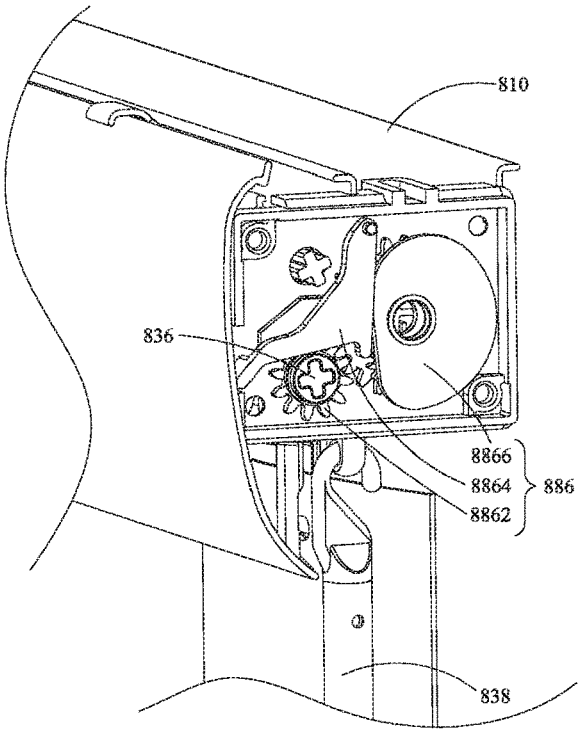
FIG. 44 is a partial perspective view of the vertical blind shown in FIG. 43, showing the structural relationship between the headrail and part of the light blocking system.
Figure 45:
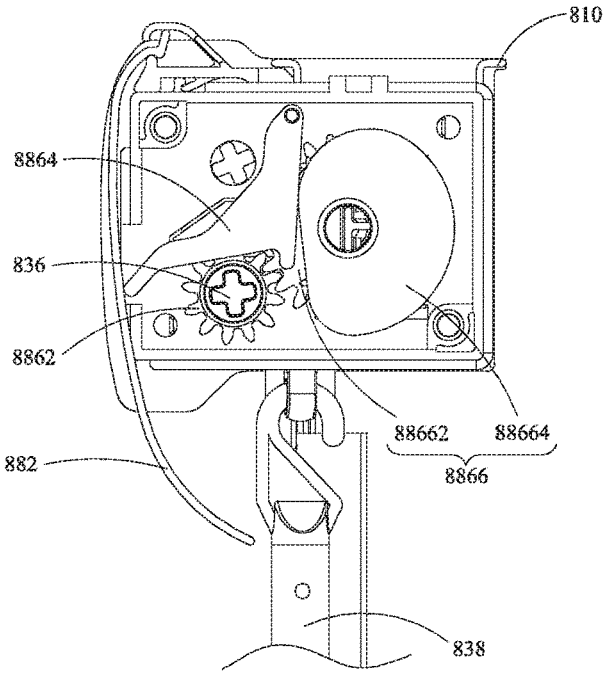
FIG. 45 is a partial side view of the vertical blind shown in FIG. 43, showing the condition of the light blocking system when the covering assembly is in the closed state.

FIG. 43 to FIG. 45 are different views showing the condition when the covering assembly of the vertical blind 800 is in the closed state. At this time, the end of the pushing portion 8864 close to the cam 88664 would correspond to a flat segment of a periphery of the cam 88664, and therefore the pushing portion 8864 would not be pushed by the cam 88664, so that the end thereof close to the cover plate 882 would maintain in the lowered condition. As a result, the cover plate 882 would be substantially vertical, whereby the cover plate 882 could cover the gap 850 to prevent light from passing through.

Figure 46:
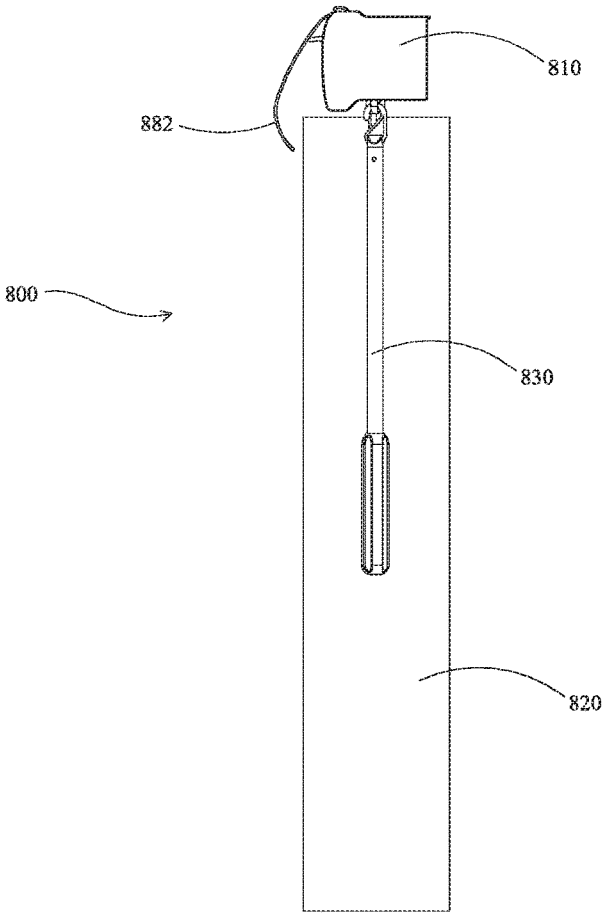
FIG. 46 is similar to FIG. 43, which is also a side view of the vertical blind applied with the light blocking system of the eighth embodiment of the present invention, but the covering assembly is in the fully open state.
Figure 47:
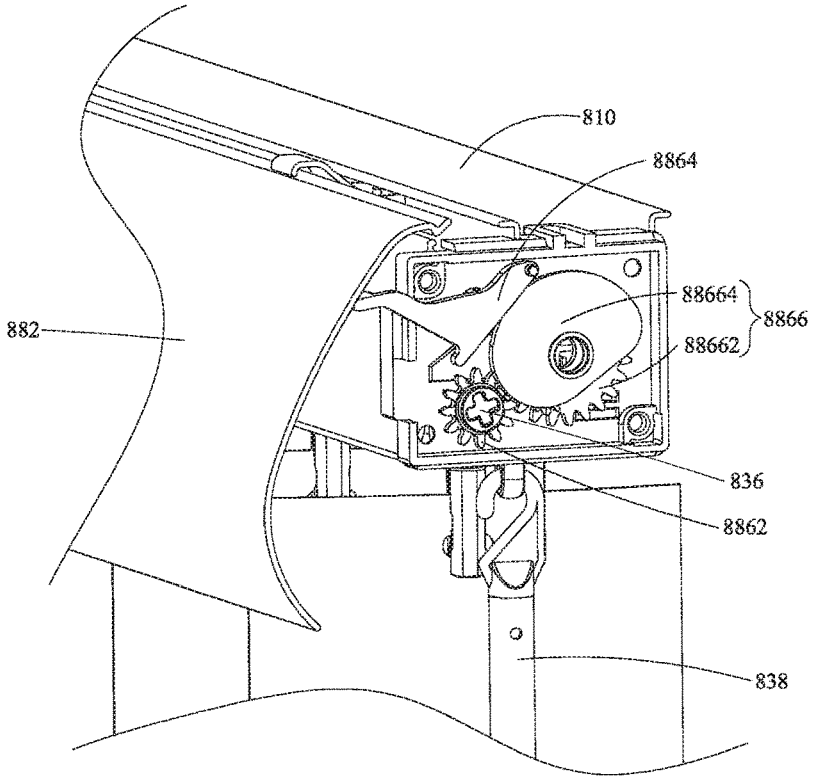
FIG. 47 is a partial perspective view of the vertical blind shown in FIG. 46, showing the structural relationship between the headrail and part of the light blocking system.
Figure 48:
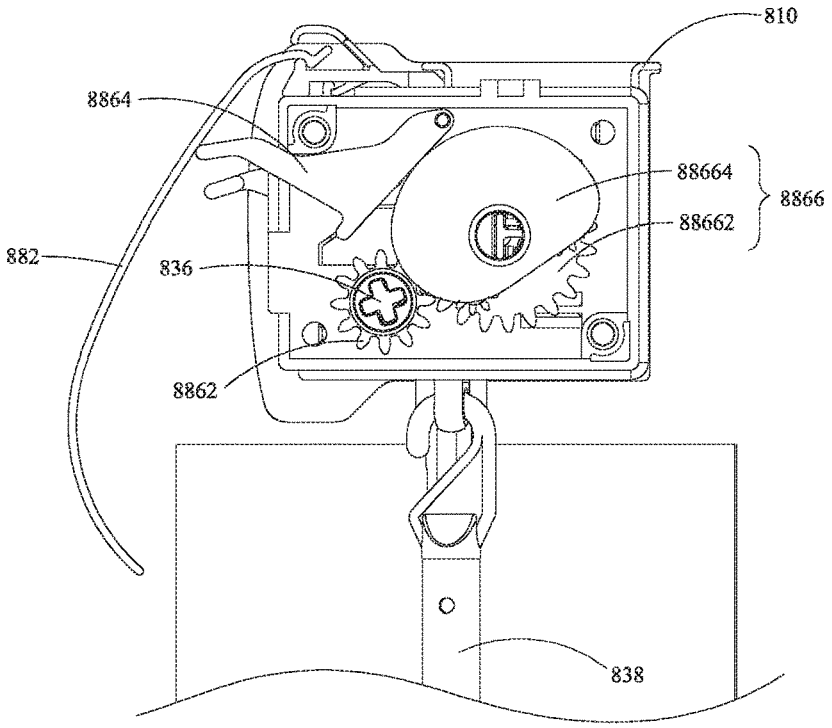
FIG. 48 is a partial side view of the vertical blind shown in FIG. 46, showing the condition of the light blocking system when the covering assembly is in the fully open state.
Figure 49:
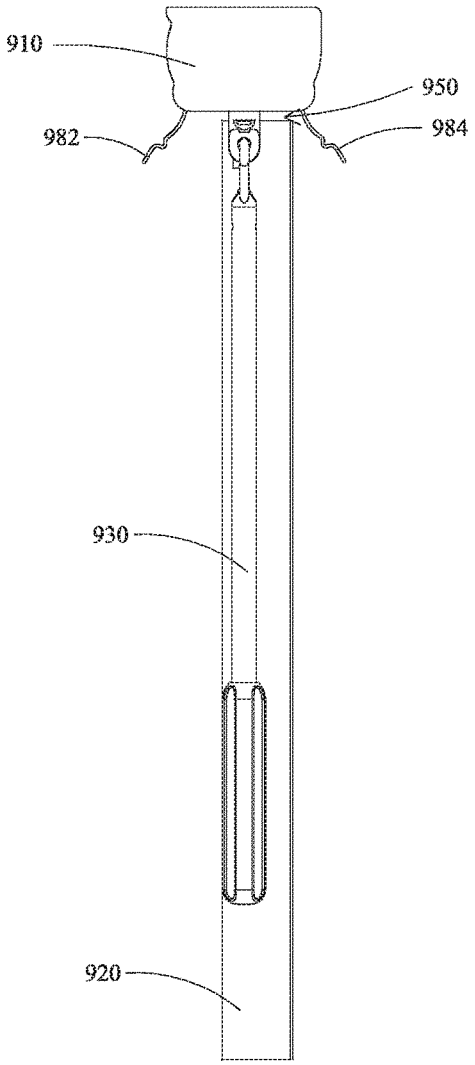
FIG. 49 is a side view of a vertical blind applied with the light blocking system of a ninth embodiment of the present invention, wherein the covering assembly is in the closed state.
Figure 50:
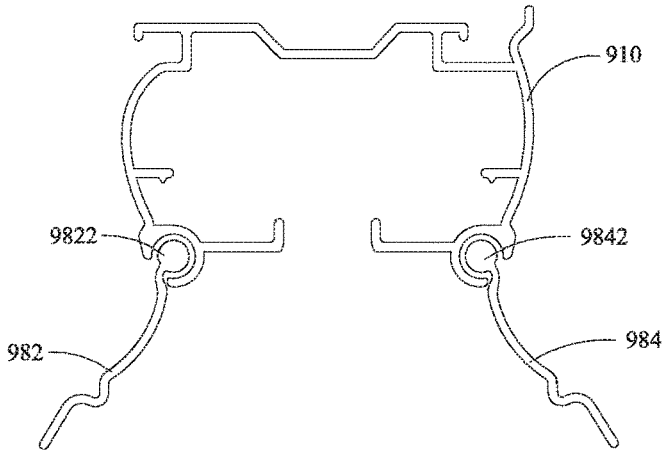
FIG. 50 is a partial side view of the vertical blind shown in FIG. 49, showing the structural relationship between the headrail and part of the light blocking system.
Figure 51:
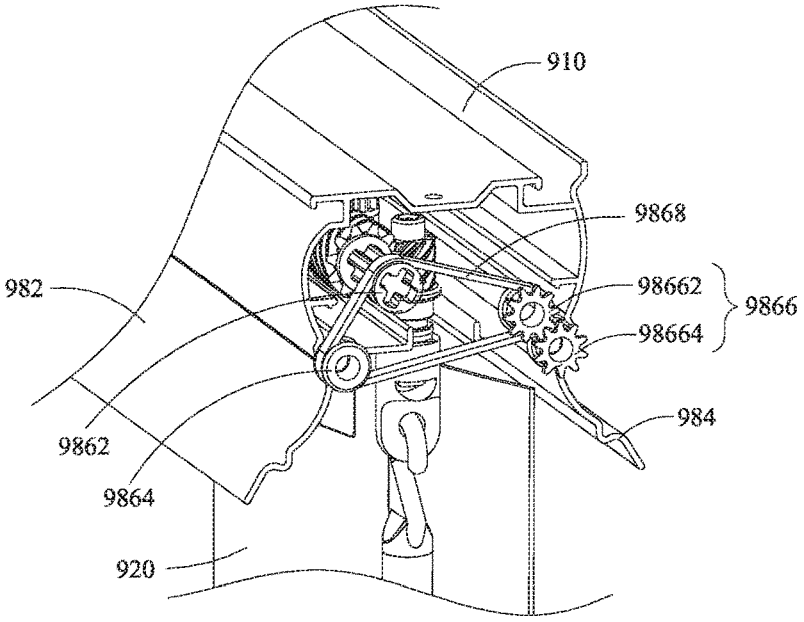
FIG. 51 is a partial perspective view of the vertical blind shown in FIG. 49, showing the position and the arrangement of the light blocking system in the headrail.
Figure 52:
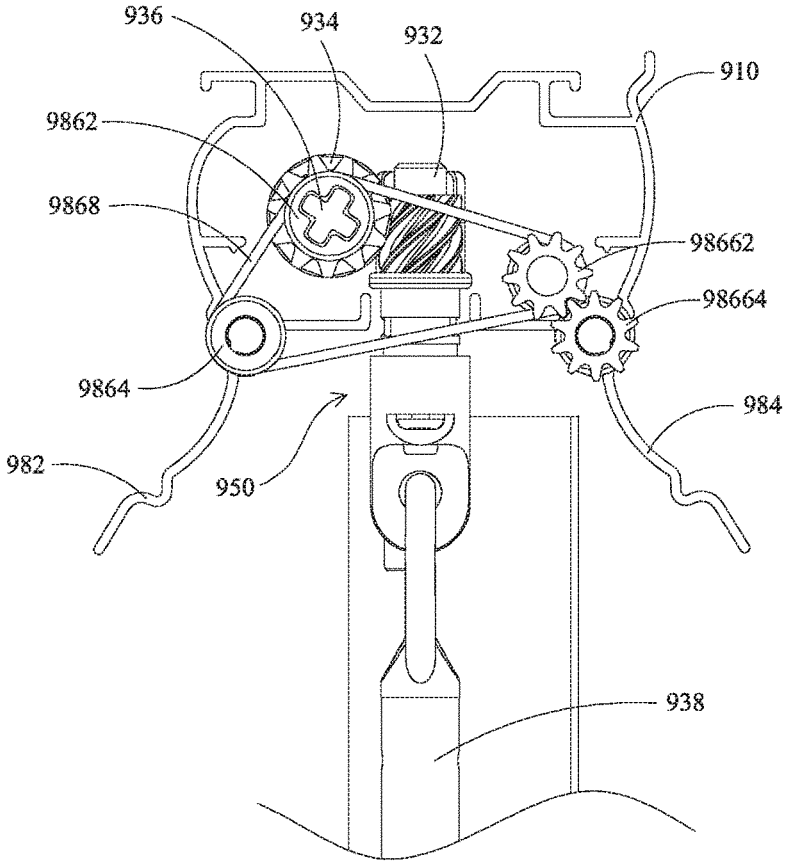
FIG. 52 is a partial side view of the vertical blind shown in FIG. 49, which also shows the position and the arrangement of the light blocking system in the headrail.

FIG. 46 to FIG. 48 are different views showing the condition when the covering assembly of the vertical blind 800 is in the fully open state. When the turning mechanisms of the slats 820 of the vertical blind 800 are driven to rotate by the control mechanism 830, changing the covering assembly toward the fully open state, the end of the pushing portion 8864 close to the cam 88664 would be pushed by the periphery of the cam 88664, so that the another end thereof close to the cover plate 882 would be raised to push the cover plate 882, whereby to push the cover plate 882 outward and upward to allow light to pass through the gap 850.

A vertical blind 900 using a light blocking system of the ninth embodiment of the present invention is shown in FIG. 49 to FIG. 56, which is also an embodiment that the cover plate is pivotable, the same as the previous embodiment. The vertical blind 900 includes a headrail 910, a covering assembly hung below the headrail 910, a control mechanism 930, and a light blocking system, wherein the covering assembly includes a plurality of slats 920, and a gap 950 is left between a bottom of the headrail 910 and a top edge of the slats 920. The light blocking system includes a front cover plate 982, a rear cover plate 984, and a driving module, wherein the front cover plate 982 and the rear cover plate 984 are rotatably provided below the headrail 910 with a shaft 9822, 9842 thereof. The driving module in the current embodiment is a lifting mechanism 986, which includes a driving portion 9862 and motion portions 9864, 9866. The driving portion 9862 is provided in a way that the driving portion 9862 is synchronously movable with the control mechanism 930, and the motion portions 9864, 9866 are synchronously movable with the front cover plate 982 and the rear cover plate 984, respectively. Whereby the driving portion 9862 could be driven by the control mechanism 930 to pivot the front cover plate 982 and the rear cover plate 984.

The control mechanism 930 includes a led gear 932, a link gear 934, and a link shaft 936 provided in the headrail 910, wherein the link shaft 936 sequentially connects the turning mechanism of each of the slats 920. The link gear 934 fits around the link shaft 936 to be synchronously moved along with the link shaft 936. The led gear 932 meshes with the link gear 934, and has an operation rod 938 provided below to be operated. When the operation rod 938 is rotated, the link gear 934 and the link shaft 936 would be driven to rotate through the led gear 932, so as to change an angle of the slats 920. The driving portion 9862 of the lifting mechanism 986 is a transmission wheel in the current embodiment. The driving portion 9862 fits around the link shaft 936 to be synchronously moved along with the link shaft 936 in the same direction. The motion portion 9864 corresponding to the front cover plate 982 is also a transmission wheel in the current embodiment, and is connected to the shaft 9822 of the front cover plate 982. The motion portion 9866 corresponding to the rear cover plate 984 is two gear shafts 98662, 98664 meshing with each other in the current embodiment, wherein the gear shaft 98664 is connected to the shaft 9842 of the rear cover plate 984. Furthermore, the driving portion 9862 and the motion portions 9864, 9866 are wound around by a transmission member to be able to move synchronously. As shown in FIG. 49 to FIG. 55, the transmission member in the current embodiment is a transmission belt 9868.

Figure 53:
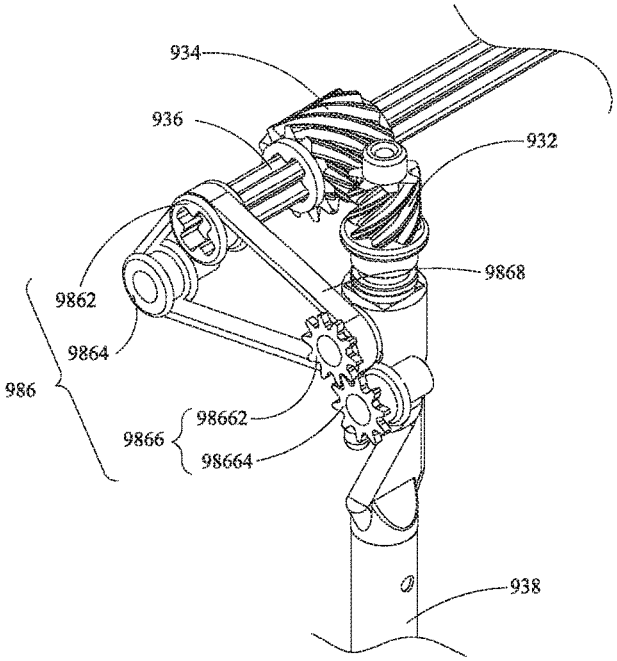
FIG. 53 is a partial perspective view of the vertical blind shown in FIG. 49 viewed from another angle.

FIG. 49 to FIG. 53 are different views showing the condition when the covering assembly of the vertical blind 900 is in the closed state. In FIG. 53, components such as the slats 920 are omitted, and only the operation relationship between the control mechanism 930 and the light blocking system is shown therein. When the slats 920 are driven to turn by the control mechanism 930, changing the covering assembly toward the closed state, the link shaft 936 would drive the lifting mechanism 986. With the transmission of the transmission belt 9868, the driving portion 9862 which is rotated along with the link shaft 936 could drive the motion portions 9864, 9866 to respectively pivot the front cover plate 982 and the rear cover plate 984 into a drooping state, whereby to cover the gap 950 and prevent light from passing through.

Figure 54:
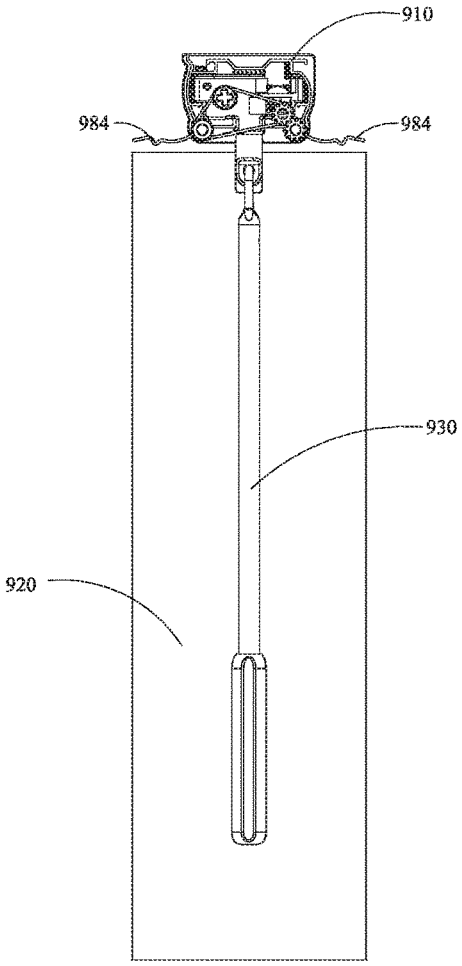
FIG. 54 is similar to FIG. 49, which is also a side view of the vertical blind applied with the light blocking system of the ninth embodiment, but the covering assembly is in the fully open state.
Figure 55:
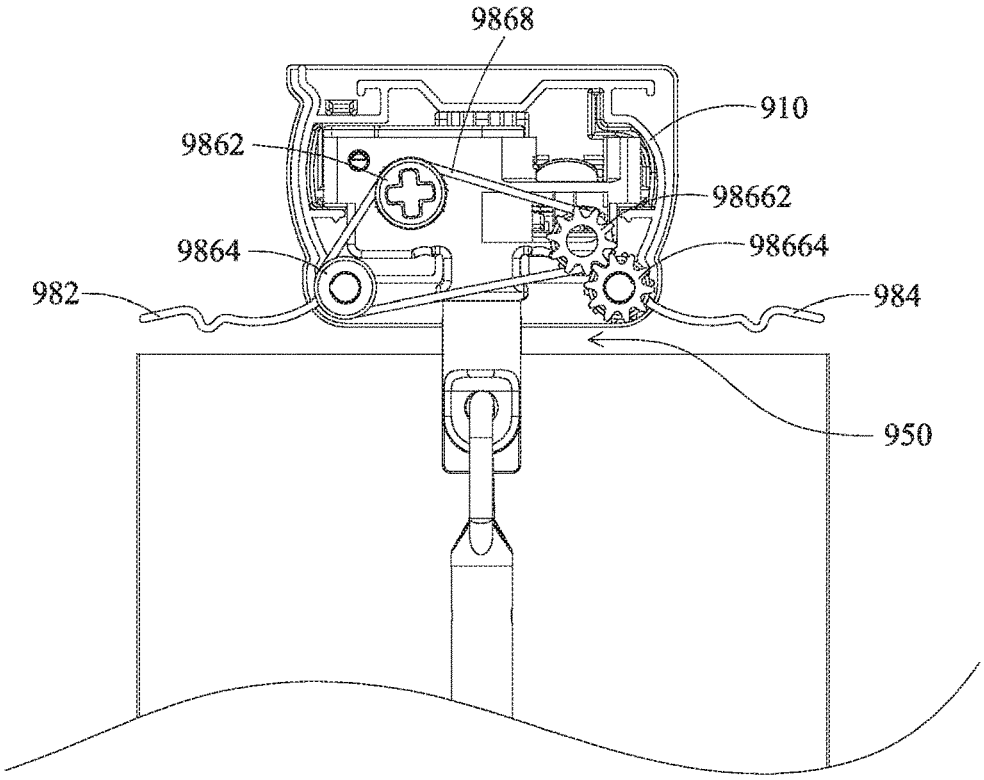
FIG. 55 is a partial side view of the vertical blind shown in FIG. 54, showing the condition of the light blocking system when the covering assembly is in the fully open state.

FIG. 54 to FIG. 55 are different views showing the condition when the covering assembly of the vertical blind 900 is in the fully open state. When the slats 920 are driven to turn by the control mechanism 930 and therefore changing the covering assembly toward the fully open state, the driving portion 9862 would drive the motion portions 9864, 9866 to respectively pivot the front cover plate 982 and the rear cover plate 984 outward and upward to almost align with a bottom of the headrail 910, whereby to allow light to pass through.

Figure 56:
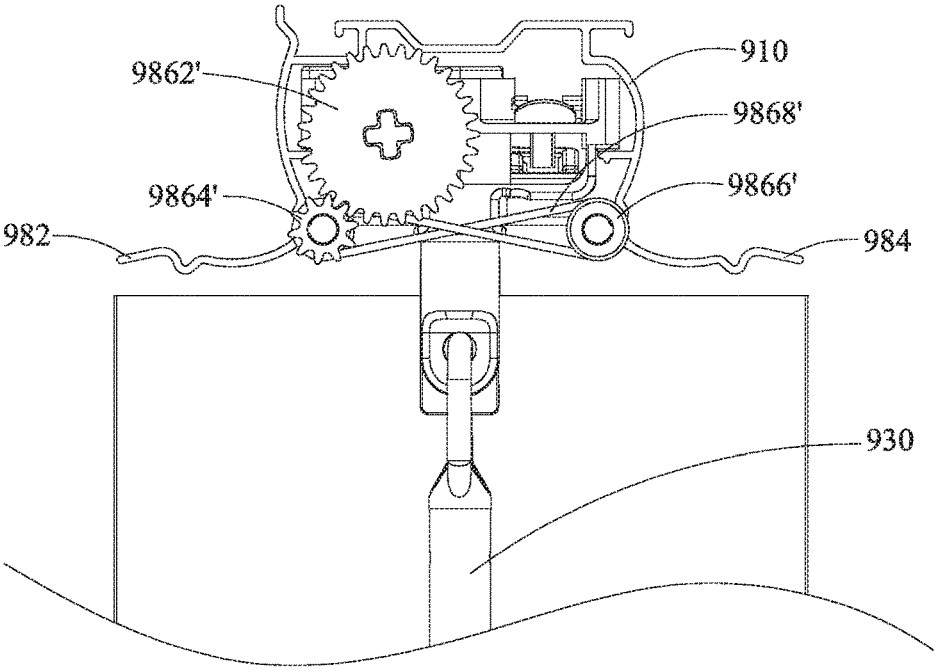
FIG. 56 is a side view of the vertical blind applied with the light blocking system of the ninth embodiment of the present invention, showing another arrangement based on the same principle with the aforementioned light blocking system.

In addition, a lifting mechanism with a different design is disclosed in FIG. 56, which also includes a driving portion 9862', two motion portions 9864', 9866', and a transmission member (i.e., a transmission belt 9868'), wherein each of the driving portion 9862' and the motion portions 9864', 9866' is a transmission wheel in the current embodiment, and the driving portion 9862' fits around the link shaft 936 to be synchronously moved along with the link shaft 936. The motion portions 9864', 9866' are respectively connected to the shaft 9822 of the front cover plate 982 and the shaft 9842 of the rear cover plate 984. The transmission belt 9868' has a turning, which makes the motion portions 9864', 9866' rotate in opposite directions. Similar to the above embodiment, when the driving portion 9862' is driven by the control mechanism 930, the front cover plate 982 and the rear cover plate 984 would be respectively driven to pivot by the motion portions 9864', 9866'.

A vertical blind 1000 using a light blocking system of the tenth embodiment of the present invention is shown in FIG. 57 to FIG. 62, which is an embodiment having a vertical moving cover plate. The vertical blind 1000 includes a headrail 1010, a covering assembly hung below the headrail 1010, a control mechanism 1030, and a light blocking system. The covering assembly includes a plurality of slats 1020, and a gap 1050 is left between a bottom of the headrail 1010 and a top edge of the slats 1020. The light blocking system includes a cover plate 1082 and a driving module, wherein the driving module in the current embodiment is a pushing mechanism 1086. The pushing mechanism 1086 is connected to the cover plate 1082, and is provided in a way that the pushing mechanism 1086 could be synchronously moved along with the control mechanism 1030, whereby the pushing mechanism 1086 could be driven by the control mechanism 1030. The cover plate 1082 is a long plate, and is provided in a longitudinal direction of the headrail 1010.

The control mechanism 1030 includes a led gear 1032, a link gear 1034, and a link shaft 1036 provided in the headrail 1010, wherein the link shaft 1036 sequentially connects the turning mechanism of each of the slats 1020. The link gear 1034 fits around the link shaft 1036 to be synchronously moved along with the link shaft 1036. The led gear 1032 meshes with the link gear 1034, and has an operation rod 1038 suspended below to be operated. The headrail 1010 has a slot 10102 adapted to receive the cover plate 1082. The pushing mechanism 1086 includes a driving portion 10862 and a moving portion 10864, wherein the driving portion 10862 is a gear which has external teeth provided on part of a periphery thereof. The driving portion 10862 fits around the link shaft 1036 to be synchronously moved along with the link shaft 1036. The moving portion 10864 is a toothed rack in the current embodiment, and is provided on a surface of the cover plate 1082 facing the driving portion 10862. Furthermore, the external teeth of the driving portion 10862 meshes with the toothed rack of the moving portion 10864 provided on the cover plate 1082.

Figure 57:
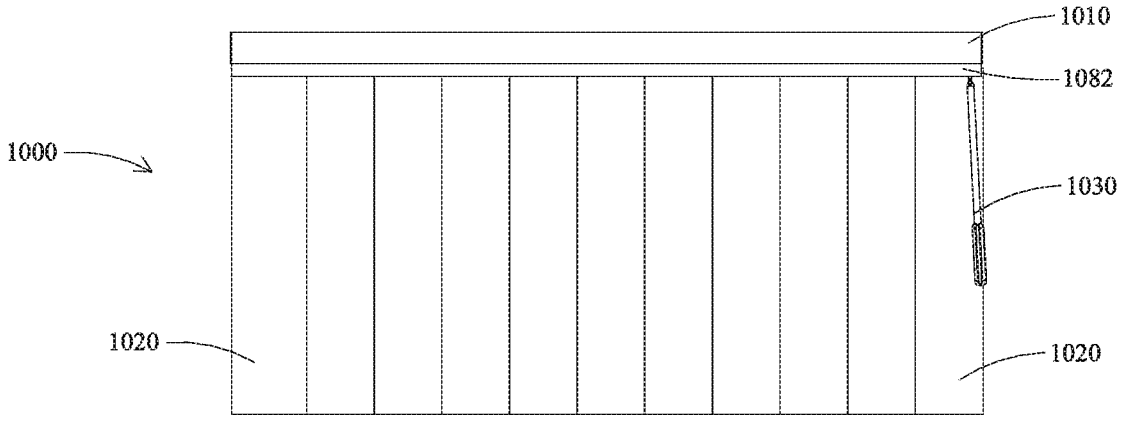
FIG. 57 is a front view of a vertical blind applied with the light blocking system of a tenth embodiment of the present invention, wherein the covering assembly is in the closed state.
Figure 58:
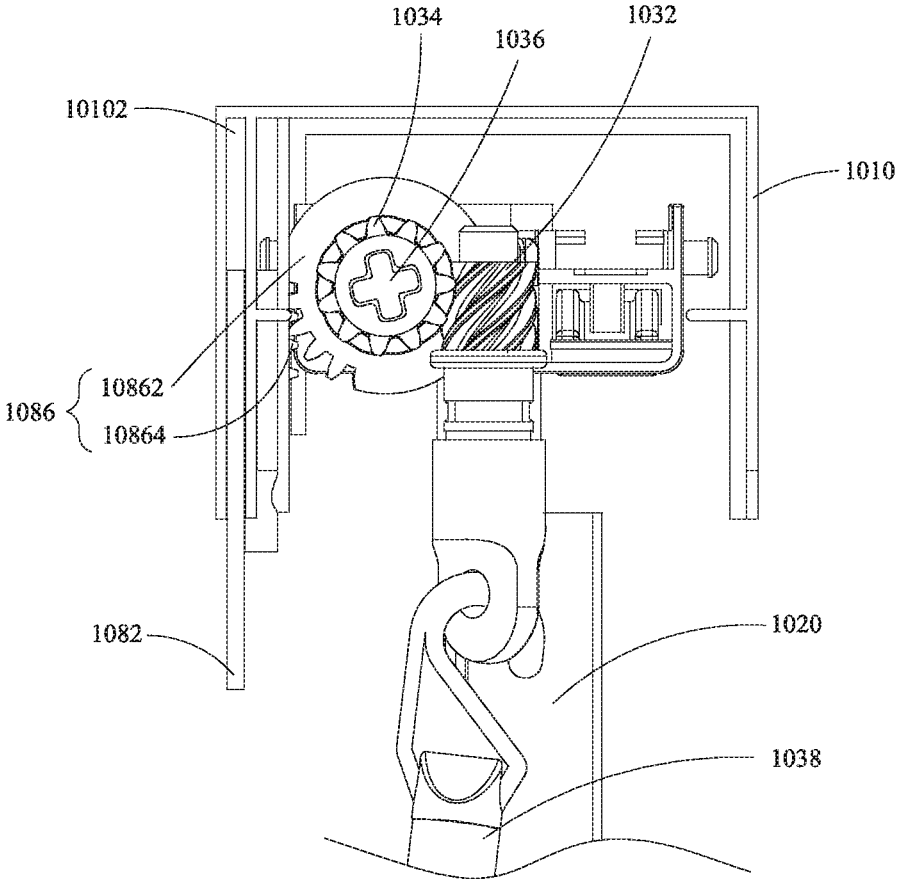
FIG. 58 is a partial side view of the vertical blind shown in FIG. 57, showing the structural relationship between the light blocking system and the control mechanism.
Figure 59:
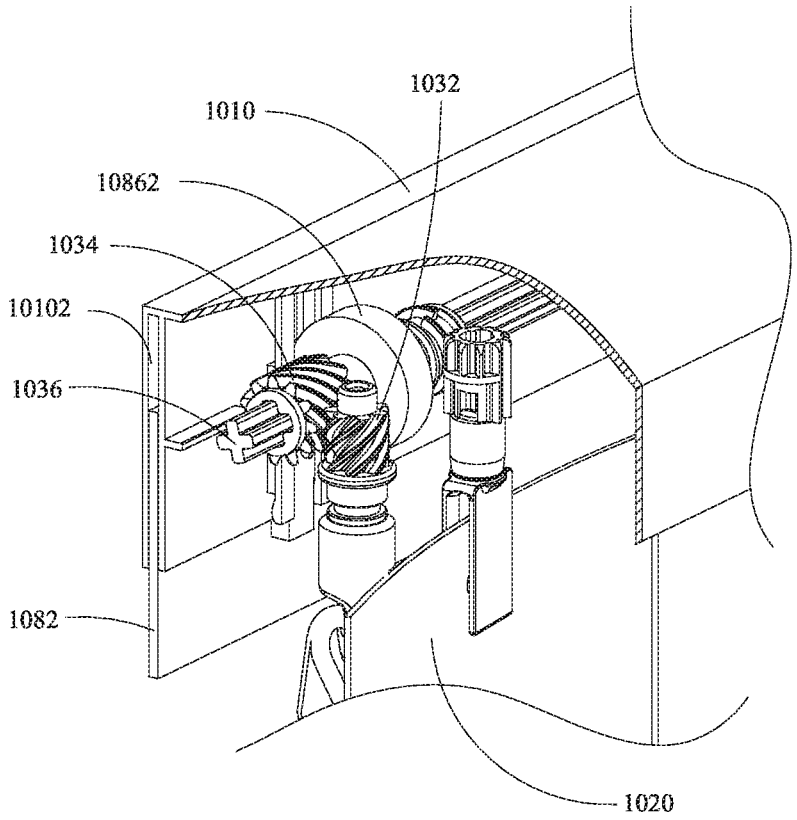
FIG. 59 is a partial perspective view of the vertical blind shown in FIG. 57, showing the condition of the light blocking system when the covering assembly is in the closed state.

FIG. 57 to FIG. 59 are different views showing the condition when the covering assembly of the vertical blind 1000 is in the closed state, wherein FIG. 59 omits part of the top and the rear structures of the headrail 1010 to clearly show the relationship between the components accommodated therein. In the current embodiment, when the led gear 1032 drives the link gear 1034 and the link shaft 1036 to rotate to change the covering assembly into the closed state, the driving portion 10862 would be driven to rotate at the same time, and the driving portion 10862 would drive the cover plate 1082 which meshes therewith through the moving portion 10864 to move relative to the slot 10102, so that the cover plate 1082 would extend out of the slot 10102 to cover the gap 1050, whereby to prevent light from passing through.

Figure 60:
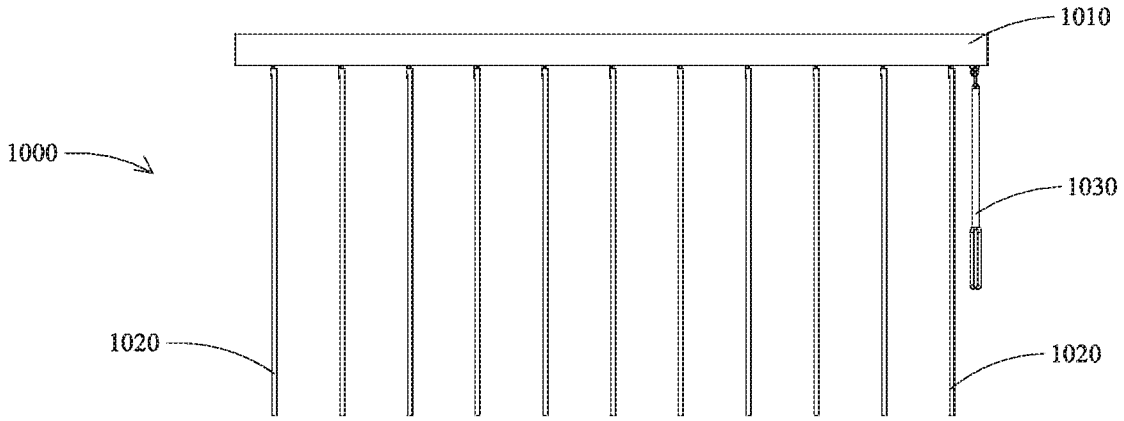
FIG. 60 is similar to FIG. 57, which is also a front view of the vertical blind applied with the light blocking system of the tenth embodiment of the present invention, but the covering assembly is in the fully open state.
Figure 61:
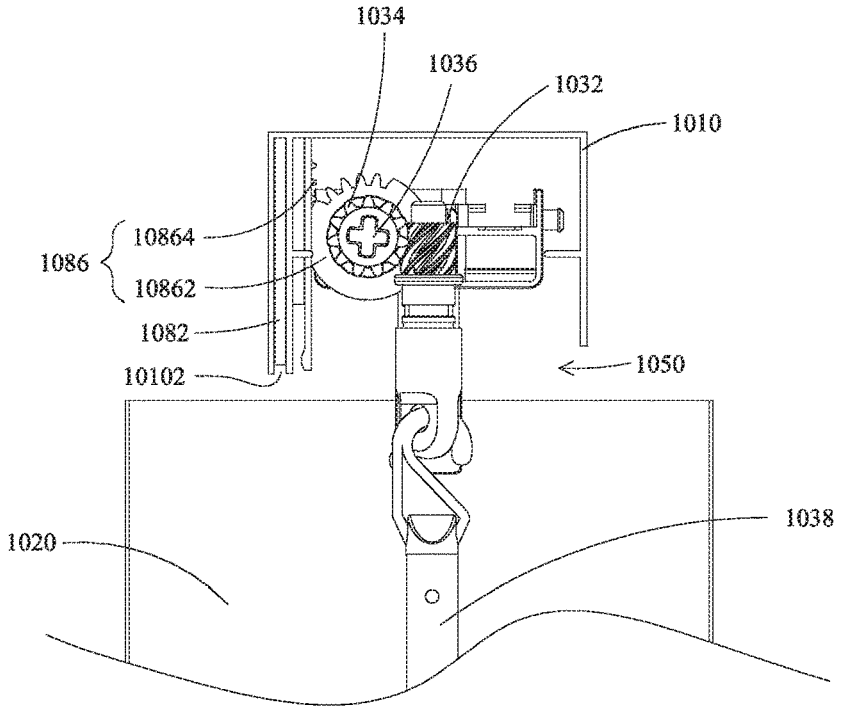
FIG. 61 is a partial side view of the vertical blind shown in FIG. 60, showing the condition of the light blocking system when the covering assembly is in the fully open state.
Figure 62:
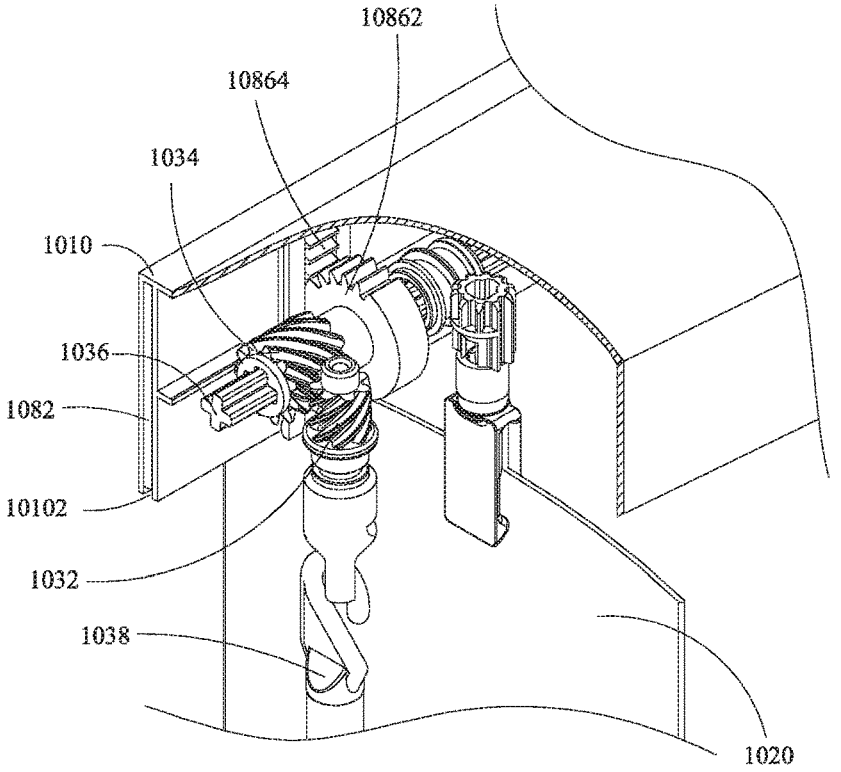
FIG. 62 is a partial perspective view of the vertical blind shown in FIG. 60, also showing the condition of the light blocking system when the covering assembly is in the fully open state.

FIG. 60 to FIG. 62 are different views showing the condition when the covering assembly of the vertical blind 1000 is in the fully open state, wherein FIG. 62 also omits part of the top and the rear structures of the headrail 1010 to clearly show the relationship between the components accommodated therein. When the turning mechanisms of the slats 1020 of the vertical blind 1000 are driven to turn by the control mechanism 1030, changing the covering assembly toward the fully open state, the driving portion 10862 would be driven as well, so that the cover plate 1082 which meshes therewith through the moving portion 10864 would be moved relative to the slot 10102, and would retreat into the slot 10102, whereby to allow light to pass through the gap 1050.

In the current embodiment, the cover plate 1082 is received in the slot 10102 of the headrail 1010, and could be moved in and out of the slot 10102. When the covering assembly is in the fully open state, the cover plate 1082 would be not visible from outside. However, the cover plate 1082 could be alternatively provided on the outside of the headrail 1010 to meet different requirements, so that the cover plate 1082 would still cover the headrail 1010 when the covering assembly is in the fully open state.

A vertical blind 1100 using a light blocking system of the eleventh embodiment of the present invention is shown in FIG. 63 to FIG. 67, which is an embodiment having a cover plate which can be rolled up. The vertical blind 1100 includes a headrail 1110, a covering assembly hung below the headrail 1110, a control mechanism 1130, and a light blocking system 1180. The covering assembly includes a plurality of slats 1120, and a gap 1150 is left between a bottom of the headrail 1110 and a top edge of the slats 1120. The light blocking system 1180 includes a cover plate 1182 and a driving module, wherein the driving module in the current embodiment is a rolling mechanism 1184 provided in the headrail 1110. The rolling mechanism 1184 includes a driving portion, a motion portion, and a transmission member. The aforementioned components in the current embodiment are respectively a driving wheel 11842, a reel 11844, and a rotary wheel 11846, wherein the driving wheel 11842 meshes with the rotary wheel 11846, and the rotary wheel 11846 fits around the reel 11844 to be synchronously moved along with the reel 11844. The cover plate 1182 is made of a flexible material, and a lateral edge thereof in a longitudinal direction thereof winds around the reel 11844. Whereby, the cover plate 1182 could be rolled up or released by the reel 11844. Another lateral end of the cover plate 1182 is a free end.

The control mechanism 1130 includes a led gear 1132, a link gear 1134, and a link shaft 1136 provided in the headrail 1110, wherein the link shaft 1136 connect a turning mechanism of each of the slats 1120, and the link gear 1134 fits around the link shaft 1136 to be synchronously moved along with the link shaft 1136. The led gear 1132 meshes with the link gear 1134, and has an operation rod 1138 suspended below to be operated. The driving wheel 11842 of the rolling mechanism 1184 fits around the link shaft 1136 to be driven by the link shaft 1136. When the operation rod 1138 is rotated, the link gear 1134 and the link shaft 1136 would be driven through the led gear 1132, whereby to change an angle of the slats 1120. In addition, the reel 11844 would be also driven at the same time to roll up or release the cover plate 1182.

Figure 63:
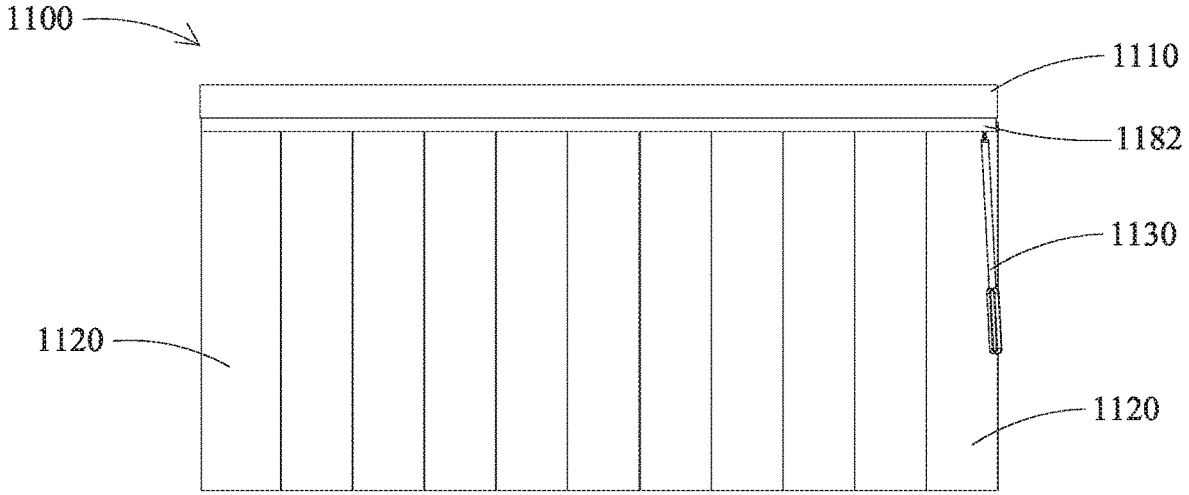
FIG. 63 is a front view of a vertical blind applied with the light blocking system of an eleventh embodiment of the present invention, wherein the covering assembly is in the closed state.
Figure 64:
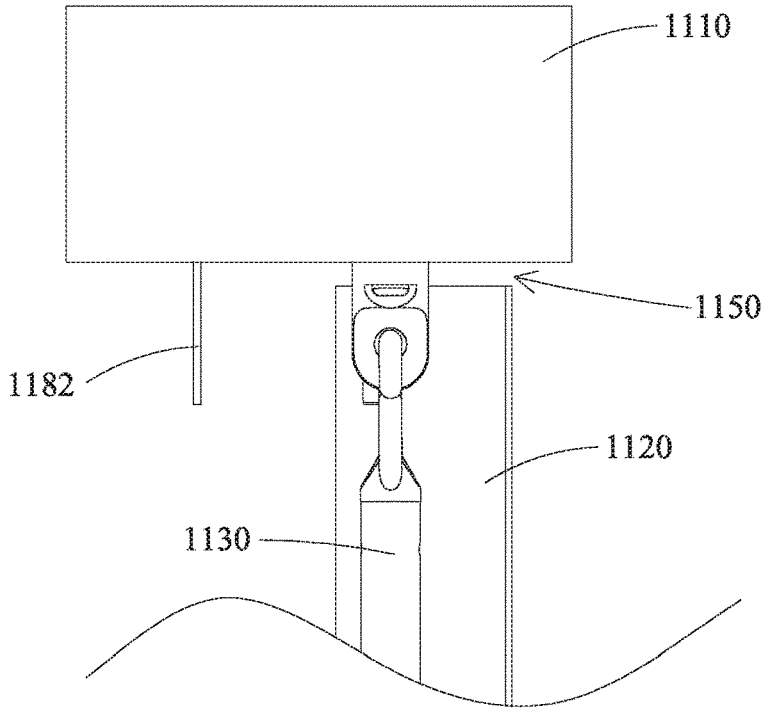
FIG. 64 is a partial side view of the vertical blind shown in FIG. 63, showing the gap is covered by the cover plate.
Figure 65:
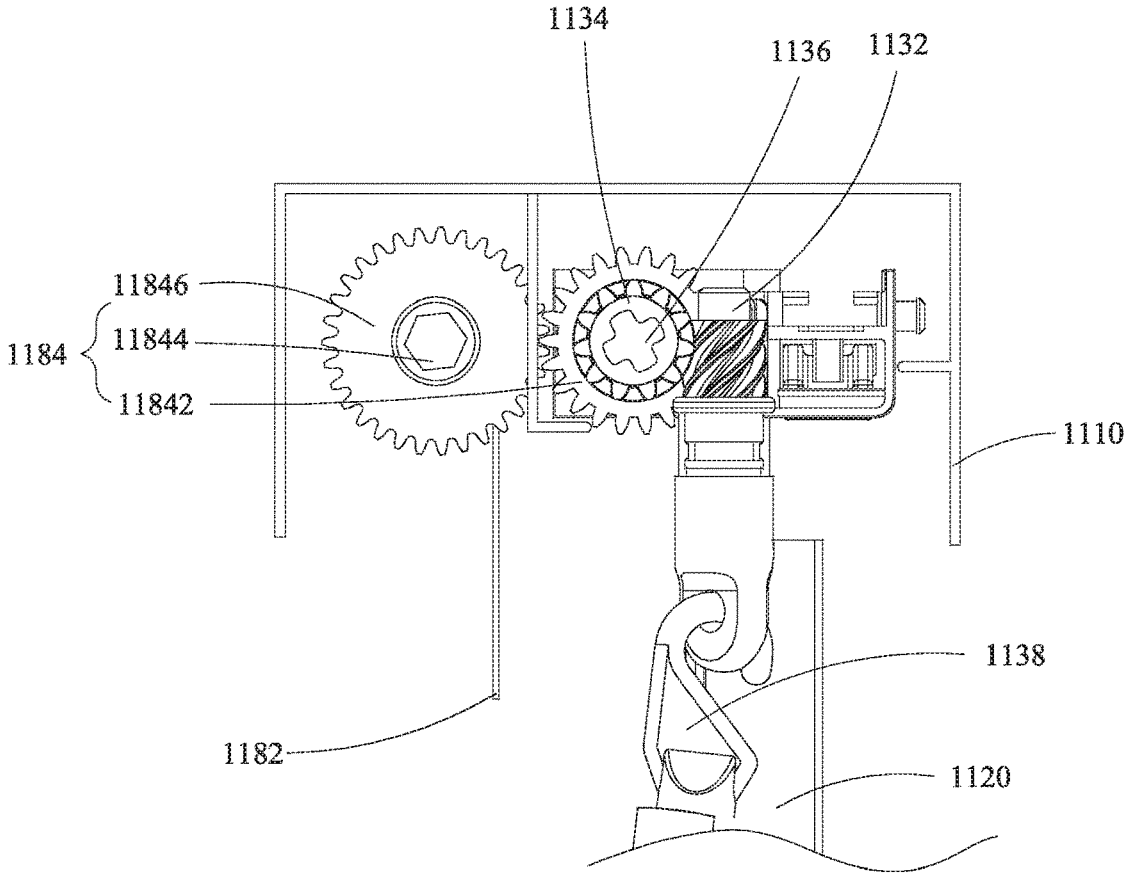
FIG. 65 is a side view of the vertical blind shown in FIG. 63, showing the link relationship between the light blocking system and the control mechanism.

FIG. 63 to FIG. 65 are different views showing the condition when the covering assembly of the vertical blind 1100 is in the closed state. In the current embodiment, when the led gear 1132 drives the link gear 1134 and the link shaft 1136 to rotate, changing the covering assembly toward the closed state, the driving wheel 11842 of the rolling mechanism 1184 would be also driven to rotate the rotary wheel 11846, whereby to drive the reel 11844 to rotate at the same time. In this way, the cover plate 1182 would extend out of the headrail 1110 to cover the gap 1150, which could prevent light from passing through.

Figure 66:
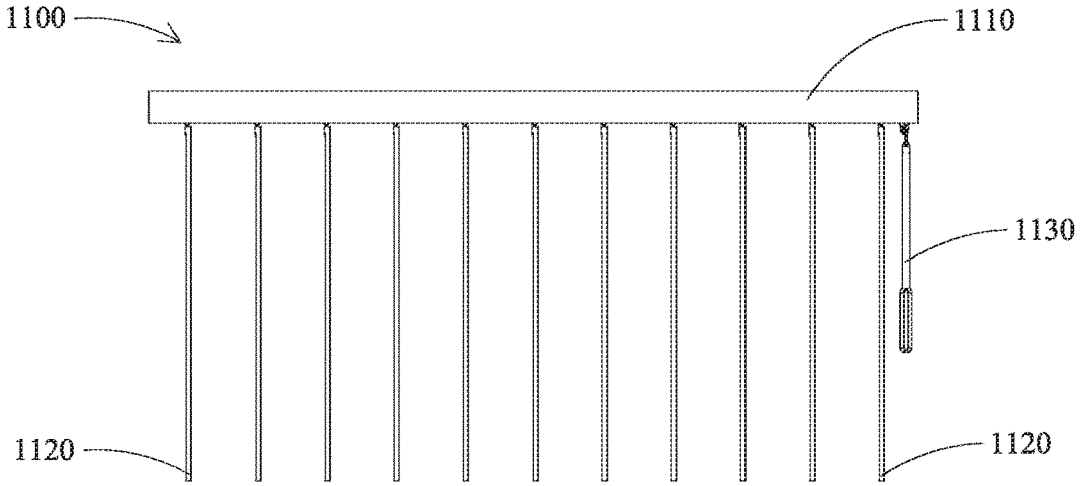
FIG. 66 is similar to FIG. 63, which is also a front view of the vertical blind applied with the light blocking system of the eleventh embodiment of the present invention, but the covering assembly is in the fully open state.
Figure 67:
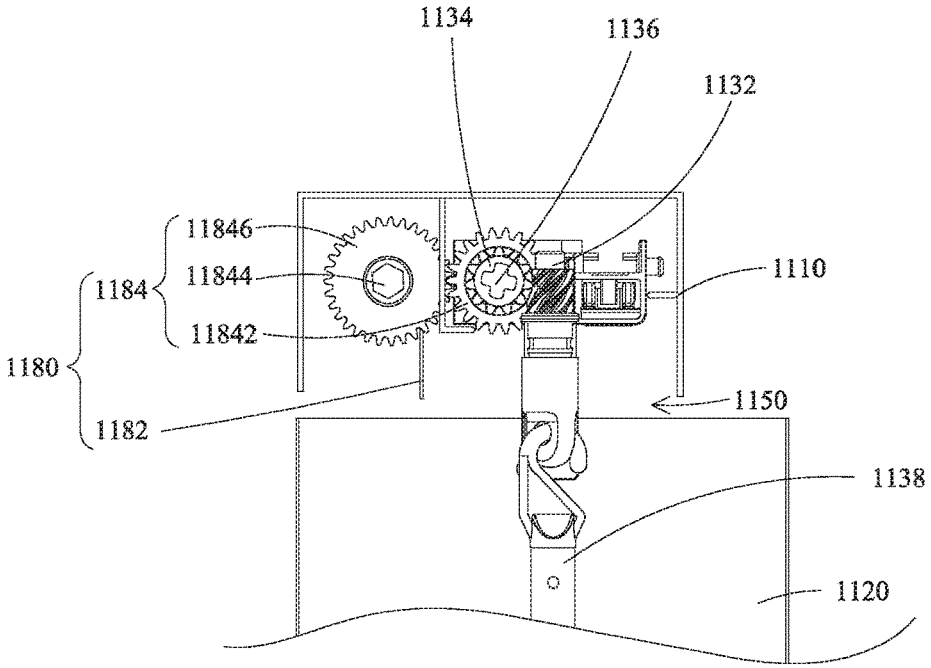
FIG. 67 is a partial side view of the vertical blind shown in FIG. 66, wherein the cover plate does not cover the gap.

FIG. 66 and FIG. 67 are different views showing the condition when the covering assembly of the vertical blind 1100 is in the fully open state. When the slats 1120 of the vertical blind 1100 are driven to turn by the control mechanism 1130, changing the covering assembly toward the fully open state, the reel 11844 of the rolling mechanism 1184 would be rotated, so that the cover plate 1182 would be rolled up around the reel 11844, and therefore would retreat into the headrail 1110, whereby to allow light to pass through the gap 1150.

Figure 68:
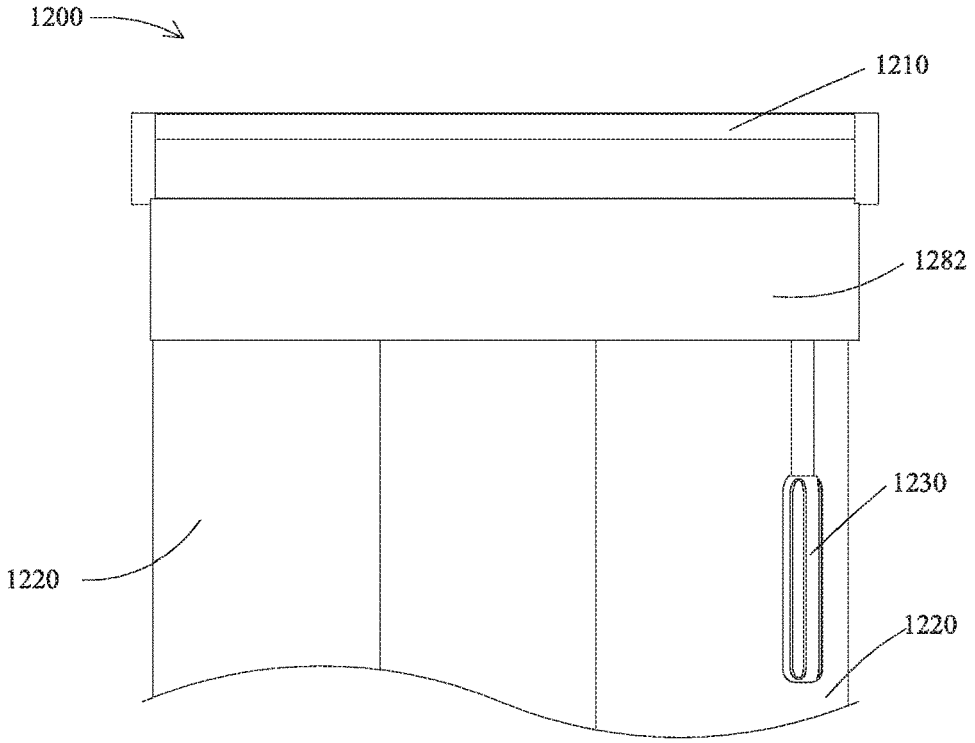
FIG. 68 is a front view of a vertical blind applied with the light blocking system of a twelfth embodiment of the present invention, wherein the covering assembly is in the closed state.
Figure 69:
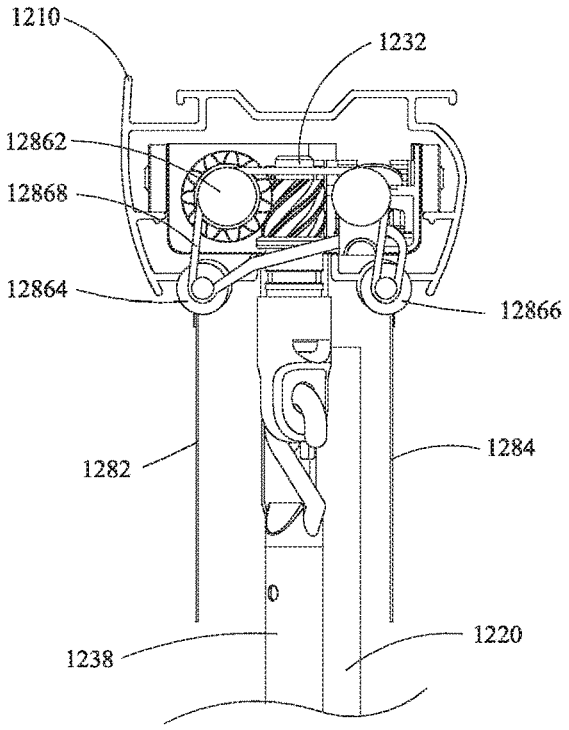
FIG. 69 is a partial side view of the vertical blind shown in FIG. 68, showing the arrangement of the light blocking system in the headrail.
Figure 70:
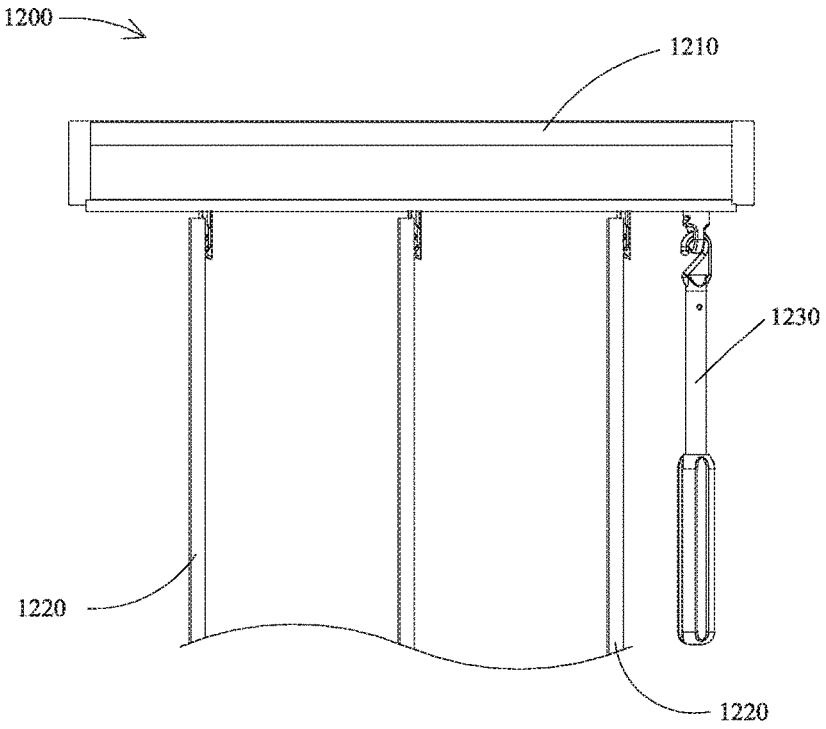
FIG. 70 is similar to FIG. 68, which is also a front view of the vertical blind applied with the light blocking system of the twelfth embodiment of the present invention, but the covering assembly is in the fully open state.

A vertical blind 1200 using the light blocking system of the twelfth embodiment of the present invention is shown in FIG. 68 to FIG. 70, which is an embodiment having a cover plate which can be rolled up. The vertical blind 1200 includes a headrail 1210, a covering assembly hung below the headrail 1210, a control mechanism 1230, and a light blocking system, wherein the covering assembly includes a plurality of slats 1220, and a gap 1250 is left between a bottom of the headrail 1210 and a top edge of the slats 1220. The light blocking system includes a front cover plate 1282, a rear cover plate 1284, and a driving module, wherein the driving module in the current embodiment is a rolling mechanism 1286.

The control mechanism 1230 includes a led gear 1232, a link gear 1234, and a link shaft 1236 provided in the headrail 1210, wherein the link shaft 1236 sequentially connects a turning mechanism of each of the slats 1220. The link gear 1234 fits around the link shaft 1236 to be synchronously moved along with the link shaft 1236. The led gear 1232 meshes with the link gear 1234, and has an operation rod 1238 suspended below to be operated. The rolling mechanism 1286 includes a driving portion 12862, motion portions 12864, 12866, and a transmission member 12868. In the current embodiment, the driving portion 12862 is a transmission wheel, each of the motion portions 12864, 12866 is a reel, and the transmission member 12868 is a transmission belt. The front cover plate 1282 and the rear cover plate 1284 are made of a flexible material, and respectively wind around the corresponding motion portions 12864, 12866 to be rolled up or released. The driving portion 12862 fits around the link shaft 1236 to be synchronously moved along with the link shaft 1236. The transmission member 12868 winds around the driving portion 12862 and the motion portions 12864, 12866 to make them move synchronously. With such design, the rolling mechanism 1286 could be synchronously moved along with the control mechanism 1230. When an angle of the slats 1220 is changed through the control mechanism 1230, the rolling mechanism 1286 would be also driven to operate, whereby to rolled up or to release the front cover plate 1282 and the rear cover plate 1284.

FIG. 68 and FIG. 69 are different views showing the condition when the covering assembly of the vertical blind 1200 is in the closed state, In the current embodiment, when the link gear 1234 and the link shaft 1236 are driven to rotate by the led gear 1232, changing the covering assembly toward the closed state, the driving portion 12862 of the rolling mechanism 1286 would be also driven at the same time to rotate the rotary wheel 12864, whereby to drive the motion portions 12864, 12866. As a result, the front cover plate 1282 and the rear cover plate 1284 would extend out of the headrail 1210 to cover the gap 1250, which could prevent light from passing through.

Figure 71:
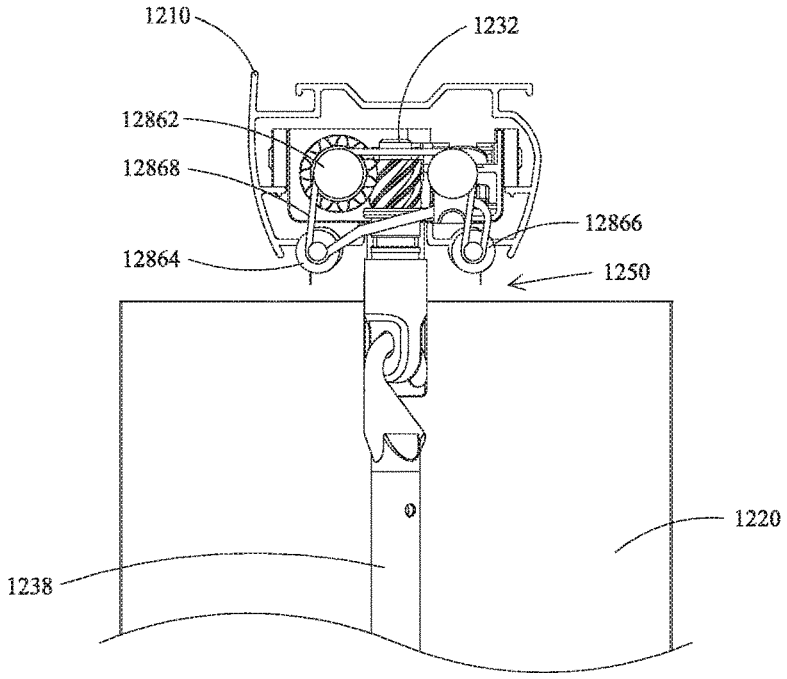
FIG. 71 is a partial side view of the vertical blind shown in FIG. 70, showing the arrangement of the light blocking system in the headrail.
Figure 72:
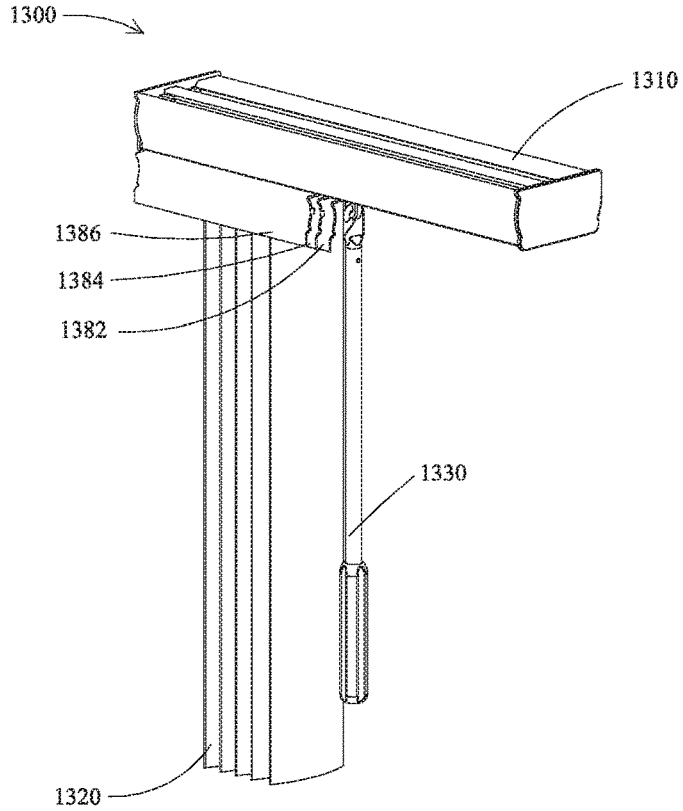
FIG. 72 is a front view of a vertical blind applied with the light blocking system of a thirteenth embodiment of the present invention, wherein the covering assembly is in the collapsed state.
Figure 73:
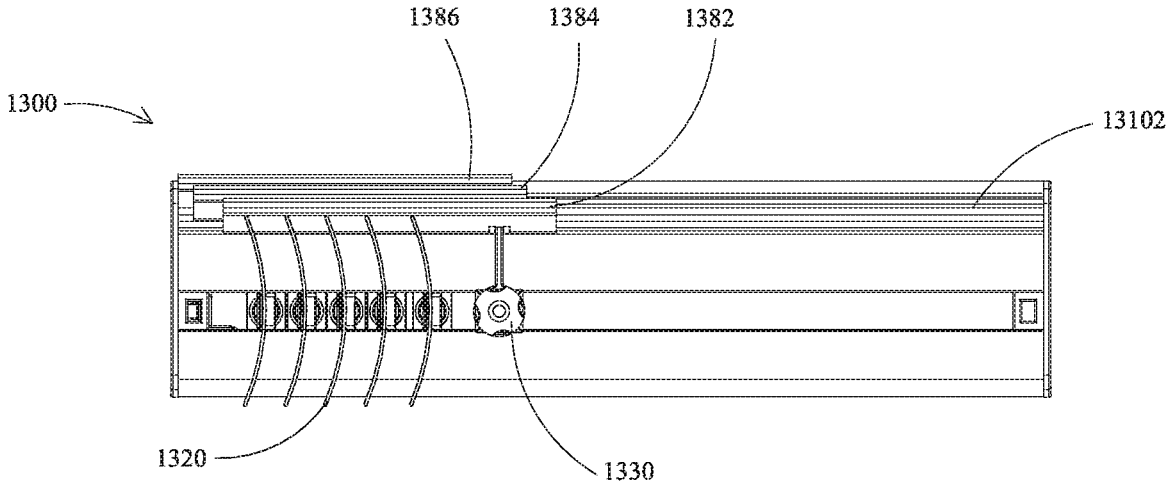
FIG. 73 is a bottom view of the vertical blind shown in FIG. 72.
Figure 74:
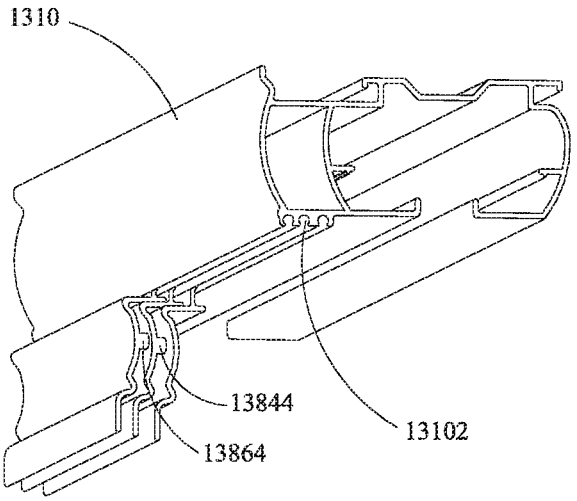
FIG. 74 is a partial perspective view of the vertical blind shown in FIG. 72, showing the cover plates overlap each other.
Figure 75:
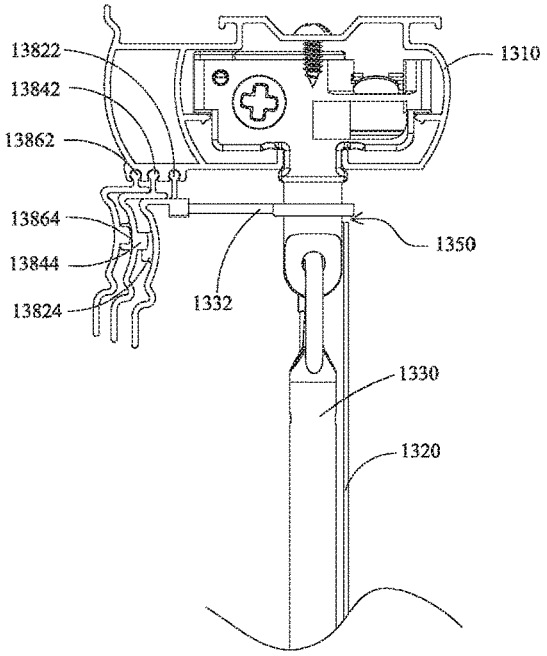
FIG. 75 is a partial side view of the vertical blind shown in FIG. 72.

FIG. 70 and FIG. 71 are different views showing the condition when the covering assembly of the vertical blind 1200 is in the fully open state. When the slats 1220 of the vertical blind 1200 is driven to turn by the control mechanism 1230, changing the covering assembly toward the fully open state, the motion portions 12864, 12866 of the rolling mechanism 1286 would be rotated, so that the front cover plate 1282 and the rear cover plate 1284 would be respectively rolled up around the corresponding motion portions 12864, 12866, and would no longer cover the gap 1250, whereby to allow light to pass through the gap 1250.

A vertical blind 1300 using a light blocking system of the thirteenth embodiment of the present invention is shown in FIG. 72 to FIG. 80, which is an embodiment that the cover plate could be moved in a longitudinal direction of the headrail. The vertical blind 1300 includes a headrail 1310, a covering assembly hung below the headrail 1310, a control mechanism 1330, and a light blocking system, covering assembly includes a plurality of slats 1320, and a gap 1350 is left between a bottom of the headrail 1310 and a top edge of the slats 1320. The light blocking system includes a first cover plate 1382, a second cover plate 1384, and a third cover plate 1386, wherein the first cover plate 1382 has a first connecting portion 13822 on an upper end thereof, the second cover plate 1384 has a second connecting portion 13842 on an upper end thereof, and the third cover plate 1386 has a third connecting portion 13862 on an upper end thereof. A bottom of the headrail 1310 has at least three guide slot 13102 on a front side thereof, each of which could be respectively inserted by one of the connecting portions 13822, 13842, 13862 of the cover plates 1382, 1384, 1386. Each of the cover plates 1382, 1384, 1386 could be moved along the corresponding guide slot 13102, and each of the cover plates 1382, 1384, 1386 partially overlaps the adjacent one of the cover plates 1382, 1384, 1386 in a transverse direction of the headrail 1310 due to the arrangements of the guide slots 13102. More specifically, in the transverse direction of the headrail 1310, each of the guide slots 13102 is closer to a front side of the vertical blind 1300 than the adjacent one of the guide slots 131012 which is on a left side thereof is. The first cover plate 1382 has a first stop portion 13824, the second cover plate 1384 has a second stop portion 13844, and the third cover plate 1386 has a third stop portion 13864, wherein two adjacent stop portions would stop each other to prevent the cover plates 1382, 1384, 1386 from disengaging from each other. The control mechanism 1330 has a connecting rod 1332, which extends to be connected to the first cover plate 1382, so that the first cover plate 1382 could be driven by the control mechanism 1330, and each of the cover plates 1382, 1384, 1386 could be sequentially moved due to the abutments between the stop portions 13824, 13844, 13864.

FIG. 72 to FIG. 75 are different views showing the condition when the covering assembly of the vertical blind 1300 is in a collapsed state. Said collapsed state refers to the state that the slats 1320 are driven by the control mechanism 1330 to gather at one side of the vertical blind 1300. At this time, the first cover plate 1382, the second cover plate 1384, and the third cover plate 1386 sequentially overlap each other at the same side with the slats 1310, so that a region under the headrail 1310 would be completely not covered.

Figure 76:
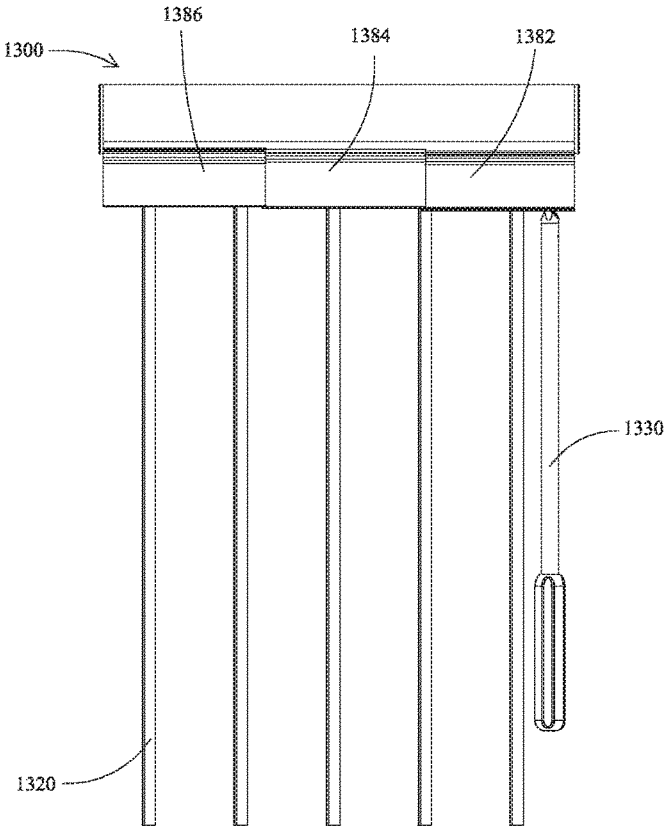
FIG. 76 is similar to FIG. 72, which is also a front view of the vertical blind applied with the light blocking system of the thirteenth embodiment of the present invention, but the covering assembly is in the fully open state.
Figure 77:
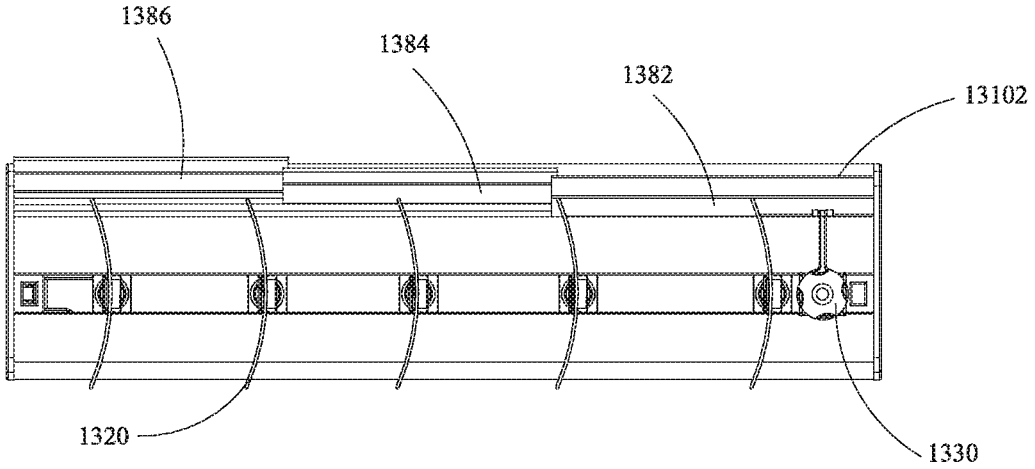
FIG. 77 is a bottom view of the vertical blind shown in FIG. 76.
Figure 78:
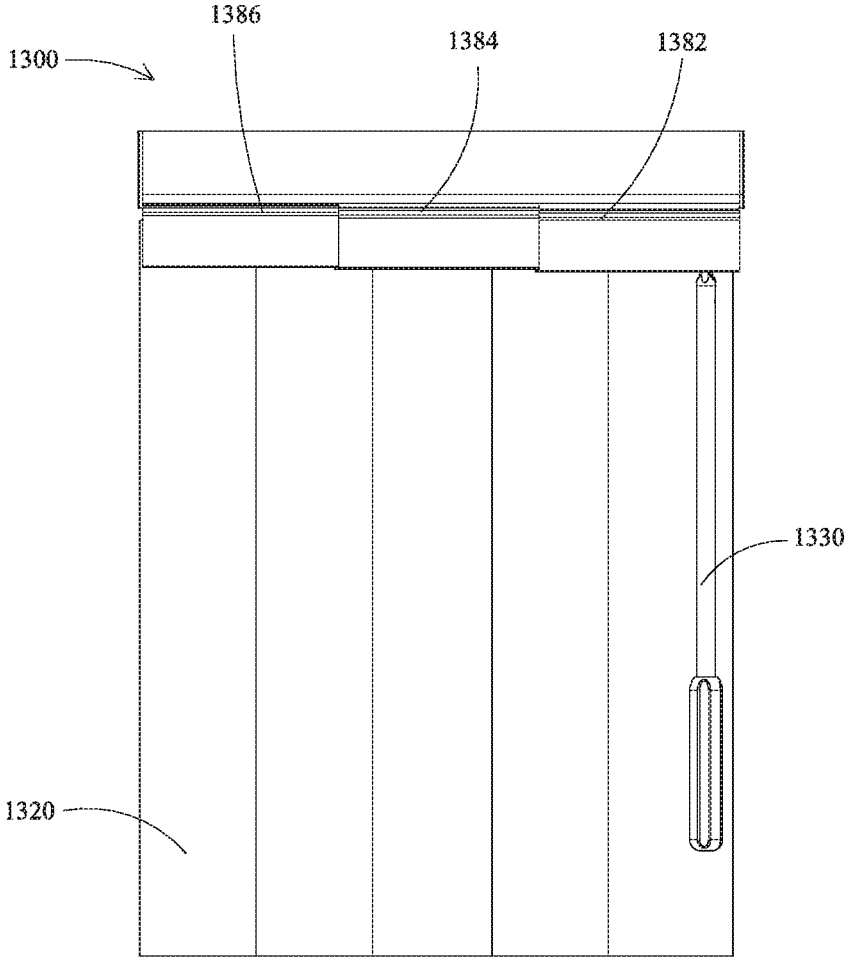
FIG. 78 is similar to FIG. 72, which is also a front view of the vertical blind applied with the light blocking system of the thirteenth embodiment of the present invention, but the covering assembly is in the closed state.
Figure 79:
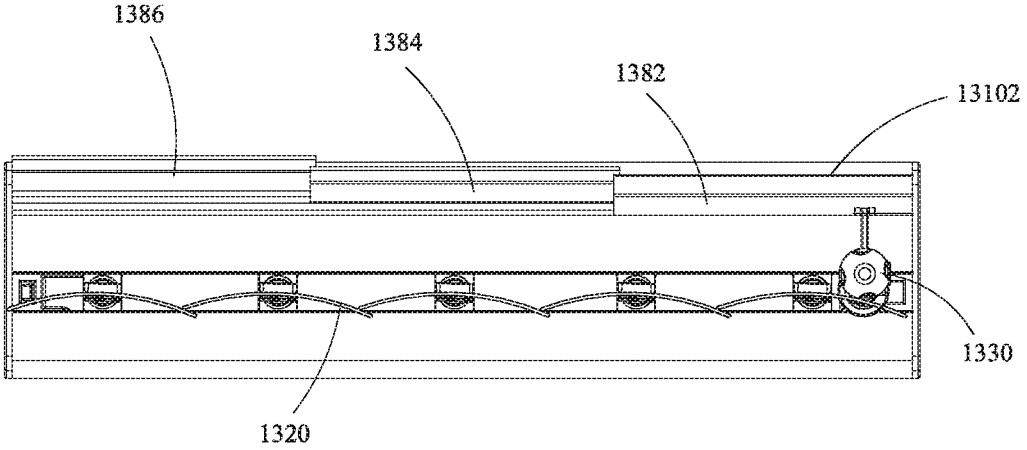
FIG. 79 is a bottom view of the vertical blind shown in FIG. 78.
Figure 80:
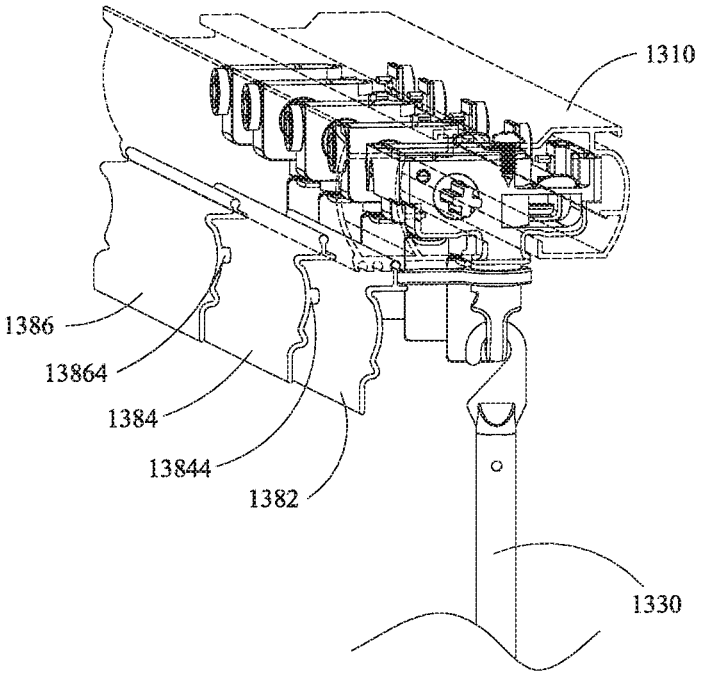
FIG. 80 is a partial perspective view of the vertical blind shown in FIG. 78, showing the cover plates are expanded.
Figure 81:
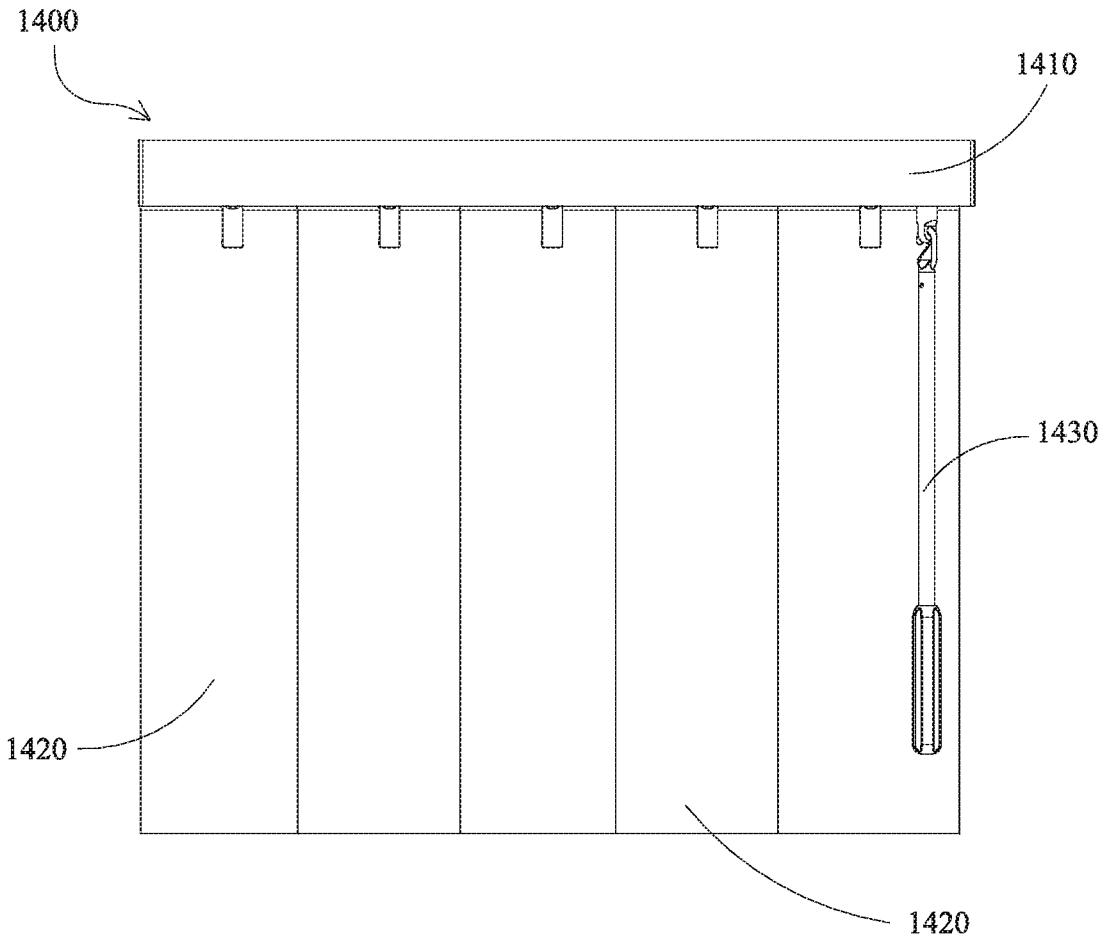
FIG. 81 is a front view of a vertical blind applied with the light blocking system of a fourteenth embodiment of the present invention, wherein the covering assembly is in the closed state.
Figure 82:
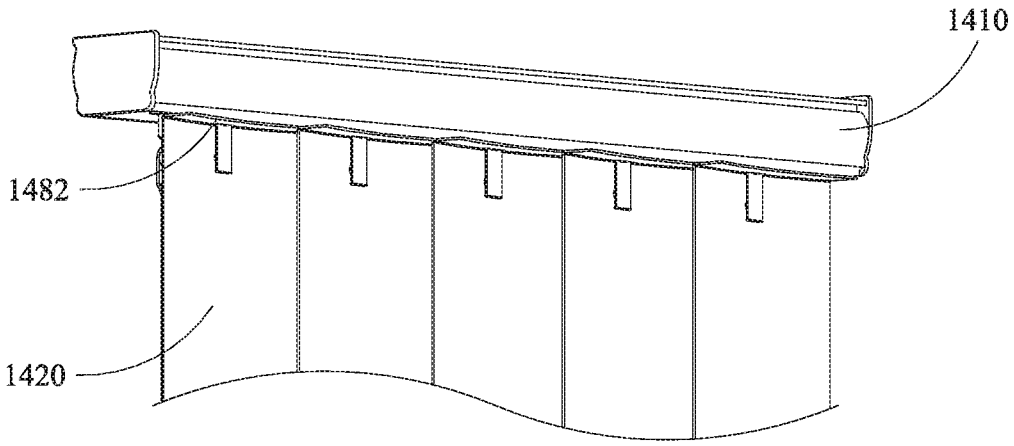
FIG. 82 is a partial perspective view of the vertical blind shown in FIG. 81, showing the slats are provided with shielding members.
Figure 83:
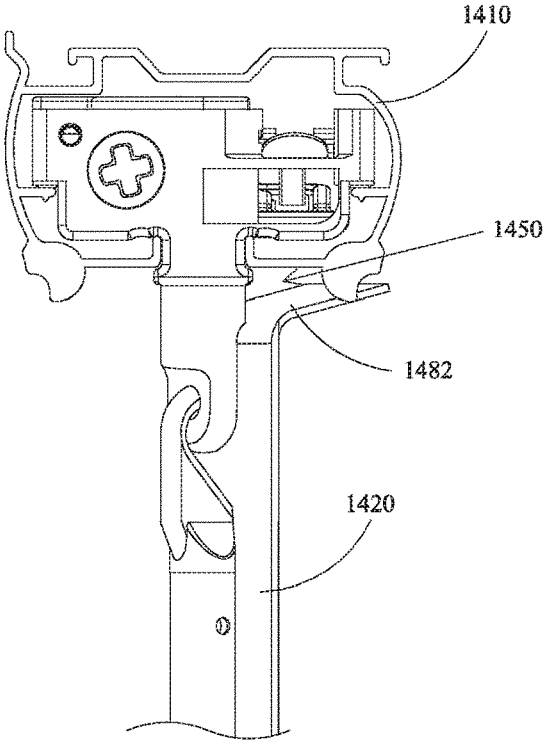
FIG. 83 is a partial side view of the vertical blind shown in FIG. 81.
Figure 84:
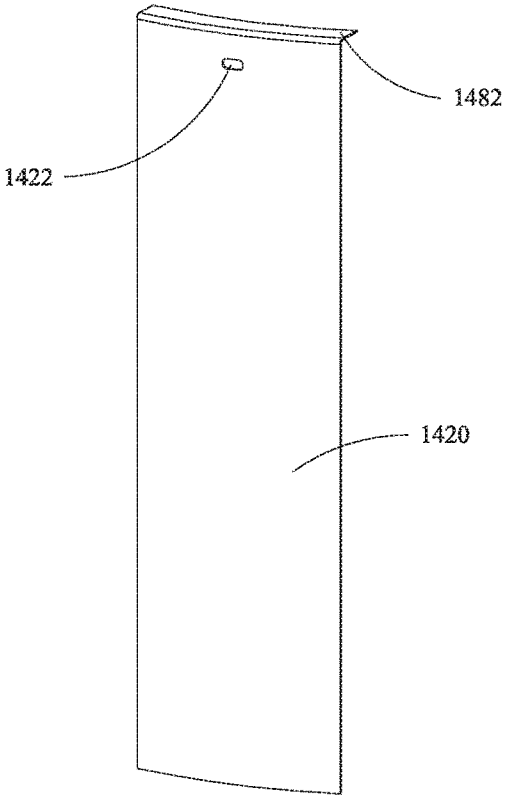
FIG. 84 is a perspective view of one of the slats of the vertical blind shown in FIG. 81.
Figure 85:
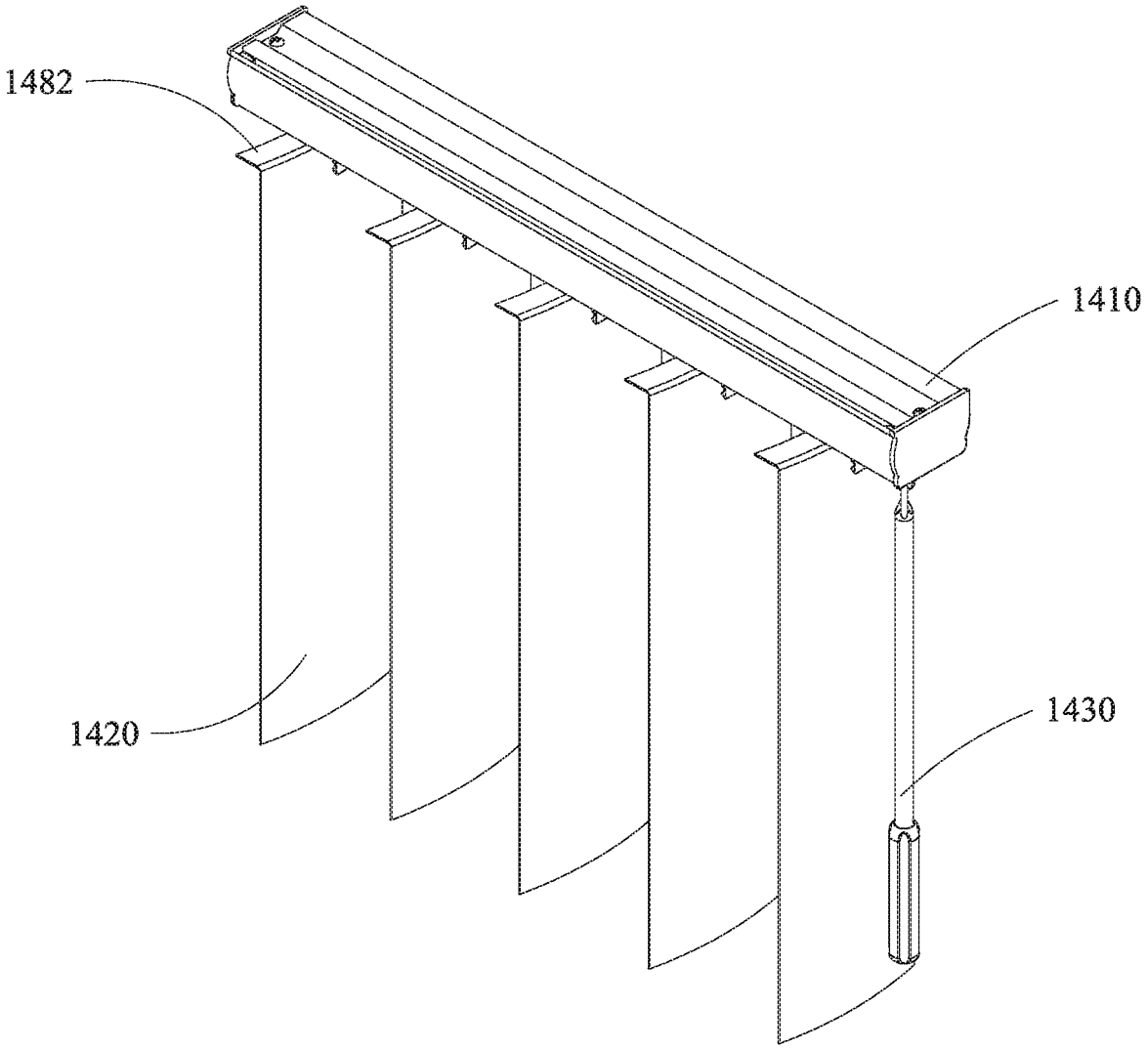
FIG. 85 is a perspective view of the vertical blind applied with the light blocking system of the fourteenth embodiment of the present invention, but the covering assembly is in the fully open state.

FIG. 76 and FIG. 77 are different views showing the condition when the covering assembly of the vertical blind 1300 is in the fully open state, and FIG. 78 to FIG. 80 are different views showing the condition when the covering assembly of the vertical blind 1300 is in the closed state. The control mechanism 1330 is adapted to pull and move the slats 1320 from the side to evenly distribute the slats 1320 under the headrail 1310, and during the process of moving the slats 1320, the first cover plate 1382, the second cover plate 1384, and the third cover plate 1386 would be also moved one by one, with the stop portion of each of the cover plates 1382, 1384, 1386 contacting and pushing the adjacent one of the cover plates 1382, 1384, 1386. In the end, the cover plates 1382, 1384, 1386 would be also evenly distributed below the headrail 1310 (as shown in FIG. 76 and FIG. 78), whereby to completely cover the gap 1350. On the other hand, while the covering assembly is changing between the fully open state and the closed state, the condition of each of the cover plates 1382, 1384, 1386 would not change, for the slats 1320 would not contact the cover plates 1382, 1384, 1386.

In the current embodiment, there are three cover plates corresponding to three guide slots, and the cover plates partially overlap each other with one in front of another. However, the numbers and the arrangements of the cover plates and the guide slots are not limitations of the present invention. There could be more or less cover plates and the guide slots to meet different requirements. In addition, in the current embodiment, the cover plates are made of a hard material, but the cover plates could be also made of a flexible material in other embodiments. There could be only one cover plate made of a flexible material matching one single guide slot, with other arrangements remained unchanged as mentioned in the above embodiment. Since the cover plate is flexible, the cover plate could be folded or bent at a side when the vertical blind is in the collapsed state; and when the vertical blind is in the fully open state or the closed state, the cover plate would become a planar screen to cover the gap between the headrail and the slats.

A vertical blind 1400 using a light blocking system of the fourteenth embodiment of the present invention is shown in FIG. 81 to FIG. 85, which is an embodiment that the cover plates are directly provided on the slats. The vertical blind 1400 includes a headrail 1410, a covering assembly hung below the headrail 1410, a control mechanism 1430, and a light blocking system, wherein the covering assembly includes a plurality of slats 1420, and the light blocking system includes a plurality of shielding members 1482. Each of the shielding members 1482 is provided on an end of one of the slats 1420 corresponding to the headrail 1410. A gap 1450 is left between the slats 1420 and the headrail 1410.

The shielding members 1482 are made of a soft material, a deformable material, or a flexible material. A height of each of the shielding members 1482 is equal to or greater than a height of the gap 1450, whereby the gap 1450 could be covered.

In conventional techniques, each of the slats is provided with a through hole corresponding to one of the clips of the turning mechanism, so that the slats are suspended from the turning mechanism. In other to provide sufficient space to install the slats, a gap has to be left in advance between the headrail and the top of the slats. In the current embodiment, the through hole 1422 of each of the slats 1420 is still provided at an upper portion of the corresponding slat 1420, and a gap 1450 is still left in advance between a top of the slats 1420 and the headrail 1410. However, the shielding members 1482 extending from the top of the slats 1420 is deformable when applied with force. Therefore, even though the height of each of the shielding members 1482 is equal to or greater than a distance of the gap 1450, the shielding members 1482 would not hinder the installation. Furthermore, no matter the covering assembly is in the fully open state or in the closed state, the shielding members 1482 would always effectively cover the gap 1450 to prevent light leakage.

In addition, in the current embodiment, each of the shielding members 1482 and the corresponding slat 1420 are made integrally, which could be made of same or different materials during the process of extrusion molding to meet different requirements. However, each of the shielding members 1482 and the corresponding slat 1420 could be independent components which are combined through gluing, stitching, or in other ways.

To prevent light leakages caused by the gap between the slats and the headrail and the through holes on the slats themselves, the aforementioned embodiments respectively disclose light blocking systems with different designs. However, it needs to be clarified that, the number of the cover plate, and the ways of engaging the cover plates and the headrail should not be limitations of the present invention. Besides of the cover plates which are made of a rigid material and are integrally made with the headrail, other types of pivotable cover plates should be able to pivot relative to the headrail. In addition, a restriction mechanism could be further provided between the control mechanism and the cover plate, whereby to position the cover plate at a required position. In this way, the cover plate could be no longer moved along with the control mechanism when the covering assembly is in the fully open state, but could be still synchronously moved along with the control mechanism when the covering assembly is changing back to the closed state or the another closed state.

It must be pointed out that the embodiments described above are only some preferred embodiments of the present invention. All equivalent structures which employ the concepts disclosed in this specification and the appended claims should fall within the scope of the present invention.

What is claimed is:

1. A light blocking system adapted to be used in a vertical blind, which comprises a headrail, a control mechanism, and a covering assembly, wherein a gap is formed between the headrail and the covering assembly; the control mechanism comprises an operable portion, a motion portion, and a plurality of clips, wherein the motion portion is provided in the headrail; the covering assembly comprises a plurality of slats, wherein each of the slats is suspended from a respective one of the plurality of clips with an end thereof, and therefore is hung below the headrail; each of the clips is rotatably connected to the motion portion; the operable portion is exposed out of the headrail to be operated, and drives the motion portion when operated, whereby to turn the slats in situ relative to the headrail, so that the covering assembly is adapted to be sequentially changed between a closed state, a fully open state, and another closed state; when the covering assembly is in the closed state and the another closed state, the slats overlap each other to block out light, wherein a surface of each of the slats faces opposite directions when the covering assembly is in the closed state and in the another closed state; when the covering assembly is in the fully open state, each of the slats is substantially perpendicular to a longitudinal direction of the headrail, which allows a most amount of light to pass through; the slats are operable to move back and forth in the longitudinal direction of the headrail; comprising:

a cover plate, which is disposed corresponding to the gap, and covers the gap when the covering assembly is in the closed state;

a driving module connected to the control mechanism;

wherein the cover plate is movable along with operation of the control mechanism; when the slats are driven to turn by the control mechanism, the cover plate is also driven by the control mechanism to cover or expose the gap;

wherein, when the control mechanism drives the slats to turn, the driving module is also driven by the control mechanism to move the cover plate.

2. The light blocking system of claim 1, wherein the cover plate also covers the gap when the covering assembly is in the another closed state.

3. The light blocking system of claim 1, wherein the motion portion comprises a led gear, a link gear, and a link shaft; each of the clips is rotatably connected to the link shaft; the operable portion is adapted to be operated to drive the led gear to rotate, and the led gear drives the link gear to rotate while being driven by the operable portion, so as to drive the link shaft to rotate as well, whereby to turn the slats in situ relative to the headrail; the driving module comprises a mounting portion and a pushing portion; the mounting portion is provided corresponding to the link shaft, and is synchronously movable with the link shaft; the pushing portion extends outward from the mounting portion, and a free end of the pushing portion optionally abuts against the cover plate; a maximum distance between the mounting portion and the free end of the pushing portion is greater than a distance between the mounting portion and the cover plate when the cover plate completely covers the gap; when the mounting portion rotates, the mounting portion drives the pushing portion to optionally push against the cover plate, so that the cover plate is pivotable relative to the headrail to cover or expose the gap.

4. The light blocking system of claim 3, wherein the mounting portion is connected to one of the clips or the led gear, so that the mounting portion is synchronously movable with the link shaft.

5. The light blocking system of claim 3, wherein the pushing portion is fixedly connected to a side of the mounting portion, so that the pushing portion is rotatable along with rotation of the mounting portion.

6. The light blocking system of claim 3, wherein the driving module further comprises a driving portion which has external teeth provided therearound; the driving portion fits around the link shaft to be synchronously moved along with the link shaft; the mounting portion is disposed between the driving portion and the pushing portion, wherein a segment of the mounting portion corresponding to the driving portion is provided with teeth to mesh with the external teeth of the driving portion, so that the mounting portion is drivable by the driving portion; a side of the pushing portion facing the mounting portion is provided with a toothed rack, and a segment of the mounting portion corresponding to the pushing portion is provided with teeth to mesh with the toothed rack; when the driving portion is rotated by the link shaft, the mounting portion drives the pushing portion to move back and forth in a direction parallel to a transverse direction of the headrail, whereby to optionally push against the cover plate.

7. The light blocking system of claim 1, wherein the motion portion comprises a led gear, a link gear, and a link shaft; each of the clips is rotatably connected to the link shaft; the operable portion is adapted to be operated to drive the led wheel to rotate, and the led gear drives the link gear to rotate while being driven by the operable portion, so as to drive the link shaft to rotate as well, whereby to turn the slats in situ relative to the headrail; the driving module comprises a driving portion, a mounting portion, and a pushing portion; the driving portion fits around the link shaft to be synchronously moved along with the link shaft; the driving portion has external teeth provided therearound; the mounting portion is disposed on a side of the driving portion, and is pivotally connected to the headrail; the mounting portion has external teeth provided therearound to mesh with the external teeth of the driving portion, so that the mounting portion is drivable by the driving portion to pivot relative to the headrail; the pushing portion extends outward from the mounting portion, and is connected to the cover plate; when the driving portion is rotated by the link shaft, the mounting portion drives the pushing portion to pivot, whereby to pivot the cover plate relative to the headrail.

8. The light blocking system of claim 1, wherein the motion portion comprises a led gear, a link gear, and a link shaft; each of the clips is rotatably connected to the link shaft; the operable portion is adapted to be operated to drive the led gear to rotate, and the led gear drives the link gear to rotate while being driven by the operable portion, so as to drive the link shaft to rotate as well, whereby to turn the slats in situ relative to the headrail; the driving module comprises a driving portion and a moving portion; the driving portion fits around the link shaft to be synchronously moved along with the link shaft, and the driving portion has external teeth provided therearound; the cover plate is provided on a side of the headrail, and the moving portion is provided on a surface of the cover plate facing the driving portion; the moving portion has a toothed rack meshing with the external teeth of the driving portion; when the driving portion rotates, the moving portion is driven by the driving portion to move up and down relative to the headrail.

9. The light blocking system of claim 1, wherein the motion portion comprises a led gear, a link gear, and a link shaft; each of the clips is rotatably connected to the link shaft; the operable portion is adapted to be operated to drive the led gear to rotate, and the led gear drives the link gear to rotate while being driven by the operable portion, so as to drive the link shaft to rotate as well, whereby to turn the slats in situ relative to the headrail; the driving module comprises a driving portion, a transmission member, and a motion portion; the driving portion fits around the link shaft to be synchronously moved along with the link shaft; the motion portion is provided to drive the cover plate, and the transmission member connects the driving portion and the motion portion in a way that the driving portion and the motion portion move synchronously; when the link shaft drives the driving portion to rotate, the driving portion drives the motion portion to rotate, and drives the cover plate to pivot about the motion portion.

10. The light blocking system of claim 1, wherein the motion portion comprises a led gear, a link gear, and a link shaft; each of the clips is rotatably connected to the link shaft; the operable portion is adapted to be operated to drive the led gear to rotate, and the led gear drives the link gear to rotate while being driven by the operable portion, so as to drive the link shaft to rotate as well, whereby to turn the slats in situ relative to the headrail; the driving module comprises a driving portion, a motion portion, and a transmission member; the driving portion fits around the link shaft to be synchronously moved along with the link shaft; the motion portion is a long rod, and an end of the cover plate is connected to the motion portion; the transmission member connects the driving portion and the motion portion in a way that the driving portion and the motion portion move synchronously; when the link shaft drives the driving portion to rotate, the driving portion drives the motion portion to rotate, and drives the cover plate to roll around the motion portion or to be released from the motion portion.

11. The light blocking system of claim 1, wherein the cover plate is long, and is connected to the headrail with a long edge thereof.

* * * * *